US011634906B2

(12) United States Patent
Kabatsi et al.

(10) Patent No.: US 11,634,906 B2
(45) Date of Patent: Apr. 25, 2023

(54) ARCHITECTURAL FIXTURE CONNECTION SYSTEM

(71) Applicant: Arktura LLC, Gardena, CA (US)

(72) Inventors: Chris Kabatsi, Venice, CA (US); Robert Kilian, Venice, CA (US); Kevin Kane, Los Angeles, CA (US); Moti Tavassoli, Los Angeles, CA (US); John Johnston, Beaumont, CA (US); Jason Gillette, Rotterdam (NL)

(73) Assignee: ARKTURA LLC, Gardena, CA (US)

( * ) Notice: Subject to any disclaimer, the term of this patent is extended or adjusted under 35 U.S.C. 154(b) by 217 days.

(21) Appl. No.: 16/863,949

(22) Filed: Apr. 30, 2020

(65) Prior Publication Data

US 2021/0340761 A1 Nov. 4, 2021

(51) Int. Cl.

| | |
|---|---|
| ***E04B 9/00*** | (2006.01) |
| ***E04B 9/34*** | (2006.01) |
| ***E04F 13/08*** | (2006.01) |

(52) U.S. Cl.

CPC ..... *E04B 9/005* (2013.01); *E04B 9/34* (2013.01); *E04F 13/08* (2013.01)

(58) Field of Classification Search

CPC ..... E04B 9/001; E04B 9/005; E04B 9/0428; E04B 9/04; E04B 9/0414; E04B 9/0421; E04B 9/0435; E04B 9/0457; E04B 1/32; E04B 1/378; E04B 1/34357; E04B 1/34384; E04B 1/343; E04B 1/3442; E04B 1/3444; E04B 1/3445; E04B 1/02; E04B 1/12; E04B 1/5818; E04B 1/5825; E04B 1/5831; E04B 2001/5856; E04B 2001/5868; E04B 2001/5881

USPC ..... 52/DIG. 8, 835, 839, 842, 844, 845

See application file for complete search history.

(56) References Cited

U.S. PATENT DOCUMENTS

| | | | | |
|---|---|---|---|---|
| 2,557,412 | A * | 6/1951 | Clements | E06B 3/82 52/794.1 |
| 2,689,026 | A | 9/1954 | Zingone | |
| 2,871,598 | A * | 2/1959 | Pawelka | G09F 13/00 40/571 |
| 3,277,624 | A * | 10/1966 | Cornell | E04B 9/005 52/506.06 |
| 3,385,557 | A * | 5/1968 | Rambelle | E04G 11/50 52/363 |
| 3,539,425 | A * | 11/1970 | Marburg | A47B 88/9416 156/247 |

(Continued)

FOREIGN PATENT DOCUMENTS

| | | | |
|---|---|---|---|
| EP | 0210385 | A2 | 4/1987 |
| WO | 2019183250 | A1 | 9/2019 |

*Primary Examiner* — Jessica L Laux

(74) *Attorney, Agent, or Firm* — The Belles Group, PC

(57) ABSTRACT

An architectural fixture assembly including a generally U-shaped first beam having a bottom side, a first side, a second side, and a first end. Interior surfaces of the first, second, and bottom sides of the first beam define an interior portion. A connector includes a plate, and a connection key extending away from the plate. The interior surfaces of the first and second sides each include a generally V-shaped alignment notch disposed generally adjacent to the first end of the beam. The connection key includes a pair of generally V-shaped sides disposed on opposite sides of the connection key, and each generally V-shaped side is configured to slidably engage one of the generally V-shaped alignment notches.

45 Claims, 75 Drawing Sheets

(56) References Cited

U.S. PATENT DOCUMENTS 3,890,415 A * 6/1975 Hull ..... E04B 9/005 264/46.7
4,000,594 A * 1/1977 Kirk, Jr. ..... E04B 2/7409 52/745.12
4,034,534 A 7/1977 Taylor
4,200,171 A 4/1980 Seymour et al.
4,625,470 A 12/1986 Heritage
4,718,213 A * 1/1988 Butterfield ..... E04B 9/005 D25/138
5,316,165 A * 5/1994 Moran, Jr. ..... H02B 1/40 229/165
5,355,604 A * 10/1994 Rathke ..... G09F 13/04 248/323
5,555,989 A * 9/1996 Moran, Jr. ..... H02G 3/10 220/4.28
5,927,841 A * 7/1999 Ferrari ..... A47B 88/9416 312/348.1
6,098,353 A * 8/2000 Stanfield ..... E01F 9/685 52/848
7,578,107 B2 8/2009 Platt
8,438,893 B2 * 5/2013 Durney ..... B65D 7/08 72/332
8,733,053 B2 5/2014 Kabatsi et al.
8,782,987 B2 7/2014 Kabatsi et al.
9,045,931 B2 6/2015 Damen et al.
D767,816 S 9/2016 Kilian et al.
9,441,373 B1 * 9/2016 Header ..... B27D 5/003
D777,349 S 1/2017 Kilian et al.
D777,943 S 1/2017 Kilian et al.
D777,944 S 1/2017 Kilian et al.
D777,945 S 1/2017 Kilian et al.
D777,946 S 1/2017 Kilian et al.
2012/0324821 A1 * 12/2012 Kordecki ..... E04G 25/066 52/708
2016/0281353 A1 9/2016 Gillette et al.
2018/0283004 A1 10/2018 Gillette et al.
2019/0161966 A1 5/2019 Friez
2019/0249408 A1 8/2019 Wyllie et al.
2020/0109560 A1 4/2020 Headley et al.

* cited by examiner

ARCHITECTURAL FIXTURE CONNECTION SYSTEM

FIELD OF THE INVENTION

The present invention relates generally to the field of ceiling and wall fixtures. More particularly, the present invention relates to an architectural fixture connection system.

BACKGROUND

Fixtures have conventionally provided only horizontally oriented surfaces or vertically oriented planar segments.

Co-owned U.S. Pat. No. 8,733,053 discloses systems and methods for supported architectural designs. Co-owned U.S. Pat. No. 8,782,987 discloses supported architectural structures.

There is a need for new types of acoustical ceiling and wall architectural fixtures. There is a further need for an improved architectural fixture providing sound-absorption. There is an additional need for an improved architectural fixture that provides a modular construction. There is also a need for an improved architectural fixture that provides improved connection between components of the fixture. There is a need for an improved architectural fixture that provides for various configurations of the fixture. There is a further need for an improved architectural fixture that provides routing and/or support for various objects. There is an additional need for a holder that is easier to manufacture, assemble, adjust, and maintain. The present invention satisfies these needs and provides other related advantages.

SUMMARY

An architectural fixture described herein provides sound-absorption. An architectural fixture described herein provides a modular construction. An architectural fixture described herein provides improved connection between components of the fixture. An architectural fixture described herein provides for various configurations of the fixture. An architectural fixture described herein provides routing and/or support for various objects. An architectural fixture described herein provides easier manufacture, assembly, adjustment, and maintenance.

An embodiment of the invention provides an architectural fixture assembly including a generally U-shaped first beam including a bottom side, a first side, a second side, and a first end, wherein interior surfaces of the first, second, and bottom sides of the first beam define an interior portion. The assembly also includes a connector having a plate, and a connection key extending away from the plate. The interior surfaces of the first and second sides each include a generally V-shaped alignment notch disposed generally adjacent to the first end of the beam. The connection key includes a pair of generally V-shaped sides disposed on opposite sides of the connection key, and each generally V-shaped side is configured to slidably engage one of the generally V-shaped alignment notches.

Another embodiment of the invention provides that the connector further includes a flange configured to be secured to a generally flat surface.

Various additional embodiments of the invention can include objects operationally engaging the plate. These objects can include, without limitation, a light fixture, an audio speaker, a sign, a planter, and a sprinkler of a sprinkler system.

Another embodiment of the invention provides a generally U-shaped second beam including a bottom side, a first side, a second side, and a first end. The interior surfaces of the first, second, and bottom sides of the second beam define an interior portion. The interior surfaces of the first and second sides of the second beam each include a generally V-shaped alignment notch disposed generally adjacent to the first end of the second beam. The connector further includes a second plate, and a second connection key extending away from the second plate. The second connection key includes a pair of generally V-shaped sides disposed on opposite sides of the second connection key, and wherein each generally V-shaped side of the second connection key is configured to slidably engage one of the generally V-shaped alignment notches of the second beam.

In the assembly described above, the connector may be configured to engage the first and second beams to form a generally L-shaped beam configuration.

In an additional embodiment of the invention, the assembly further provides a plurality of generally U-shaped beams. Each beam of the plurality of beams includes a bottom side, a first side, a second side, and a first end, and interior surfaces of the first, second, and bottom sides of each beam of the plurality of the beams define an interior portion of that beam. The interior surfaces of the first and second sides of each beam of the plurality of beams each include a generally V-shaped alignment notch disposed generally adjacent to the first end of the that beam. The connector further includes a plurality of plates, and a plurality of connection keys. Each connection key extends away from a particular one of the plurality of plates, and each connection key of the plurality of connection keys includes a pair of generally V-shaped sides disposed on opposite sides of that connection key. Each generally V-shaped side of each connection key of the plurality of connection keys is configured to slidably engage a particular one of the generally V-shaped alignment notches of a particular beam of the plurality of beams.

Various additional embodiments of the invention can be configured by how the connector is varied in configuration. For example, the plates of the connector can be configured in a quadrangle. In another example, the connector may be configured to engage the beams to form a generally L-shaped beam configuration. In a further example, the connector is configured to engage the beams to form a generally Y-shaped beam configuration. In an additional example, the connector is configured to engage the beams to form a generally T-shaped beam configuration. In still another example, the connector is configured to engage the beams to form a generally X-shaped beam configuration. In the assembly described above, a shape of a beam configuration may be configured from a number of plates of the plurality of plates of the connector, wherein each plate of the number of plates includes one of the plurality of connection keys extending away therefrom and engaging a particular one of the beams.

In an additional embodiment, the beam(s) of an assembly may be made from of a sound-absorbing material.

Various additional embodiments of the invention may be provided by adapting a beam(s) such that various objects or systems are at least partially disposed within the interior portion of a beam(s). For example, these objects or systems can include a light fixture. In an additional embodiment, the beam may be made from a light-diffusive material configured to glow when the light fixture is illuminated. Other examples include, without limitation, a speaker of a speaker system, a planter, a portion of a sprinkler system, a portion of an HVAC system, additional sound-absorbing material, a router or other wireless system, etc.

In an additional embodiment, the assembly further includes a spacer having a pair of generally V-shaped sides disposed on opposite sides of the spacer. The interior surfaces of the first and second sides of each beam each include a second generally V-shaped alignment notch disposed generally adjacent to the V-shaped alignment notch disposed generally adjacent to the first end of the beam, and each generally V-shaped side of the spacer is configured to engage one of the second generally V-shaped alignment notches.

In accordance with a further embodiment of the invention, an architectural fixture assembly includes first and second beams, where each beam is generally U-shaped, and includes a bottom side, a first side, a second side, and a first end. The interior surfaces of the first, second, and bottom sides of each beam define an interior portion. The assembly also has a connector that includes first and second connection keys. The interior surfaces of the first and second sides of each beam each include a generally V-shaped alignment notch disposed generally adjacent to the first end of the beam. Each connection key includes a pair of generally V-shaped sides disposed on opposite sides of the connection key. The generally V-shaped sides of the first connection key are configured to slidably engage the generally V-shaped alignment notches of the first beam, and the generally V-shaped sides of the second connection key are configured to slidably engage the generally V-shaped alignment notches of the second beam. In a further embodiment, the second beam may be curved.

In accordance with a further embodiment of the invention, an architectural fixture assembly includes a generally U-shaped first beam including a bottom side, a first side, and a second side. An exterior surface of the first side of the beam includes a recess formed therein, and the recess includes a pair of generally V-shaped alignment notches. Each alignment notch is disposed on an opposite side of the recess from the other alignment notch. The assembly also includes a generally U-shaped second beam including a bottom side, a first side, a second side, and a first end. Interior surfaces of the first, second, and bottom sides of the second beam define an interior portion. The interior surfaces of the first and second sides of the second beam each include a generally V-shaped alignment notch disposed generally adjacent to the first end of the second beam. A connector includes first and second connection keys. Each connection key includes a pair of generally V-shaped sides disposed on opposite sides of the connection key. The generally V-shaped sides of the first connection key are configured to slidably engage the generally V-shaped alignment notches of the first beam, and the generally V-shaped sides of the second connection key are configured to slidably engage the generally V-shaped alignment notches of the second beam.

In accordance with a further embodiment of the invention, an architectural fixture assembly includes first and second beams. Each beam is generally U-shaped, and includes a bottom side, a first side, a second side, and a first end. Interior surfaces of the first, second, and bottom sides of each beam define an interior portion. The assembly also includes a connector having a generally V-shaped first side, and a generally V-shaped second side on an opposite side of the connector from the first side. The first end of each beam is angled from the second side to the first side, whereby the first ends of the beams are configured to directly engage each other such that the beams are at an angle to each other. The interior surfaces of the first side of the first beam and the second side of the second beam are configured to form a generally V-shaped first alignment feature when the first ends of the beams are in direct engagement. The interior surfaces of the second side of the first beam and the first side of the second beam are configured to form a generally V-shaped second alignment feature when the first ends of the beams are in direct engagement. The generally V-shaped first side of the connector is configured to slidably engage the generally V-shaped first alignment feature of the engaged beams, and the generally V-shaped second side of the connector is configured to slidably engage the generally V-shaped second alignment feature of the engaged beams. In an additional embodiment of the foregoing assembly, the interior surface of the first side of the first beam includes a generally V-shaped alignment notch disposed generally adjacent to the first end of the beam, and the interior surface of the second side of the second beam includes a generally V-shaped alignment notch disposed generally adjacent to the first end of the second beam. The generally V-shaped first alignment feature of the engaged beams includes the generally V-shaped alignment notches.

In accordance with still another embodiment of the invention, an architectural fixture assembly includes first and second beams. Each beam is generally U-shaped, and includes a bottom side, a first side, a second side, and a first end. Interior surfaces of the first, second, and bottom sides of each beam define an interior portion. The first and second sides of each beam each include a pair of notches. The pairs of notches of the second beam extends downward from a top side of the second beam towards the bottom side of the second beam, and the pairs of notches of the first beam extend upward from the bottom side of the first beam towards a top side of the first beam. A first notch of the pair of notches of the first side of the first beam engages a second notch of the pair of notches of the first side of the second beam and a second notch of the pair of notches of the first side of the first beam engages a second notch of the pair of notches of the second side of the second beam. A first notch of the pair of notches of the second side of the first beam engages a first notch of the pair of notches of the first side of the second beam and a second notch of the pair of notches of the second side of the first beam engages a first notch of the pair of notches of the second side of the second beam.

The foregoing assembly can be further configured into another embodiment such that the first and second sides of the first beam each further include a second pair of notches configured to engage a third beam. In an example of another embodiment, the first and second sides of the first beam each further include a plurality of pairs of notches configured to engage a plurality of beams. In a further example of another embodiment, the first and second sides of the second beam each further include a second pair of notches configured to engage a third beam. In yet another example, the first and second sides of the second beam each further include a plurality of pairs of notches configured to engage a plurality of beams.

In accordance with a still further embodiment of the invention, the first and second sides of the first beam each further include a second pair of notches configured to engage particular notches of a third beam. The first and second sides of the second beam each further include a second pair of notches configured to engage particular notches of a fourth beam. The third beam and fourth beams engage each other such that the first, second, third and fourth beams are configured to form a lattice. In accordance with another embodiment, the foregoing assembly further includes a first connector including first and second connection keys; and a second connector including first and second connection keys. The lattice comprises a first lattice. The third beam of the first lattice is generally U-shaped, and includes a bottom side, a first side, a second side, a first end, and a second end. Interior surfaces of the first, second, and bottom sides of the third beam of the first lattice defines an interior portion. The second beam of the first lattice includes a second end. The assembly further includes a second lattice including first, second, third, and fourth beams, wherein each beam of the second lattice is generally U-shaped, and includes a bottom side, a first side, a second side, a first end, and a second end. Interior surfaces of the first, second, and bottom sides of the each beam of the second lattice define an interior portion. Interior surfaces of the first and second sides of the second and third beams of the first lattice each include a generally V-shaped alignment notch disposed generally adjacent to the second end of the beam. The interior surfaces of the first and second sides of the second and third beams of the second lattice each include a generally V-shaped alignment notch disposed generally adjacent to the first end of the beam. Each connection key includes a pair of generally V-shaped sides disposed on opposite sides of the connection key. The generally V-shaped sides of the first connection key of the first connector are configured to slidably engage the generally V-shaped alignment notches of the second beam of the first lattice, and the generally V-shaped sides of the second connection key of the first connector are configured to slidably engage the generally V-shaped alignment notches of the second beam of the second lattice. The generally V-shaped sides of the first connection key of the second connector are configured to slidably engage the generally V-shaped alignment notches of the third beam of the first lattice, and the generally V-shaped sides of the second connection key of the second connector are configured to slidably engage the generally V-shaped alignment notches of the third beam of the second lattice. The first lattice and the second lattice engage each other such that the first and second lattices are configured to form a larger lattice.

In accordance with another embodiment of the invention, an architectural fixture assembly includes first and second beams. Each beam includes a bottom side, a first side, a second side, a first end, and a second end, and each beam is foldable between a generally flat, sheet-like configuration and a generally rectangular beam configuration. Each beam each includes an alignment notch along a length of that beam. The alignment notch of the first beam extends downward from a top side of the first beam towards the bottom side of the first beam, and the alignment notch of the second beam extends upward from the bottom side of the second beam towards a top side of the second beam. The alignment notch of the first beam engages the alignment notch of the second beam such that the top side of the first beam is aligned with the top side of the second beam when the beams are engaged, and the bottom side of the first beam is aligned with the bottom side of the second beam when the beams are engaged. The engagement of the beams gives the appearance of that the first and second beams are intersecting.

The second beam includes a second alignment notch configured to engage a third beam, and the third beam includes an alignment notch. The second alignment notch of the second beam extends downward from a top side of the second beam towards the bottom side of the second beam, and the alignment notch of the third beam extends upward from the bottom side of the third beam towards a top side of the third beam. The alignment notch of the third beam engages the second alignment notch of the second beam such that the top side of the third beam is aligned with the top sides of the first and second beams when the second and third beams are engaged, and the bottom side of the third beam is aligned with the bottom sides of the first and second beams when the second and third beams are engaged. The engagement of the beams gives the appearance of that the first, second, and third beams are intersecting.

In accordance with still another embodiment of the invention, an architectural fixture assembly includes first and second fins. Each fin includes a top side, a bottom side, and a plurality of pairs of alignment notches along a length of the fin. The assembly also includes a first plurality of generally U-shaped beams. Each beam includes a bottom side, a first side, a second side, a first end, and a second end, and interior surfaces of the first, second, and bottom sides of the each beam define an interior portion of the beam. The first and second sides of each beam each include an alignment notch disposed near the first end of the beam, and an alignment notch disposed near the second end of the beam. The beams of the first plurality of beams are generally disposed between the first and second fins, with the alignment notches of the first end of each beam aligned with and engaging a particular pair of alignment notches of the first fin, and the alignment notches of the second end of each beam aligned with and engaging a particular pair of alignment notches of the second fin.

The assembly further includes a third fin having a top side, a bottom side, and a plurality of pairs of alignment notches along a length of the third fin. The assembly also includes a second plurality of generally U-shaped beams where each beam of the second plurality of beams includes a bottom side, a first side, a second side, a first end, and a second end. The interior surfaces of the first, second, and bottom sides of the each beam of the second plurality of beams define an interior portion of the beam. The first and second sides of each beam of the second plurality of beams each include an alignment notch disposed near the first end of the beam, and an alignment notch disposed near the second end of the beam. The beams of the second plurality of beams are generally disposed between the third and second fins, with the alignment notches of the first end of each beam of the second plurality of beams aligned with and engaging a particular pair of alignment notches of the third fin. The alignment notches of the second end of each beam of the second plurality of beams are aligned with and engaging a particular pair of alignment notches of the second fin.

The assembly further includes the beams of the first and second plurality of beams alternatingly engaging the second fin along a length of the second fin.

The pairs of alignment notches of the first and third fins are generally equal in depth such that the first ends of the beams of the first plurality of beams are generally level with the first ends of the beams of the second plurality of beams. The depths of the pairs of alignment notches of the second fin vary along the length of the second fin such that the second end of at least one beam of the first plurality of beams varies in elevation from the second end of at least one beam of the second plurality of beams.

This brief summary has been provided so that the nature of the invention may be understood quickly. Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE DRAWINGS

The various present embodiments now will be discussed in detail with an emphasis on highlighting the advantageous features with reference to the drawings of various embodiments. The illustrated embodiments are intended to illustrate, but not to limit the invention. The drawings are not to be construed as drawn to scale. Arrows indicating direction of movement are not to be construed as limiting amount of movement. These drawings include the following figures, in which like numerals indicate like parts.

DETAILED DESCRIPTION

Figure 1:
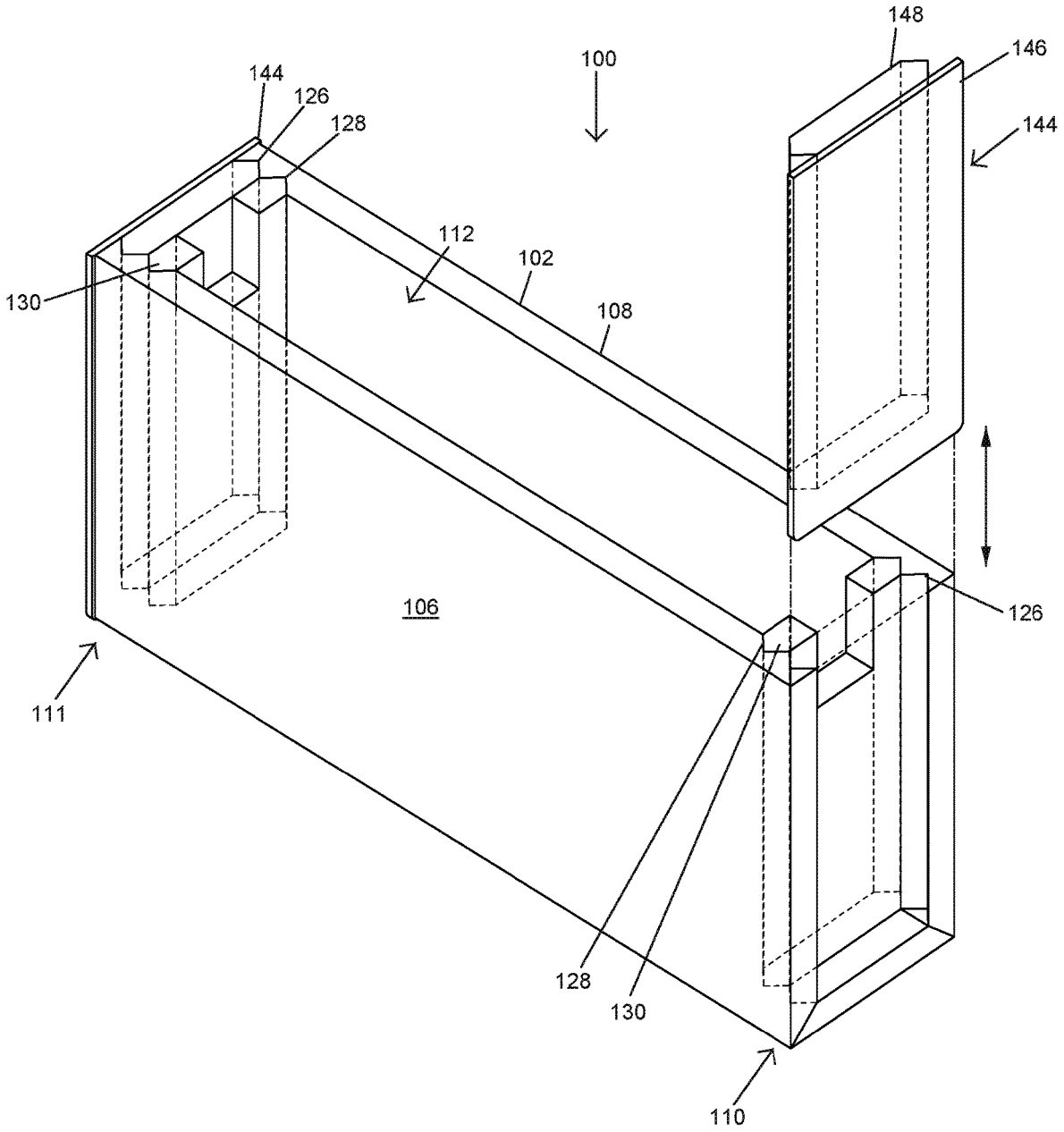
FIG. 1 illustrates a top, front, left perspective view of a beam of an architectural fixture embodying the invention, with one connector shown in engagement with a second end of the beam, and another connector shown disengaged from a first end of the beam, with a double-ended arrow indicating directions of movement for the connector to engage with/disengage from the beam.
Figure 2:
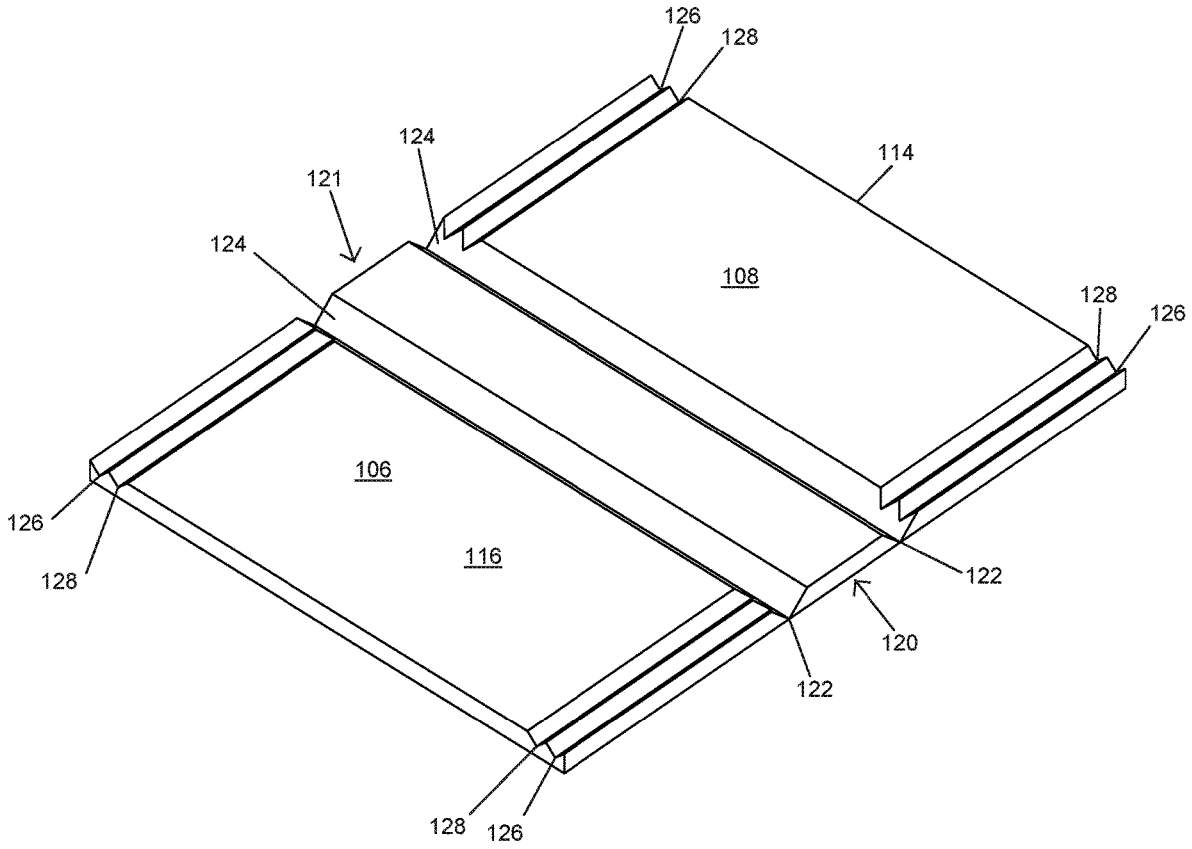
FIG. 2 illustrates a top, front, left perspective view of the beam of FIG. 1 in a generally flat, unfolded configuration.
Figure 3:
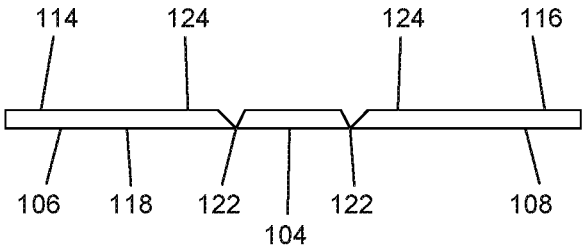
FIG. 3 illustrates a front elevation view of unfolded beam of FIG. 2.
Figure 4:
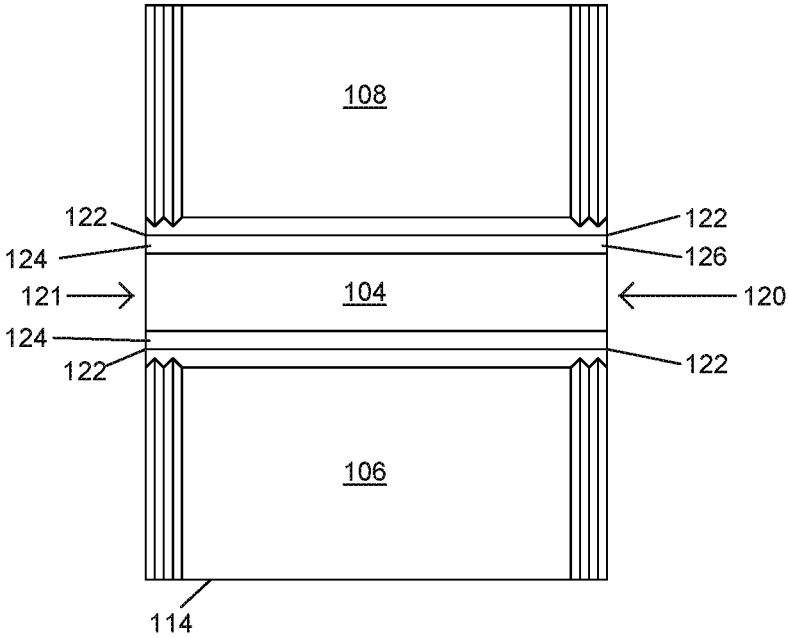
FIG. 4 illustrates a top plan view of unfolded beam of FIG. 2.
Figure 5:
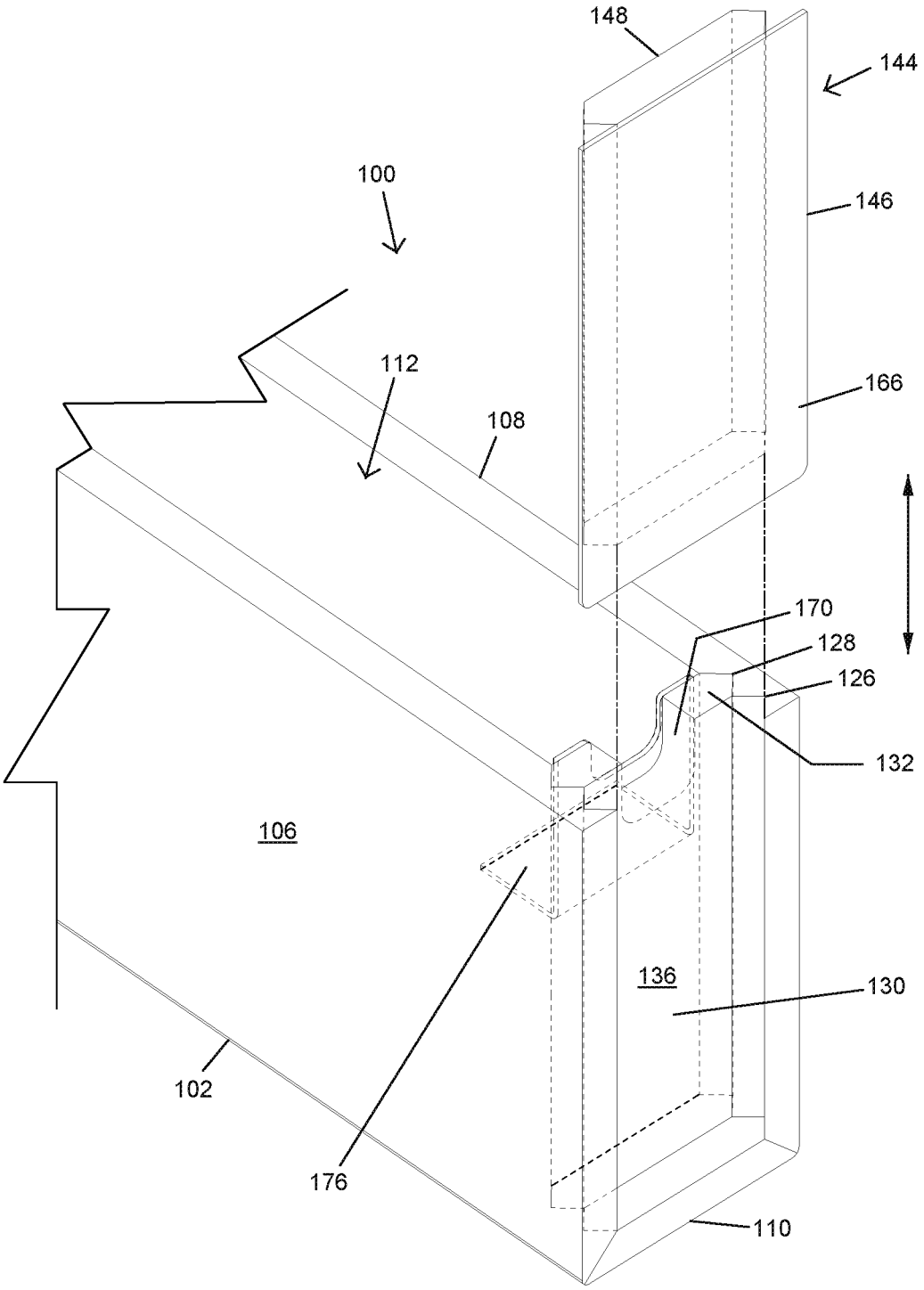
FIG. 5 illustrates another top, front, left perspective view of the architectural fixture of FIG. 1, focusing on the first end of the beam, with a double-ended arrow indicating directions of movement for the connector to engage with/disengage from the beam.
Figure 6:
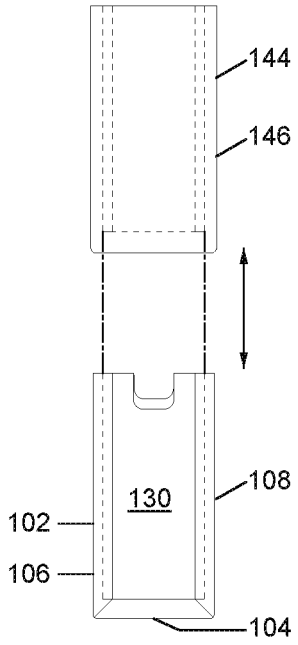
FIG. 6 illustrates a front elevation view of the architectural fixture of FIG. 5, taken along line 6-6 of FIG. 5, with a double-ended arrow indicating directions of movement for the connector to engage with/disengage from the beam.
Figure 7:
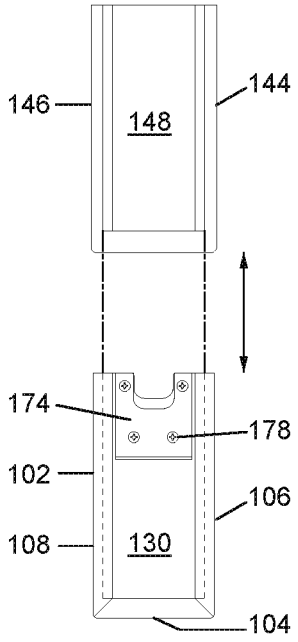
FIG. 7 illustrates a rear elevation cross-sectional view of the architectural fixture of FIG. 5, taken along line 7-7 of FIG. 5, with a double-ended arrow indicating directions of movement for the connector to engage with/disengage from the beam.
Figure 8:
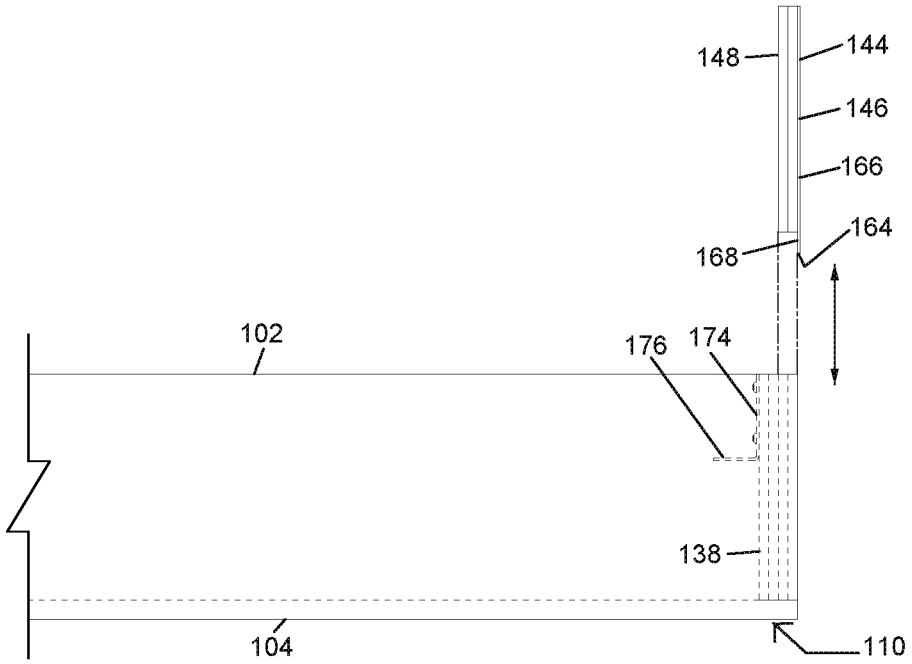
FIG. 8 illustrates a left side elevation view of the architectural fixture of FIG. 5, with a double-ended arrow indicating directions of movement for the connector to engage with/disengage from the beam.
Figure 9:
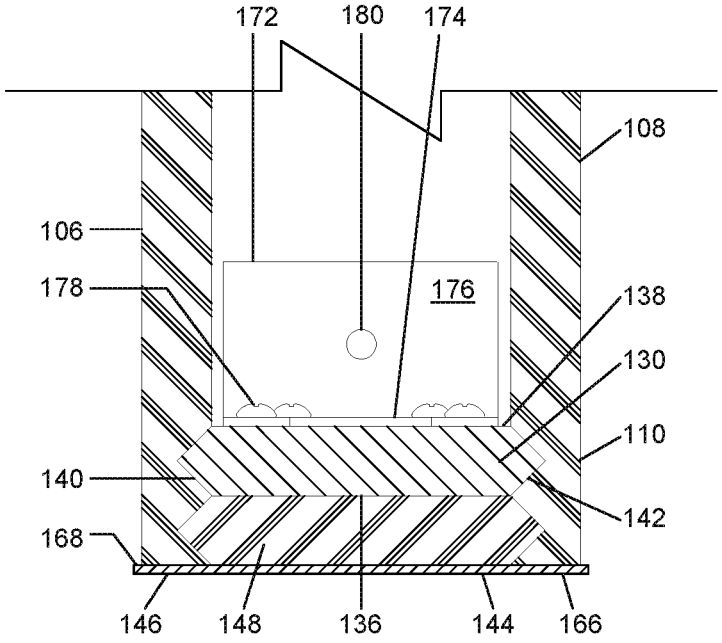
FIG. 9 illustrates a top plan cross-sectional view of the architectural fixture of FIG. 5, taken along line 9-9 of FIG. 5, with the connector in engagement with the beam.
Figure 10:
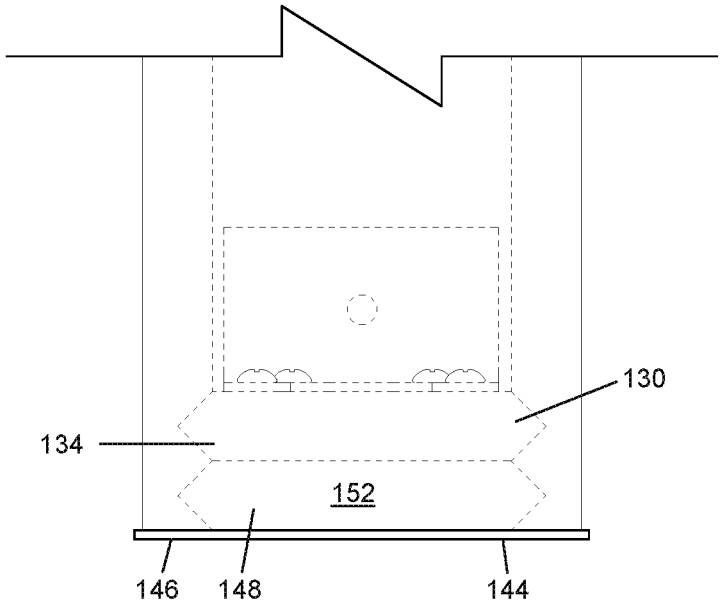
FIG. 10 illustrates a bottom plan view of the architectural fixture of FIG. 5, with the connector in engagement with the beam.
Figure 11:
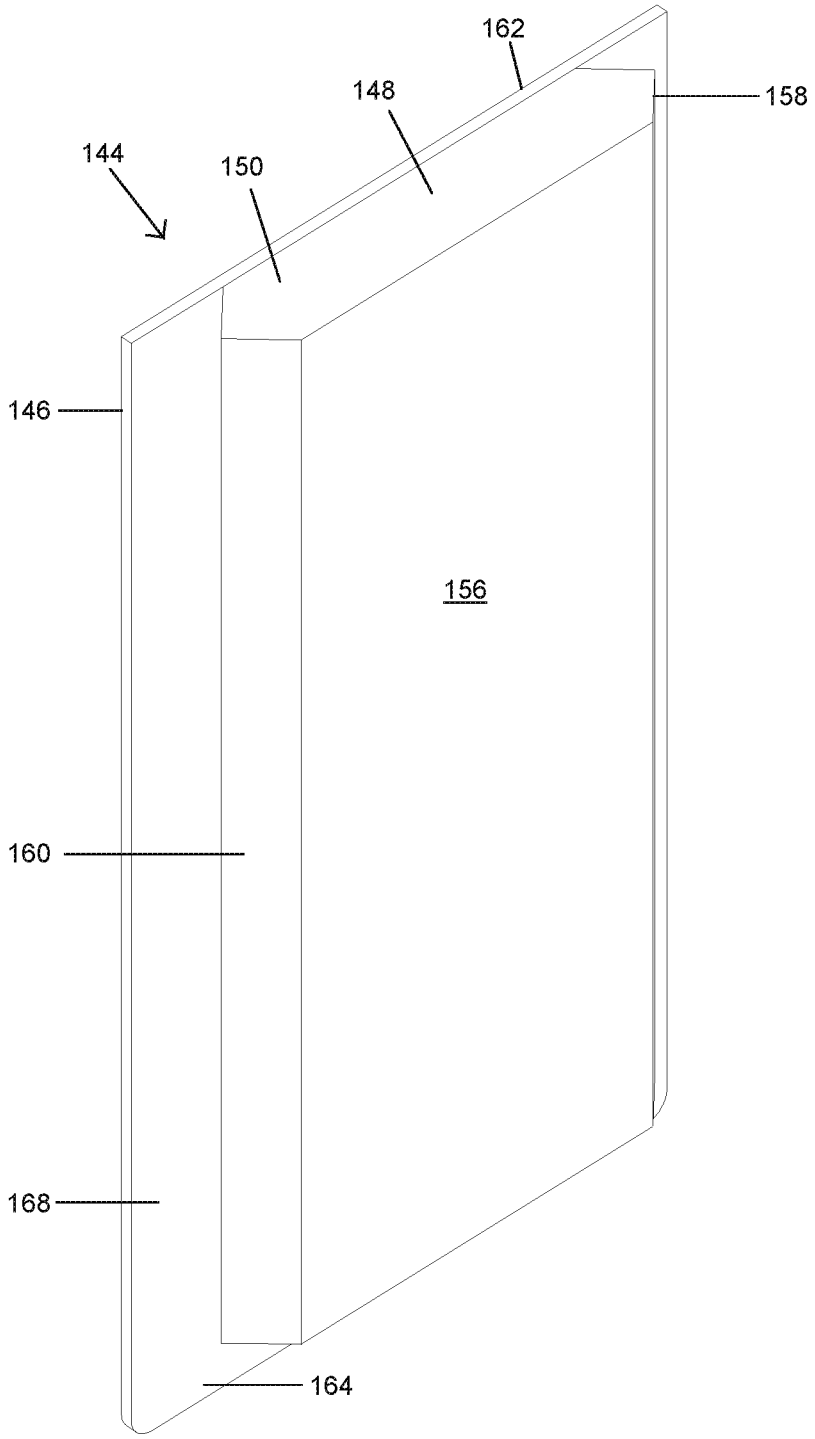
FIG. 11 illustrates a top, back, left perspective view of the disengaged connector of FIG. 1.

The following detailed description describes present embodiments with reference to the drawings. In the drawings, reference numbers label elements of present embodiments. These reference numbers are reproduced below in connection with the discussion of the corresponding drawing features.

As shown in FIGS. 1-14 for purposes of illustration, an embodiment of the present invention resides in an architectural fixture assembly 100. The architectural fixture assembly 100 includes a generally U-shaped beam 102 having a bottom portion or side 104, a first side 106, a second side 108, a first end 110, and a second end 111. Interior surfaces of the first, second, and bottom sides 106, 108, 104 of the beam 102 define an interior portion 112. A beam 102 can be any length desired by a user, with various dimensions and proportions of the beam 102 also being as desired by a user.

The beam 102 may be made from a generally flat, elongated sheet 114 with a top side 116, a bottom side 118, a first end 120, and a second end 121. The sheet 114 has a thickness and a longitudinal axis running along a center of the sheet 114 between the first end 120 and the second end 121. A pair of fold lines 122 extend between the first end 120 and the second end 121. The fold lines 122 are disposed on the top side 116 of the sheet 114, on opposite sides of, and parallel with, the longitudinal axis. Each fold line 122 includes a generally V-shaped cut 124 on the top side 116 of the sheet 114 so that the sheet 114 may cleanly fold without substantially compressing or deforming the material of the sheet 114 that is otherwise present along the fold lines 122.

The fold lines 122 define the bottom portion or side 104, first side 106, and second side 108 of the beam 102. The generally V-shaped cuts 124 may be configured to permit the exposed edges to abut in a flush manner when the first and second sides 106, 108 are folded at a desired angle. The general U-shape of the beam 102 is formed by the first side 106 being folded upwards about the fold line 122 until the sides of the generally V-shaped cut 124 engage, and the second side 108 being folded upwards about the fold line 122 until the sides of the generally V-shaped cut 124 engage. The first end 106 of the beam 102 and the first end 120 of the sheet 114 are the same end. The sheet 114 is folded from a flat configuration to the generally U-shaped configuration of the beam 102.

The sheet 114 includes first and second alignment notches 126, 128 disposed side-by-side, generally adjacent to the first end 120 of the sheet 114 (the first alignment notch 126 being closer to the first end 120 of the sheet 114 than the second alignment notch 128), on the top side 116 of the sheet, on the portions of the sheet 114 defining the first and second sides 106, 108. Each alignment notch 126, 128 is in the shape of a generally V-shaped cut. Alternatively, the alignment notches 126, 128 may have various other shapes including, without limitation, a dovetail, and other types of joints found in woodworking including, without limitation, a tongue and groove joint, a dado joint, a finger joint, a mitre joint, a puzzle piece joint, and a half blind lap joint. When the sheet 114 is folded into the generally U-shaped beam 102, the interior surfaces of the first and second sides 106, 108 each include a generally V-shaped first alignment notch 126 disposed generally adjacent to the first end 110 of the beam 102, with a generally V-shaped second alignment notch 128 disposed generally adjacent to the first alignment notch 126. Another pair of alignment notches 126, 128, each alignment notch also in the form of a generally V-shaped cut, are disposed side-by-side, adjacent to the second end 121 of the sheet 114, on the top side 116 of the sheet, on the portions of the sheet 114 defining the first and second sides 106, 108. In this manner, the second end 121 of the sheet 114 may have the same/similar features as the first end 120 (e.g., first and second alignment notches 126, 128, etc.).

The assembly 100 further includes a generally rectangular spacer 130. The spacer 130 may be made from the same material as the sheet 114/beam 102. The spacer 130 has a top side 132, a bottom side 134, a front side 136, a back side 138, a first side 140, and a second side 142 on an opposite side of the spacer 130 from the first side 140. The first and second sides 140, 142 are each generally V-shaped. Alternatively, the first and second sides 140, 142 of the spacer 130 may have various other shapes including, without limitation, a dovetail, and other types of joints found in woodworking including, without limitation, a tongue and groove joint, a dado joint, a finger joint, a mitre joint, a puzzle piece joint, and a half blind lap joint. The first and second sides 140, 142 of the spacer 130 are sized, shaped, and configured to engage the generally V-shaped alignment notches 128 of the first and second sides 106, 108 of the beam 102. The first and second sides 140, 142 of the spacer 130 may be slid into engagement with the generally V-shaped alignment notches 128 of the first and second sides 106, 108. An adhesive (placed on the first and second sides 140, 142 and/or the generally V-shaped alignment notches 128) may be used to hold the spacer 130 in engagement with the beam 102. Alternatively, a plate installed above the spacer 130 may be used to hold the spacer 130 in engagement with the beam 102. The spacer 130 may be used to hold the beam 102 in the general U-shape. Alternatively, or in combination with the spacer 130, the abutting edges/sides of the generally V-shaped cut 124 may, for example, be locked into place using various means including, without limitation, brackets, fasteners and/or adhesives (e.g., an epoxy or the like); either alone or in various combinations with one or more of the others. A generally U-shaped recess 170 may be formed in the spacer 130 from the top side 132 towards the bottom side 134. The generally U-shaped recess 170 provides enough space for the user to maneuver their fingers in to install or remove the connector 144. The recess 170 also allows various things (e.g., wiring, piping, ducts/ducting, etc.) to be routed towards the first end 110 of the beam 102. A flange 172 (e.g., a generally L-shaped flange) having a generally vertical portion 174 and a generally horizontal portion 176. The generally vertical portion 174 may be attached to the back side 138 of the spacer 130 by various fasteners including, without limitation, mechanical fasteners 178, chemical fasteners (e.g., adhesives), or the like. An upper portion of the generally vertical portion may also include a generally U-shaped recess generally aligned with the generally U-shaped recess 170 of the spacer 130 in order to allow various things (e.g., wiring, piping, ducts/ducting, etc.) to be routed towards the first end 110 of the beam 102. One or more apertures 180 or other structure in the generally horizontal portion 176 may be used to secure a cable (e.g., aircraft cable or wire ropes, etc.) to the assembly 100 in order to hang the assembly 100 (e.g., from a ceiling or other higher location).

The beam 102/sheet 114 may be made using a sheet of one or more sound-absorbing/barrier (acoustical) materials including, but not limited to, fabric-covered synthetic polymer foam, fabric-covered glass wool composite material, or the like. Alternatively, the beam 102/sheet 114 may be made from other sound-absorbing materials including, but not limited to, synthetic foam or nonwoven polymer (without fabric), or synthetic foam or nonwoven polymer covered by a perforated metallic sheet, wood, wool or the like. In the alternative, the beam 102/sheet 114 may also be formed from a metallic sheet, a polymeric sheet, or the like. Metallic sheets, for example, may be pressed or bent into the required folded generally U-shape by various methods known in the art. Polymeric sheet stock, for example, may be pressed/bent under heating to obtain the required shape. Polymeric sheets having the required folded general U-shape, for example, may also be molded such as by injection molding directly into the required general U-shape.

A connector 144 includes a plate 146, and a connection key 148 extending away from the plate 146. The plate 146 is generally in the form of a thin, rectangular sheet of material. The plate 146 may be made from the same material as the beam 102. Alternatively, the plate 146 may be made from various other materials including, without limitation, powder-coated steel or aluminum, synthetic nonwoven or foam polymer, wood veneer applied to steel or aluminum, stainless steel, and translucent plastic. The connection key 148 is generally in the form of a rectangular sheet of material. The connection key 148 may be made from various materials including, without limitation, the same material as the beam 102 and/or the spacer 130. The connection key 148 has a top side 150, a bottom side 152, a front side 154, a back side 156, a first side 158, and a second side 160 on an opposite side of the connection key 148 from the first side 158. The plate 146 has a top side 162, a bottom side 164, a front side 166, and a back side 168. The connection key 148 has a smaller width and a smaller height than the plate 146. The front side 154 of the connection key 148 is fixedly attached to the back side 168 of the plate 146. The connection key 148 may be fixedly attached to the back side 168 of the plate 146 by adhesive or metal fasteners. The connection key 148 is engaged to the plate 146 with the top side 162 of the plate 146 generally aligned with the top side 150 of the connection key 148, and with a mid-point of the width of the plate 146 generally aligned with a mid-point of the width of the connection key 148.

Figure 12:
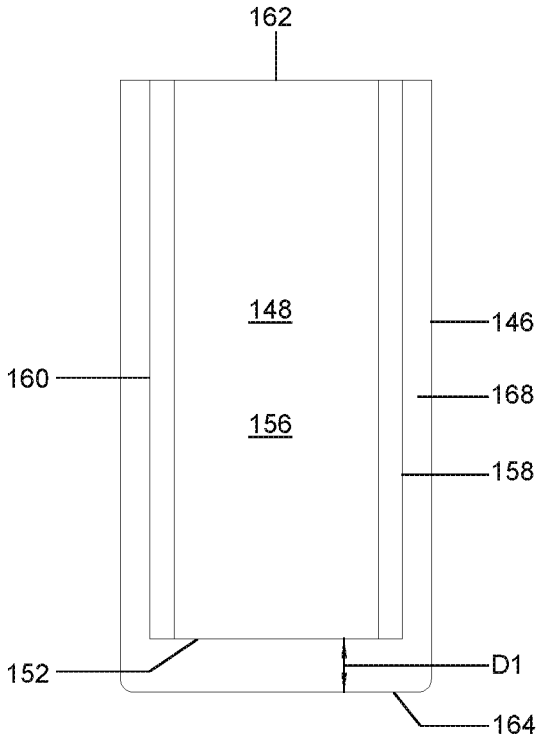
FIG. 12 illustrates a rear side elevation view of the connector of FIG. 11.
Figure 13:
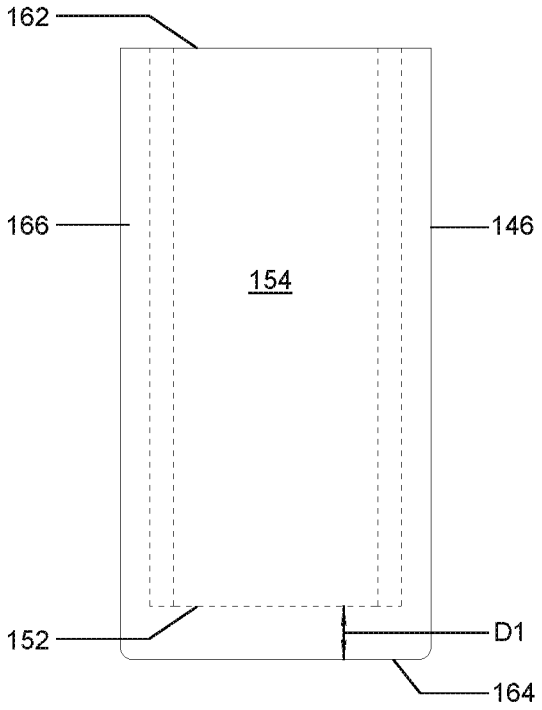
FIG. 13 illustrates a front side elevation view of the connector of FIG. 11.
Figure 14:
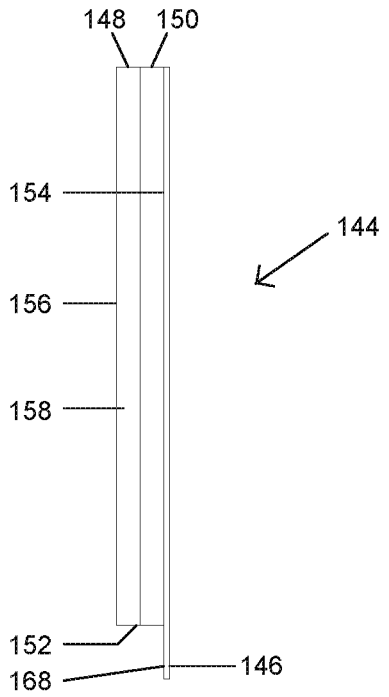
FIG. 14 illustrates a right side elevation view of the connector of FIG. 11.

The connector 144 slidably engages the beam 102. The first and second sides 158, 160 of the connection key 148 are each generally V-shaped. Alternatively, the first and second sides 158, 160 of the connection key 148 may have various other shapes including, without limitation, a dovetail, and other types of joints found in woodworking including, without limitation, a tongue and groove joint, a dado joint, a finger joint, a mitre joint, a puzzle piece joint, and a half blind lap joint. The first and second sides 158, 160 of the connection key 148 are sized, shaped, and configured to engage the generally V-shaped alignment notches 126 of the first and second sides 106, 108 of the beam 102. The first and second sides 158, 160 of the connection key 148 may be slid into engagement with the generally V-shaped alignment notches 126 of the first and second sides 106, 108. The first and second sides 158, 160 of the connection key 148 may be held in engagement with the generally V-shaped alignment notches 126 of the first and second sides 106, 108 by friction fit or, alternatively, an adhesive (placed on the first and second sides 158, 160 and/or the generally V-shaped alignment notches 126) may be used to hold the connection key 146 in engagement with the beam 102, and to hold the beam 102 in the general U-shape. Alternatively, a plate installed above the connector 144 may be used to hold the connector 144 in engagement with the beam 102. As seen in FIG. 12, the distance D1 between the bottom side 152 of the connection key 148 and the bottom side 164 of the plate 146 is roughly approximate to a thickness of the bottom side 104 of the beam 102 such that when the connector 144 fully engages the beam 102, the bottom side 104 of the beam 102 is generally aligned with the bottom side 164 of the plate 146.

When the connector 144 fully engages the beam 102, the front side 166 of the plate 146 can serve as a "end cap" of the beam 102. The front side 166 of the plate 146 can be colored to suit the needs of the user. For example, the front side 166 may be colored to match the paint color of at least one wall and/or ceiling of a room in which the beam 102 is located. In another example, if a wall and/or ceiling color is changed, the front side 166 of the plate 146 may also be changed by painting or otherwise changing the color of the front side 166. In the alternative, the connector 144 with the plate 146 having the old wall and/or ceiling color may be replaced by a new connector with a plate 146 having a front side 166 with the new wall and/or ceiling color.

Figure 15:
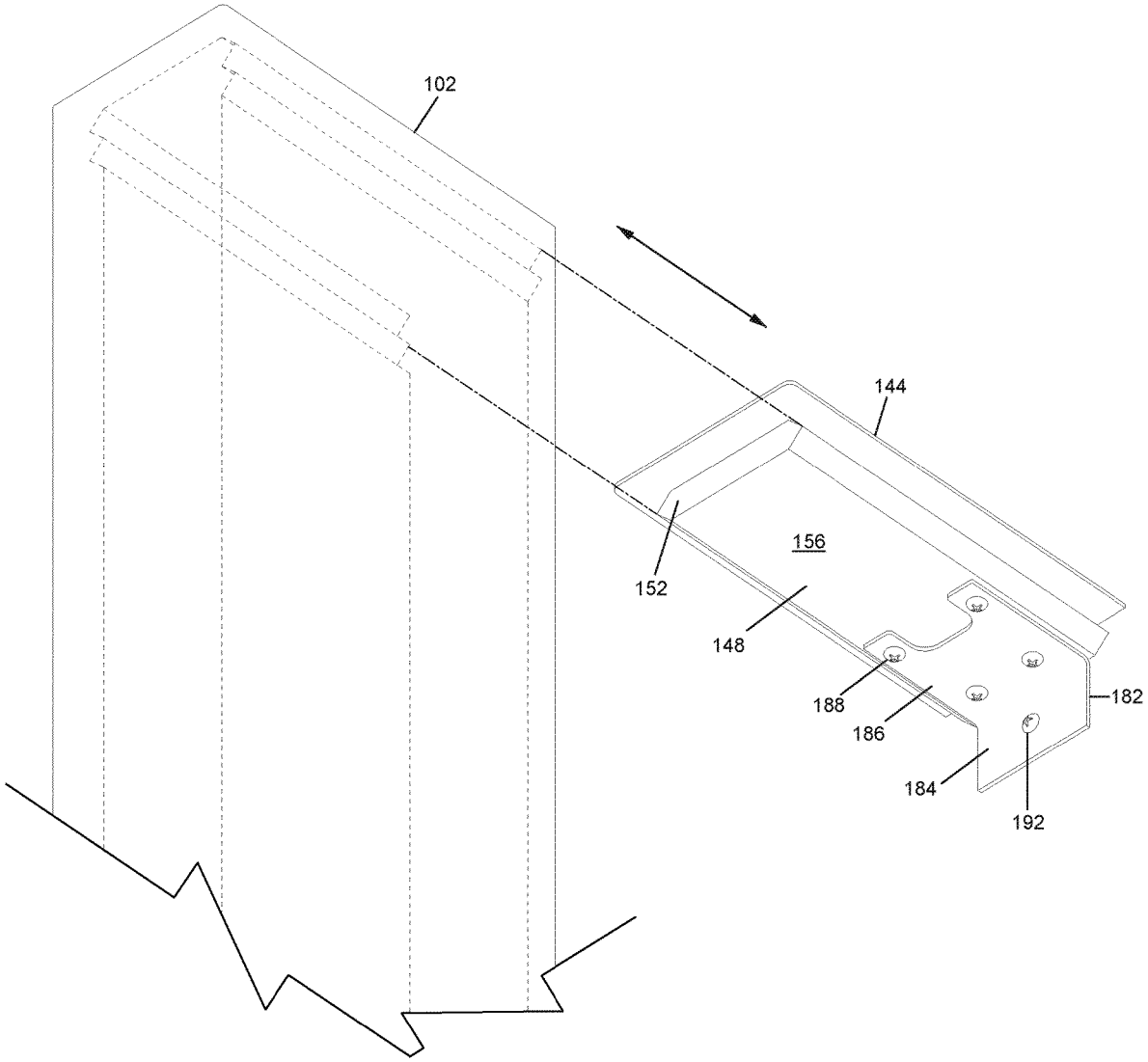
FIG. 15 illustrates a top, front, left perspective view of a beam of another architectural fixture embodying the invention, with a double-ended arrow indicating directions of movement for a connector to engage with/disengage from the beam.
Figure 16:
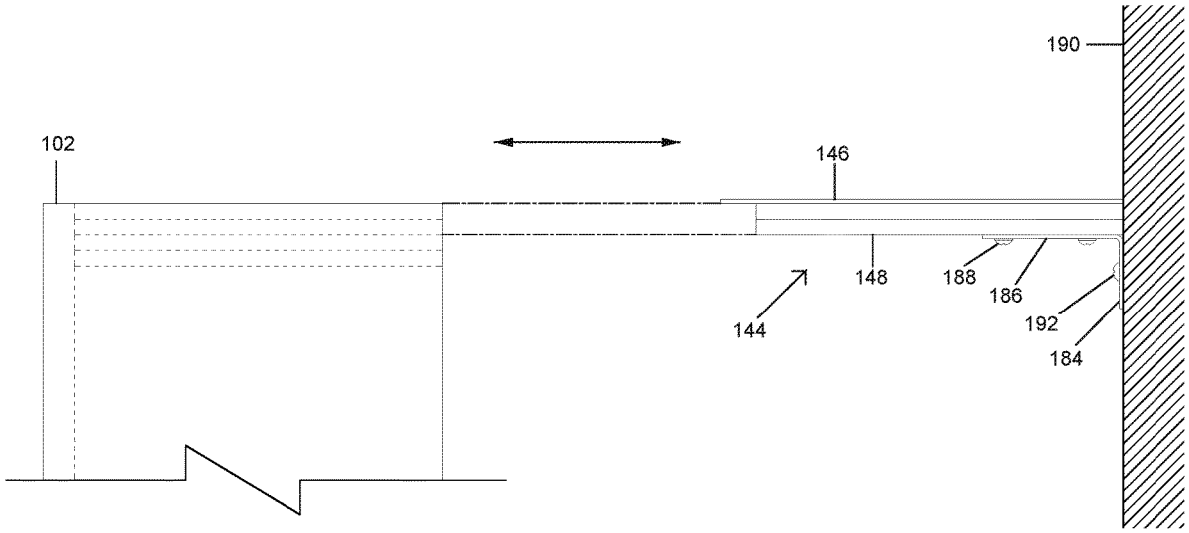
FIG. 16 illustrates a left side elevation view of the beam of FIG. 15, with a double-ended arrow indicating directions of movement for the connector to engage with/disengage from the beam.

In accordance with another embodiment of the invention, as seen in FIGS. 15-16, the connector 144 may further include a flange 182 configured to be secured to a generally flat surface (e.g., a wall, a ceiling, or the like). The flange 182 (e.g., a generally L-shaped flange) includes a generally vertical portion 184 and a generally horizontal portion 186. The generally horizontal portion 186 may be attached to the back side 156 of the connection key 148 by various fasteners including, without limitation, mechanical fasteners 188, chemical fasteners (e.g., adhesives), or the like extending through one or more apertures (not shown) in the generally horizontal portion 186. One or more apertures 190 or other structure in the generally vertical portion 184 may be used to secure the assembly 100 to a generally flat surface (e.g., a wall, a ceiling, or the like) 190 using a fastener 192 (e.g., mechanical fastener, etc.). Alternatively, a chemical fastener may be used to secure the generally vertical portion 184 to the generally flat surface.

Figure 17:
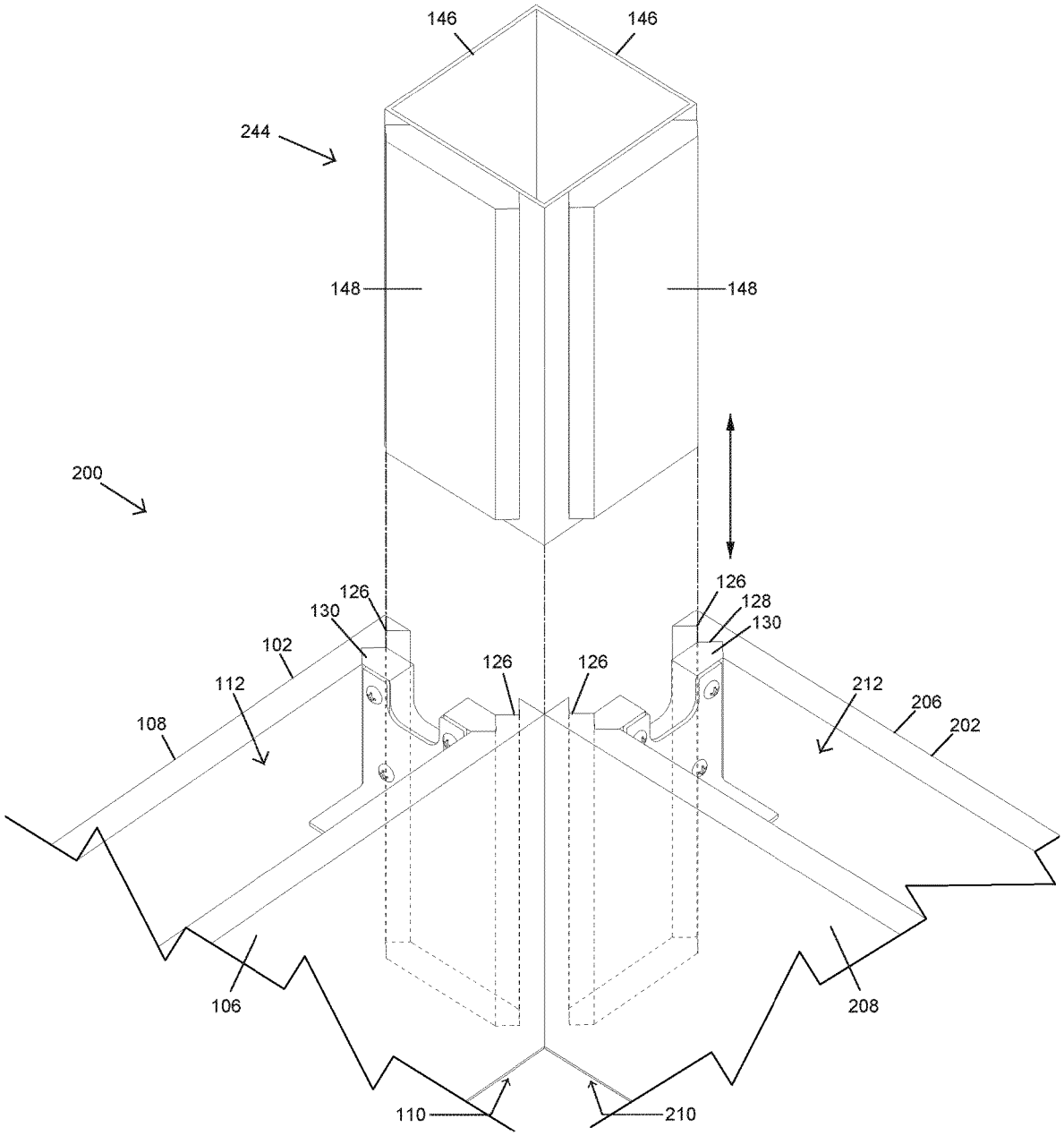
FIG. 17 illustrates a top, front, left perspective view of an additional architectural fixture embodying the invention, with two beams and a connector for interconnecting the two beams, with a double-ended arrow indicating directions of movement for the connector to engage with/disengage from the beams.
Figure 18:
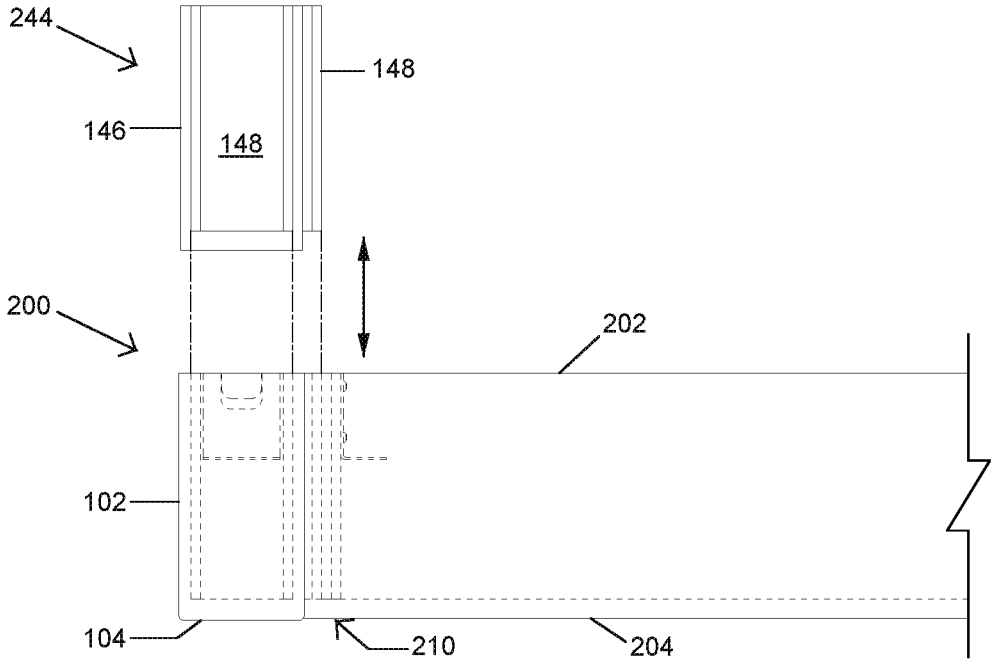
FIG. 18 illustrates a front side elevation view of the architectural fixture of FIG. 17, with a double-ended arrow indicating directions of movement for the connector to engage with/disengage from the beams.
Figure 19:
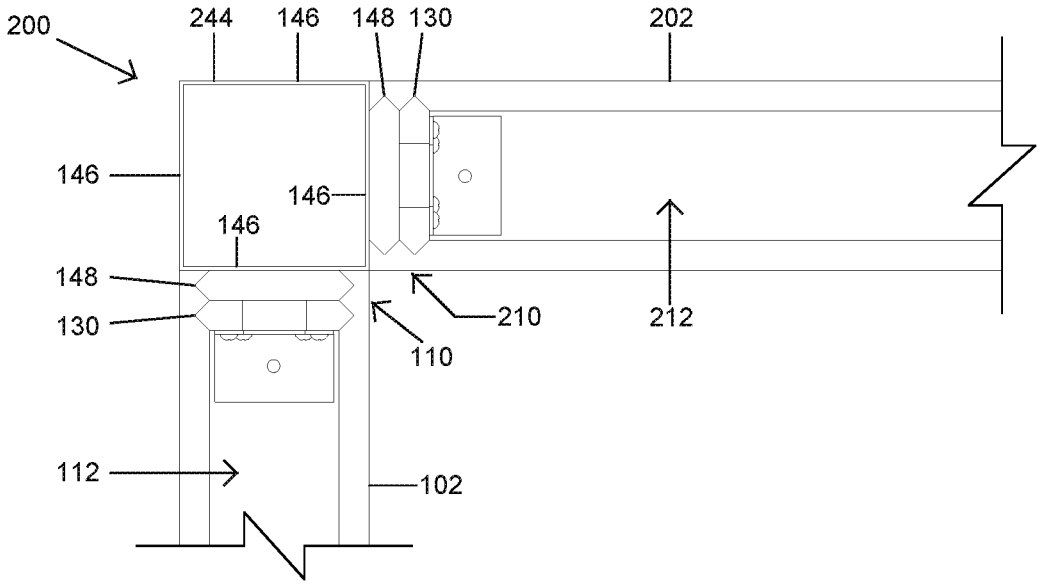
FIG. 19 illustrates a top plan view of the architectural fixture of FIG. 17, with the beams in engagement.

In accordance with a further embodiment of the invention, an architectural fixture assembly 200 is illustrated in FIGS. 17-19. The assembly 200 has many similar, if not identical, features as described above in reference to the assembly 100, except that the assembly 200 describes an embodiment where two beams 102, 202 are connected at a right angle to each other. In addition to the first beam 102, the assembly 200 includes a generally U-shaped second beam 202 including a bottom side 204, a first side 206, a second side 208, and a first end 210, wherein interior surfaces of the first, second, and bottom sides 206, 208, 204 of the second beam 202 define an interior portion 212. The second beam 202 is generally identical to the first beam 102 in design and construction. Except for purposes of clarity, reference numbers used to describe features in the assembly 100 will be used to describe identical/similar features in the assembly 200.

The interior surfaces of the first and second sides 206, 208 of the second beam 202 each include a generally V-shaped alignment notch 126 disposed generally adjacent to the first end 210 of the second beam 202. The second beam 202 also includes a spacer 130 engaging a generally V-shaped alignment notch 128 generally adjacent to the generally V-shaped alignment notch 126.

A connector 244 includes four (4) plates 146, and two (2) connection keys 148. The four (4) plates 146 are configured in the form of a quadrangle (e.g., a square, a rectangle, a rhombus, etc.; a square configuration is shown for purposes of illustration in the figures but the connector 244 is not limited to a square configuration) when viewed from above, with each plate 146 forming a side of the quadrangle. Each plate 146 and connection key 148 is as described above. Only two (2) of the four (4) plates 146 of the connector 244 have a connection key 148 attached thereto in the manner described above in connection with the assembly 100. The connector 244 is configured to engage the first and second beams 102, 202 to form a generally L-shaped beam configuration. The connector 244 slidably engages the first and second beams 102, 202 when each generally V-shaped side of the connection keys 148 slidably engages a particular one of the generally V-shaped alignment notches 126 of the beams 102, 202. The other two (2) plates 146 of the connector 244 (i.e., the plates 146 that do not have a connection key 148 attached thereto) may act as "end caps." That is, when the connector 244 fully engages the beams 102, 202, the front sides 166 of the two (2) plates 146 that do not have a connection key 148 attached thereto can serve as "end caps" of the beams 102, 202, such as described above. Likewise, the front side 166 of the plates 146 that do not have a connection key 148 attached thereto may also be adapted to act as an attachment point for a variety of devices or objects, such as described above. Alternatively, the connector 244 can be made with only two (2) plates 146 connected side-by-side at an angle (e.g., a right angle (i.e., 90 degrees)), with each of the two (2) plates 146 having a connection key 148, and the front sides 166 of the two (2) plates 146 serving as "end caps" of the beams 102, 202, such as described above, and/or one or both of the front sides 166 of the plates 146 being adapted to act as an attachment point for a variety of devices or objects, such as described above. In a further alternative, the connector 244 can be made with only three (3) plates 146 connected side-by-side in the form of a triangle when viewed from above, with at least two (2) of the plates 146 each having a connection key 148, and meeting at a right angle (i.e., 90 degrees), and the front side of the third plate (the width of the third plate possibly being greater than the width of the other two (2) plates 146) completing the triangle as well as acting as an "end cap," such as described above, and/or the front side of the third plate being adapted to act as an attachment point for a variety of devices or objects, such as described above. In an additional alternative, a plate may be attached to a bottom side of the connector 244 for aesthetic purposes and/or to provide additional structural support to the connector 244.

Figure 20:
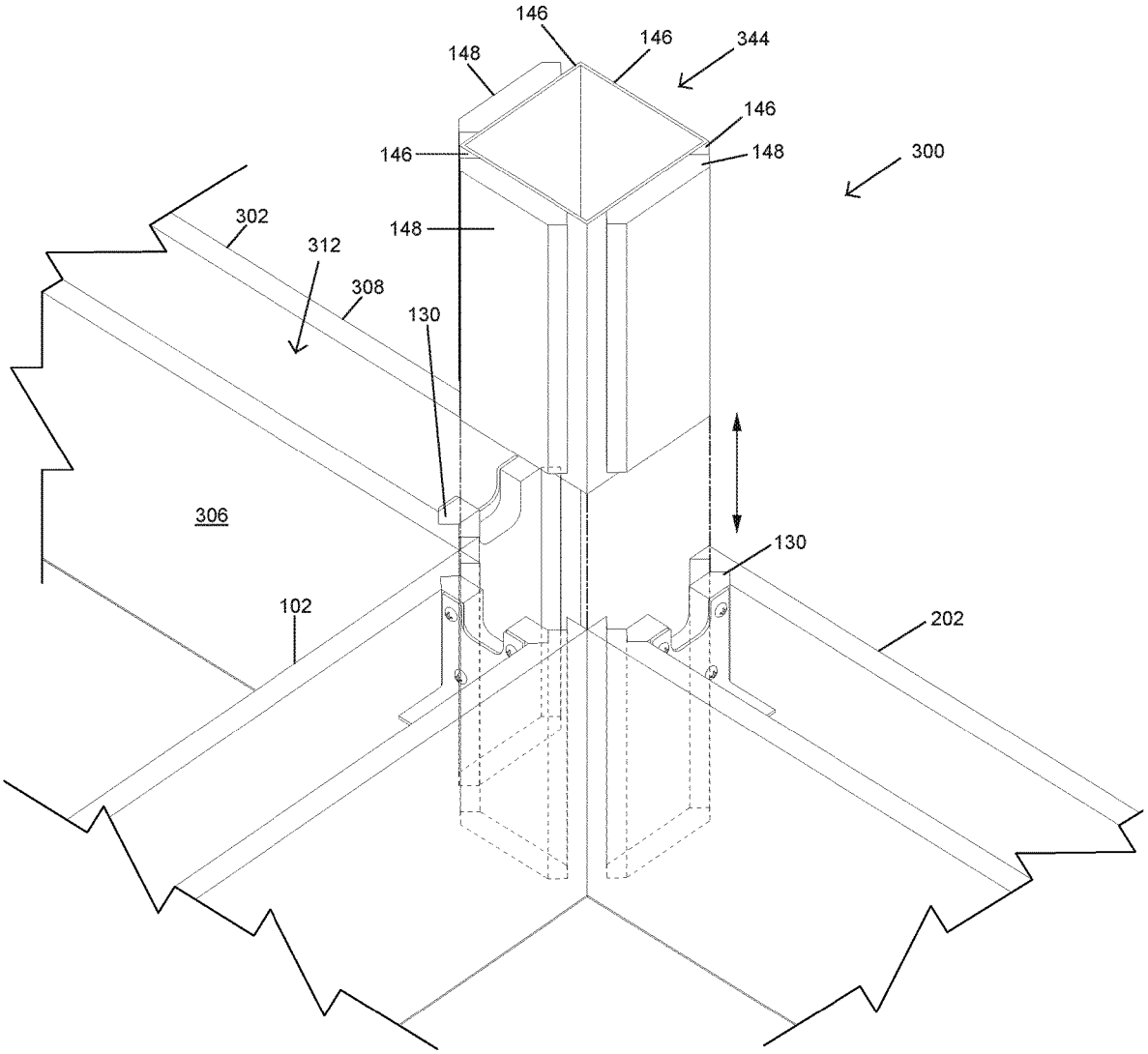
FIG. 20 illustrates a top, front, left perspective view of still another architectural fixture embodying the invention, with three beams and a connector for interconnecting the three beams, with a double-ended arrow indicating directions of movement for the connector to engage with/disengage from the beams.
Figure 21:
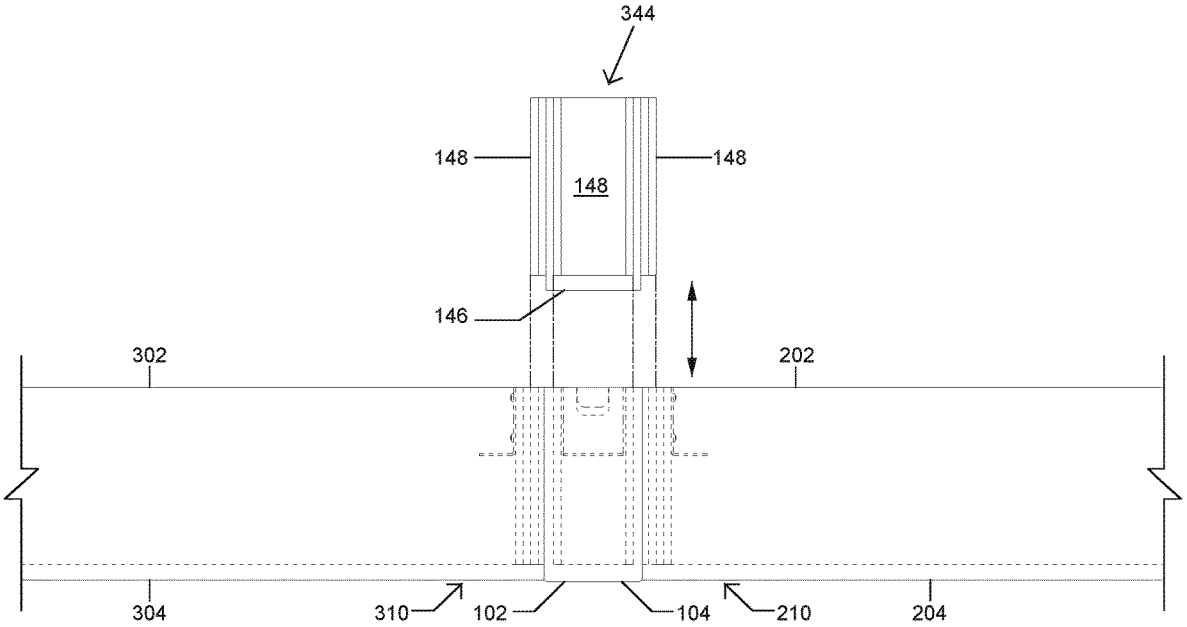
FIG. 21 illustrates a front side elevation view of the architectural fixture of FIG. 20, with a double-ended arrow indicating directions of movement for the connector to engage with/disengage from the beams.
Figure 22:
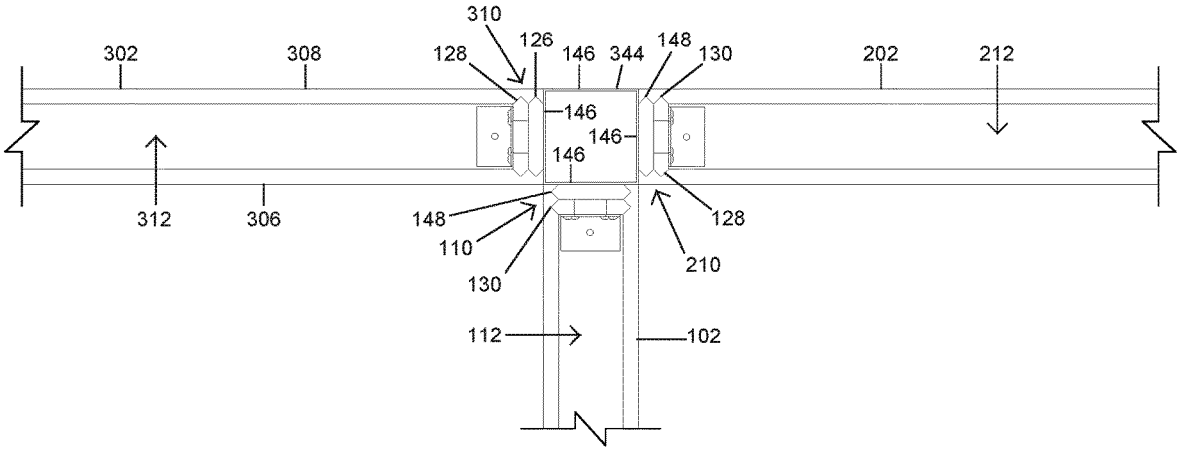
FIG. 22 illustrates a top plan view of the architectural fixture of FIG. 20, with the beams in engagement.

In accordance with an additional embodiment of the invention, an architectural fixture assembly 300 is illustrated in FIGS. 20-22. The assembly 300 has many similar, if not identical, features as described above in reference to the assemblies 100, 200, except that the assembly 300 describes an embodiment where three (3) beams 102, 202, 302 are connected, and each beam 102, 202, 302 is connected at a right angle (i.e., 90 degrees) to one of the other two (2) beams. In addition to the first and second beams 102, 202, the assembly 300 includes a generally U-shaped third beam 302 including a bottom side 304, a first side 306, a second side 308, and a first end 310, wherein interior surfaces of the first, second, and bottom sides 306, 308, 304 of the third beam 302 define an interior portion 312. The third beam 302 is identical to the first and second beams 102, 202 in design and construction. Except for purposes of clarity, reference numbers used to describe features in the assemblies 100, 200 will be used to describe identical/similar features in the assembly 300.

The interior surfaces of the first and second sides 306, 308 of the third beam 302 each include a generally V-shaped alignment notch 126 disposed generally adjacent to the first end 310 of the third beam 302. The third beam 302 also includes a spacer 130 engaging a generally V-shaped alignment notch 128 generally adjacent to the generally V-shaped alignment notch 126.

A connector 344 includes four (4) plates 146, and three (3) connection keys 148. The four (4) plates 146 are configured in the form of a quadrangle (e.g., a rectangle, a square, a rhombus, etc.; a square configuration is shown for purposes of illustration in the figures but the connector 344 is not limited to a square configuration) when viewed from above, with each plate 146 forming a side of the quadrangle. Each plate 146 and connection key 148 is as described above. Only three (3) of the four (4) plates 146 of the connector 344 have a connection key 148 attached thereto in the manner described above in connection with the assemblies 100, 200. The connector 344 is configured to engage the first, second and third beams 102, 202, 302 to form a generally T-shaped beam configuration. The connector 344 slidably engages the first, second, and third beams 102, 202, 302 when each generally V-shaped side of the connection keys 148 slidably engages a particular one of the generally V-shaped alignment notches 126 of the beams 102, 202, 302.

The remaining plate 146 of the connector 344 (i.e., the plate 146 that does not have a connection key 148 attached thereto) acts as an "end cap." That is, when the connector 344 fully engages the beams 102, 202, 302, the front side 166 of the plate 146 that does not have a connection key 148 attached thereto can serve as an "end cap" of the beams 102, 202, 302, such as described above. Likewise, the front side 166 of the plate 146 that does not have a connection key 148 attached thereto may also be adapted to act as an attachment point for a variety of devices or objects, such as described above. Alternatively, the connector 344 can be made with only three (3) plates 146 connected side-by-side, with each plate 146 connected at an angle (e.g., a right angle (i.e., 90 degrees)) to at least one of the other plates 146 to configure the plates 146 generally in the form of a U-shape when viewed from above, with each of the three (3) plates 146 having a connection key 148, and the front sides 166 of the three (3) plates 146 serving as "end caps" of the beams 102, 202, 302, such as described above, and/or at least one of the front sides 166 of the plates 146 being adapted to act as an attachment point for a variety of devices or objects, such as described above. In an additional alternative, a plate may be attached to a bottom side of the connector 344 for aesthetic purposes and/or to provide additional structural support to the connector 344.

Figure 23:
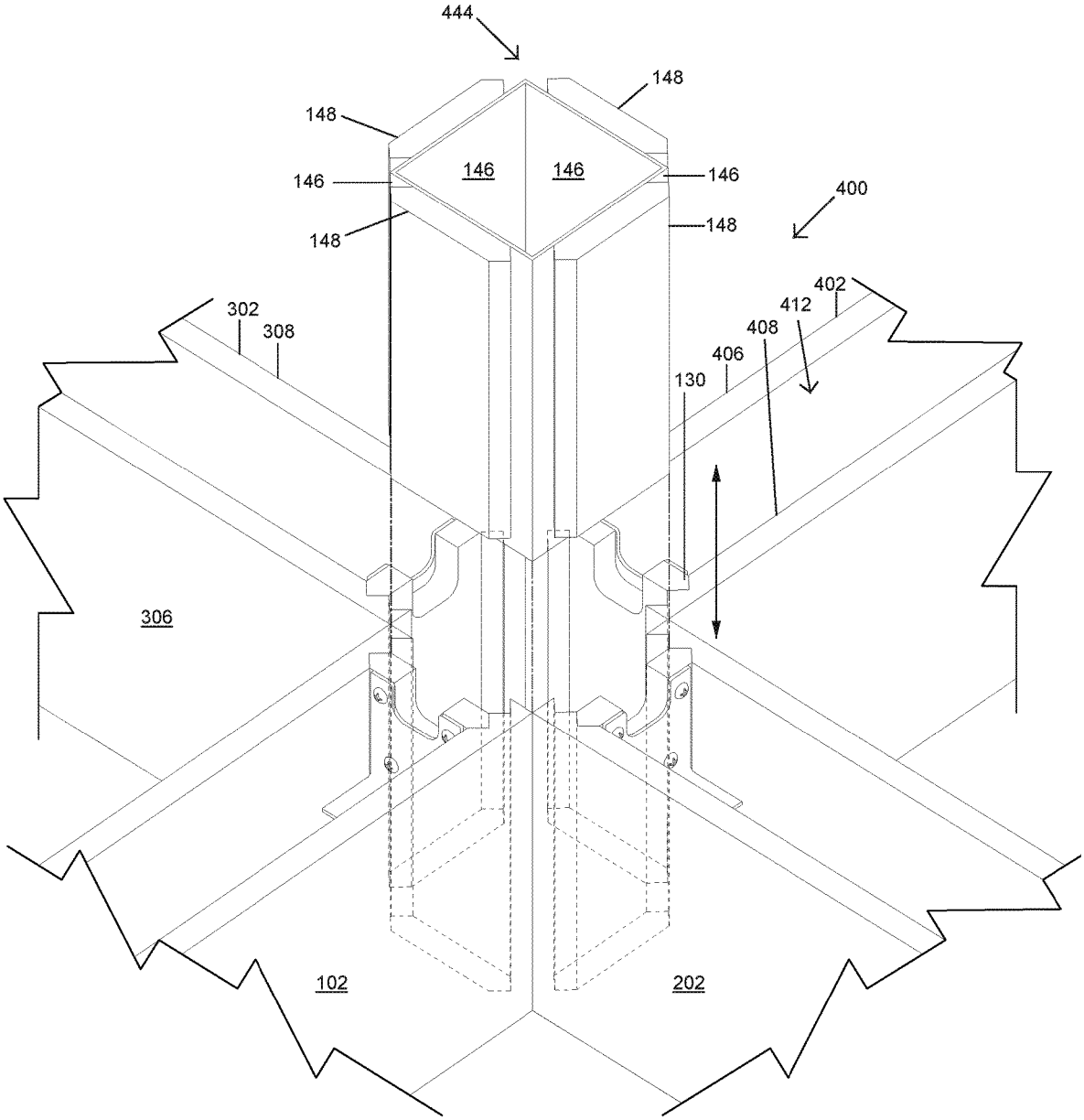
FIG. 23 illustrates a top, front, left perspective view of an additional architectural fixture embodying the invention, with four beams and a connector for interconnecting the four beams, with a double-ended arrow indicating directions of movement for the connector to engage with/disengage from the beams.
Figure 24:
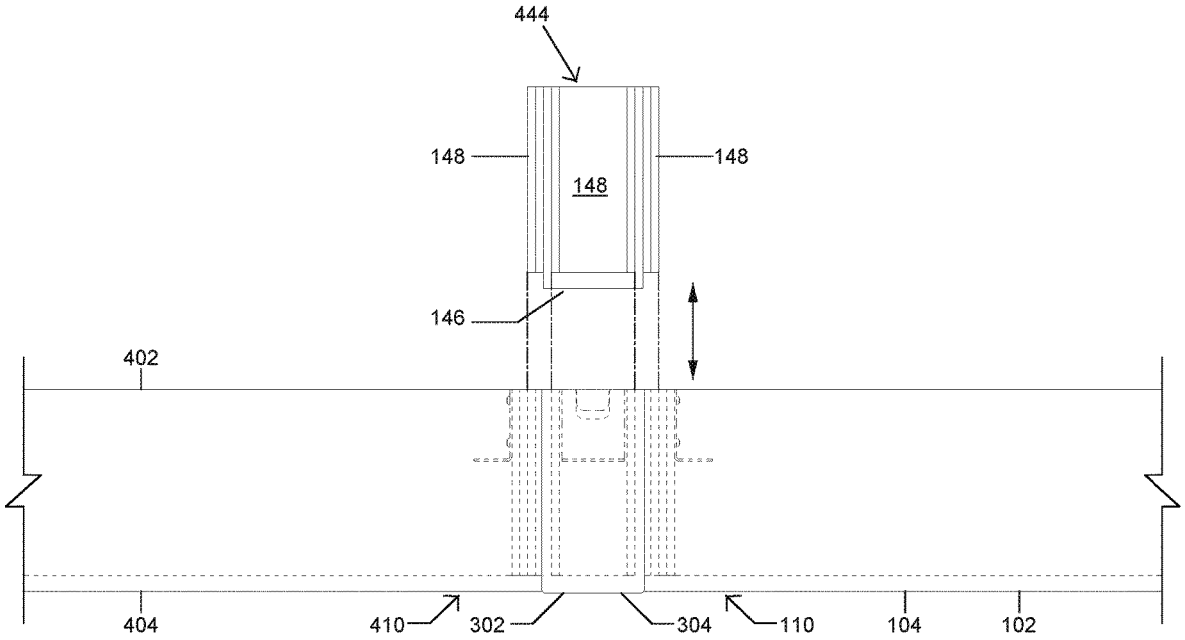
FIG. 24 illustrates a front side elevation view of the architectural fixture of FIG. 23, with a double-ended arrow indicating directions of movement for the connector to engage with/disengage from the beams.
Figure 25:
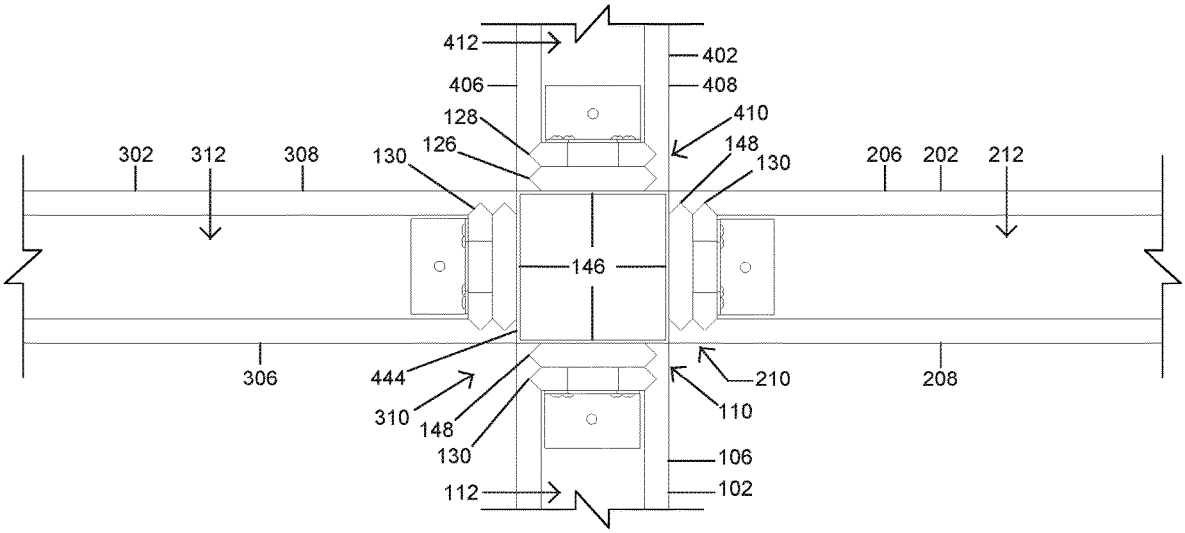
FIG. 25 illustrates a top plan view of the architectural fixture of FIG. 24, with the beams in engagement.

In accordance with an additional embodiment of the invention, an architectural fixture assembly 400 is illustrated in FIGS. 23-25. The assembly 400 has many similar, if not identical, features as described above in reference to the assemblies 100, 200, 300, except that the assembly 400 illustrates an embodiment where four (4) beams 102, 202, 302, 402 are connected, and each beam 102, 202, 302 402 is connected at a right angle (i.e., 90 degrees) to two of the other beams. In addition to the first, second, and third beams 102, 202, 302, the assembly 400 includes a generally U-shaped fourth beam 402 including a bottom side 404, a first side 406, a second side 408, and a first end 410, wherein interior surfaces of the first, second, and bottom sides 406, 408, 404 of the fourth beam 402 define an interior portion 412. The fourth beam 402 is identical to the first, second and third beams 102, 202, 302 in design and construction. Except for purposes of clarity, reference numbers used to describe features in the assemblies 100, 200, 300 will be used to describe identical/similar features in the assembly 400.

The interior surfaces of the first and second sides 406, 408 of the fourth beam 402 each include a generally V-shaped alignment notch 126 disposed generally adjacent to the first end 410 of the fourth beam 402. The fourth beam 402 also includes a spacer 130 engaging a generally V-shaped alignment notch 128 generally adjacent to the generally V-shaped alignment notch 126.

A connector 444 includes four (4) plates 146, and four (4) connection keys 148. The four (4) plates 146 are configured in the form of a quadrangle (e.g., a rectangle, a square, a rhombus, etc.; a square configuration is shown for purposes of illustration in the figures but the connector 444 is not limited to a square configuration) when viewed from above, with each plate 146 forming a side of the quadrangle. Each plate 146 and connection key 148 is as described above. Each of the four (4) plates 146 of the connector 444 has a connection key 148 attached thereto in the manner described above in connection with the assemblies 100, 200, 300. The connector 444 is configured to engage the first, second, third, and fourth beams 102, 202, 302, 402 to form a generally X-shaped or cross-shaped beam configuration. The connector 444 slidably engages the first, second, third, and fourth beams 102, 202, 302, 402 when each generally V-shaped side of the connection keys 148 slidably engages a particular one of the generally V-shaped alignment notches 126 of the beams 102, 202, 302, 402.

In an additional alternative, a plate may be attached to a bottom side of the connector 444 for aesthetic purposes and/or to provide additional structural support to the connector 444. A bottom side of this bottom plate can act as an "end cap," such as described above. Likewise, a bottom side of this bottom plate may also be adapted to act as an attachment point for a variety of devices or objects, such as described above.

Figure 26:
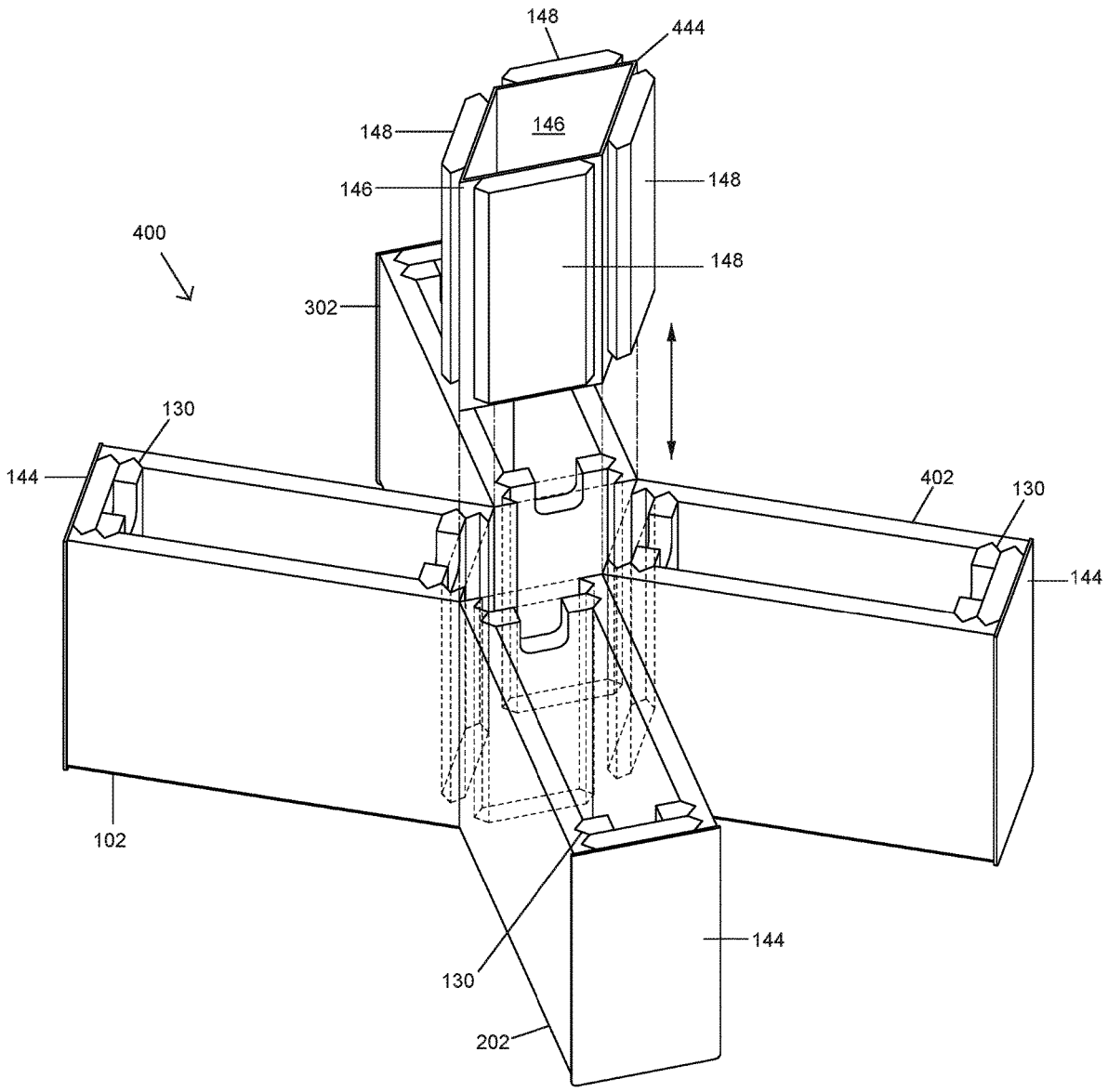
FIG. 26 illustrates a top, front, left perspective view of an additional architectural fixture embodying the invention, with four beams and a connector for interconnecting the four beams, with a double-ended arrow indicating directions of movement for the connector to engage with/disengage from the beams.
Figure 27:
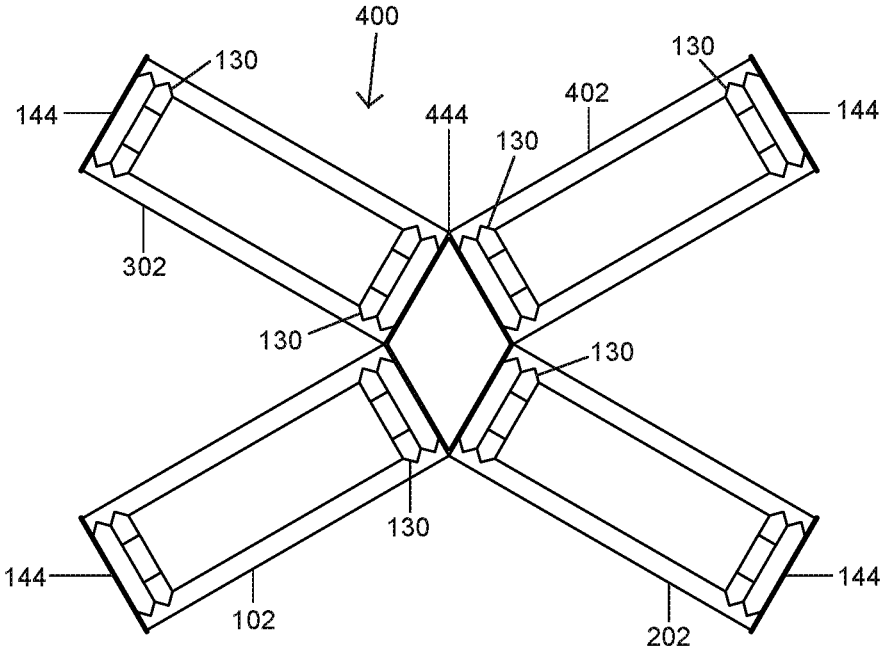
FIG. 27 illustrates a top plan view of the architectural fixture of FIG. 26, with the beams in engagement.

In an alternative embodiment, a more angled X-shape may be configured, as seen in FIGS. 26-27. In this alternative embodiment, instead of the beams 102, 202, 302, 402 meeting at right angles (i.e., ninety (90) degrees) to neighboring beams 102, 202, 302, 402 due to the plates 146 of the connector 444 meeting adjacent plates 146 at right angles (i.e., ninety (90) degrees; as seen in, for example, FIGS. 17-25), the relative angles between the plates 146 of the connector 444 may be adjusted such that the beams 102, 202, 302, 402 may meet at acute and obtuse angles relative to neighboring beams 102, 202, 302, 402. The plates 146 of other connectors (e.g., connector 244, 344, etc.) may be similarly modified as desired by a user.

Figure 28:
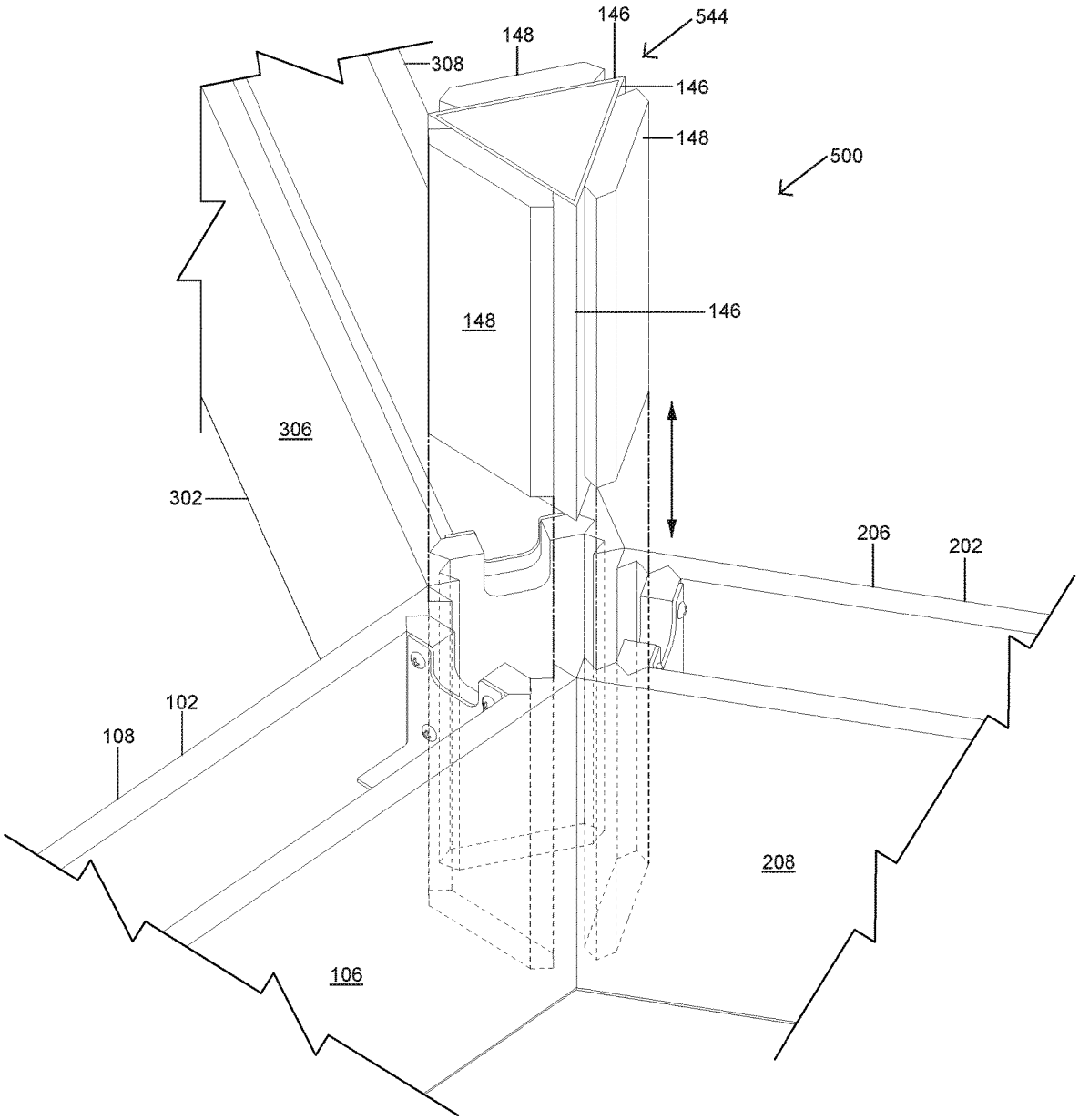
FIG. 28 illustrates a top, front, left perspective view of an additional architectural fixture embodying the invention, with three beams and a connector for interconnecting the three beams, with a double-ended arrow indicating directions of movement for the connector to engage with/disengage from the beams.
Figure 29:
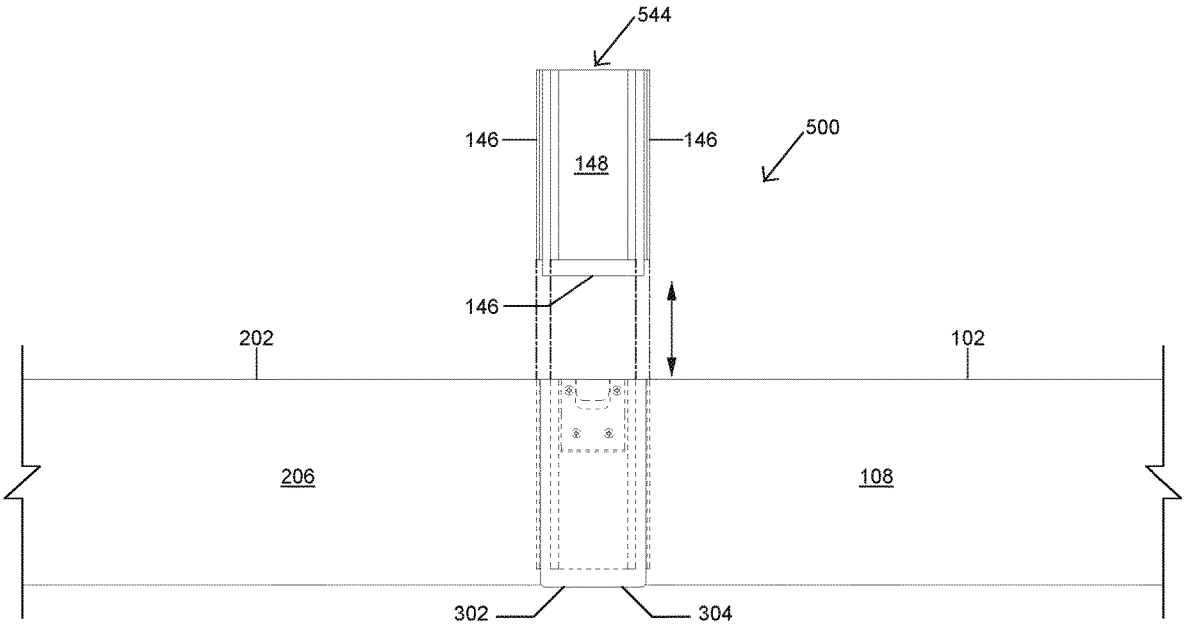
FIG. 29 illustrates a side elevation view of the architectural fixture of FIG. 28 looking into the third beam, with a double-ended arrow indicating directions of movement for the connector to engage with/disengage from the beams.
Figure 30:
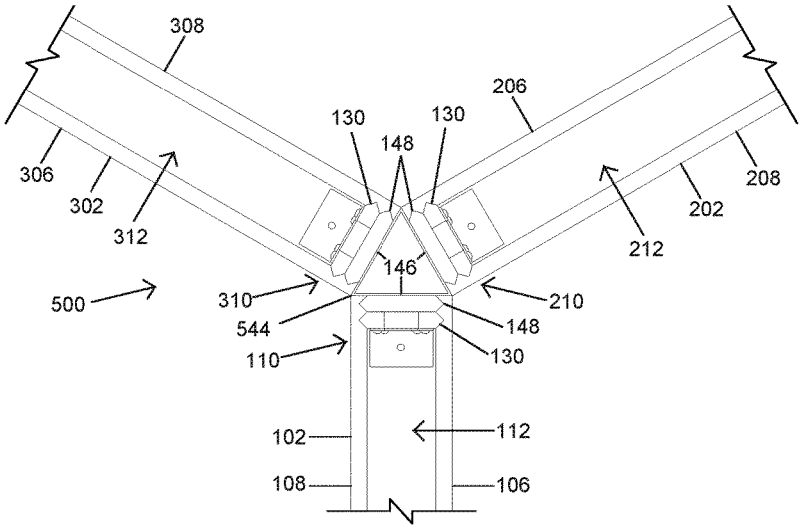
FIG. 30 illustrates a top plan view of the architectural fixture of FIG. 28, with the beams in engagement.

In accordance with an additional embodiment of the invention, an architectural fixture assembly 500 is illustrated in FIGS. 28-30. The assembly 500 has many similar, if not identical, features as described above in reference to the assemblies 100, 200, 300, 400 except that the assembly 500 illustrates an embodiment where three (3) beams 102, 202, 302 are connected, and each beam 102, 202, 302 is connected at an angle (not necessarily the same angle) to two of the other beams. Except for purposes of clarity, reference numbers used to describe features in the assemblies 100, 200, 300, 400 will be used to describe identical/similar features in the assembly 500.

A connector 544 includes three (3) plates 146, and three (3) connection keys 148. The three (3) plates 146 are configured in the form of a triangle (e.g., an equilateral triangle configuration is shown for purposes of illustration in the figures but the connector 544 is not limited to an equilateral triangle configuration) when viewed from above, with each plate 146 forming a side of the triangle. Each plate 146 and connection key 148 is as described above. Each of the three (3) plates 146 of the connector 544 has a connection key 148 attached thereto in the manner described above in connection with the assemblies 100, 200, 300, 400. The connector 544 is configured to engage the first, second, and third beams 102, 202, 302 to form a generally Y-shaped beam configuration. The connector 544 slidably engages the first, second, and third beams 102, 202, 302 when each generally V-shaped side of the connection keys 148 slidably engages a particular one of the generally V-shaped alignment notches 126 of the beams 102, 202, 302.

In an alternative, a plate may be attached to a bottom side of the connector 544 for aesthetic purposes and/or to provide additional structural support to the connector 544. A bottom side of this bottom plate can act as an "end cap," such as described above. Likewise, a bottom side of this bottom plate may also be adapted to act as an attachment point for a variety of devices or objects, such as described above.

Figure 31:
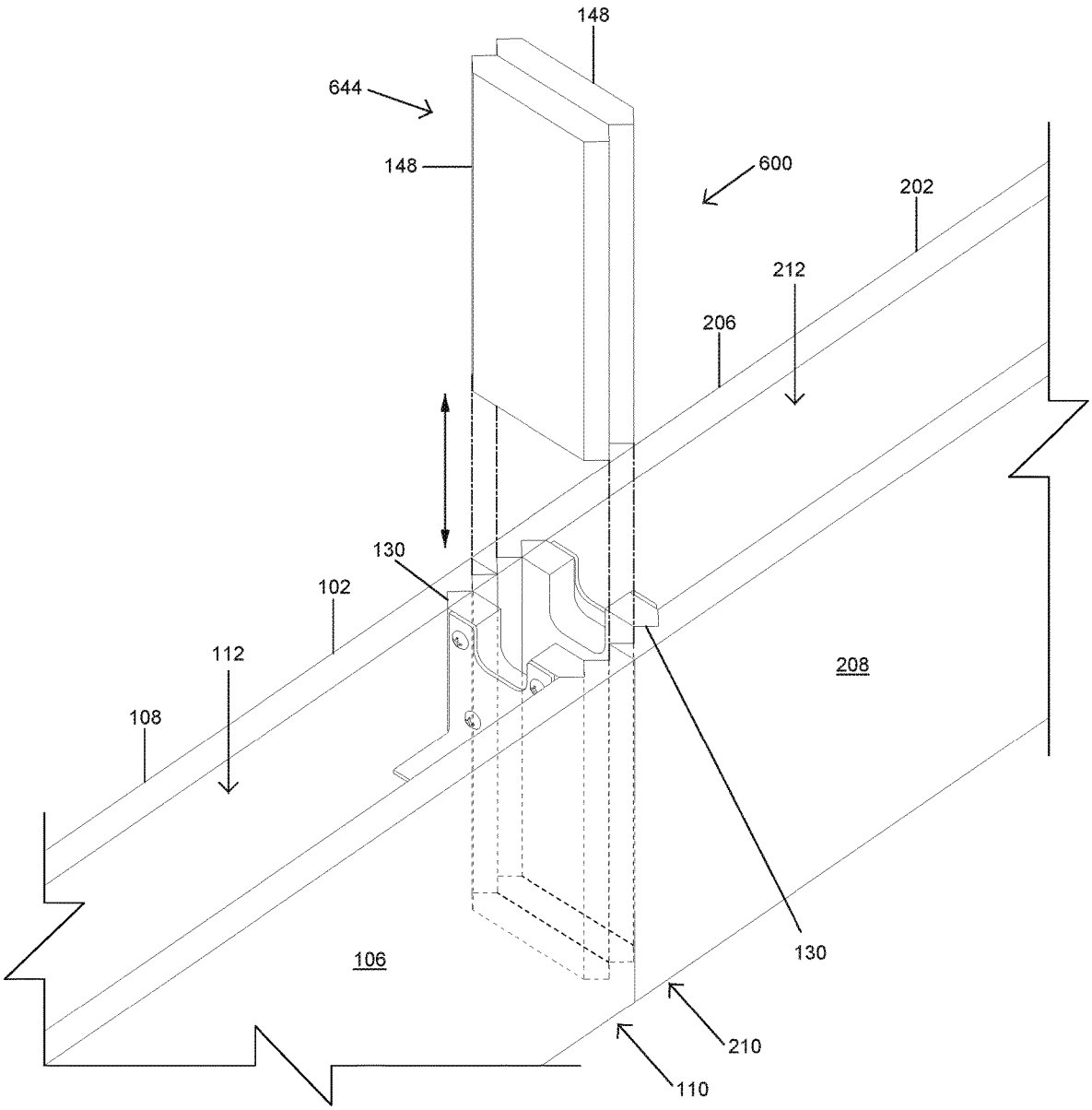
FIG. 31 illustrates a top, front, left perspective view of a further architectural fixture embodying the invention, with two beams and a connector for interconnecting the two beams, with a double-ended arrow indicating directions of movement for the connector to engage with/disengage from the beams.
Figure 32:
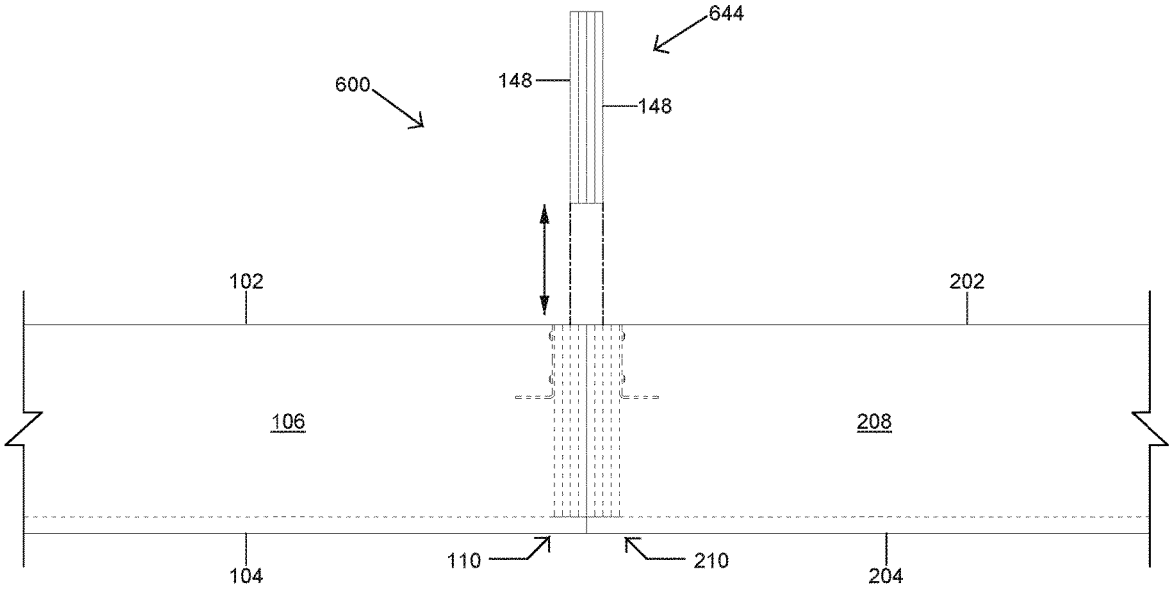
FIG. 32 illustrates a left side elevation view of the architectural fixture of FIG. 31, with a double-ended arrow indicating directions of movement for the connector to engage with/disengage from the beams.
Figure 33:
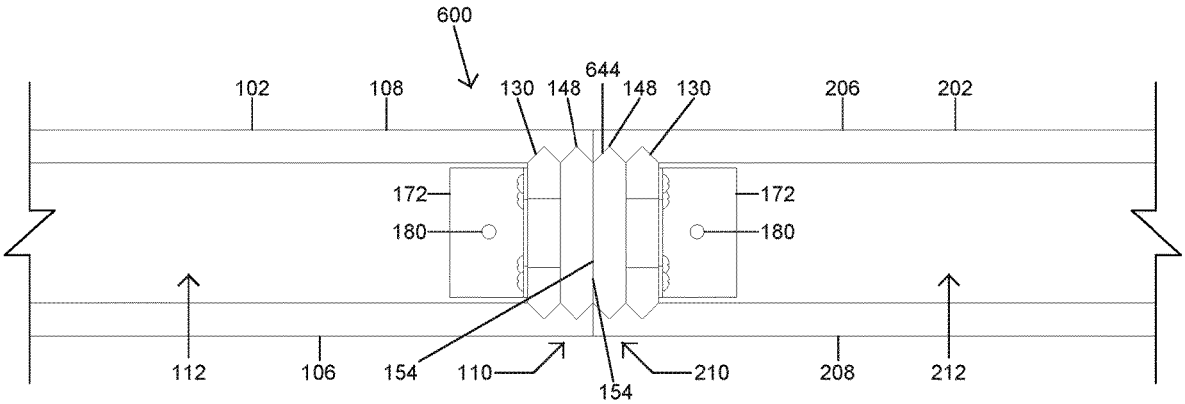
FIG. 33 illustrates a top plan view of the architectural fixture of FIG. 31, with the beams in engagement.

In accordance with a further embodiment of the invention, an architectural fixture assembly 600 is illustrated in FIGS. 31-33. The assembly 600 has many similar, if not identical, features as described above in reference to the assemblies 100, 200, 300, 400, 500 except that the assembly 600 describes an embodiment where two beams 102, 202 are connected end-to-end. Except for purposes of clarity, reference numbers used to describe features in the assemblies 100, 200, 300, 400, 500 will be used to describe identical/similar features in the assembly 600.

A connector 644 includes two (2) connection keys 148. Each connection key 148 is as described above. The front side 154 of each connection key 148 is fixedly attached to the front side 154 of the other connection key 148. The front side 154 may be fixedly attached by adhesive (e.g., glue, etc.), double-sided tape, screws, a fixing plate above, or woodworking joint (e.g., a dado joint, a dovetail joint, etc.). The connection keys 148 are generally aligned with, and attached to, each other with sides 150, 152, 158, 160 of each connection key 148 generally aligned with respective sides 150, 152, 158, 160 of the other connection key 148 (e.g., mid-points of the height and width of each connection key 148 are generally aligned with mid-points of the height and width of the other connection key 148).

The connector 644 is configured to engage the first and second beams 102, 202 in an end-to-end configuration. The connector 644 slidably engages the first and second beams 102, 202 when each generally V-shaped side of the connection keys 148 slidably engages a particular one of the generally V-shaped alignment notches 126 of the beams 102, 202. That is, the generally V-shaped sides of the one of the connection keys 148 are configured to slidably engage the generally V-shaped alignment notches 126 of the first beam 102, and the generally V-shaped sides of the other connection key 148 are configured to slidably engage the generally V-shaped alignment notches 126 of the second beam 202.

In the alternative, the connector 644 includes four (4) plates 146, and two (2) connection keys 148, with each connection key 148 disposed on an opposite side of the connector 644 from the other connection key 148 in order to provide an end-to-end configuration, such that the connector 644 is disposed between the beams 102, 202. The four (4) plates 146 are configured in the form of a quadrangle (e.g., a square, a rectangle, a rhombus, etc.) when viewed from above, with each plate 146 forming a side of the quadrangle. Each plate 146 and connection key 148 is as described above. Only two (2) of the four (4) plates 146 of the connector 244 have a connection key 148 attached thereto in the manner described above in connection with the assembly 100. As mentioned above, the two (2) plates 146 that have a connection key 148 would be disposed on opposite sides of the connector 644. The other two (2) plates 146 of the connector 244 (i.e., the plates 146 that do not have a connection key 148 attached thereto) may act as "end caps" of the beams 102, 202, such as described above (though these plates 146 might more accurately be described as "side caps" since these plates 146 would be disposed between the sides 106, 108, 206, 208 of the beams 102, 202). Likewise, the front side 166 of the plates 146 that do not have a connection key 148 attached thereto may also be adapted to act as an attachment point for a variety of devices or objects, such as described above. A plate may be attached to a bottom side of the connector 644 for aesthetic purposes and/or to provide additional structural support to the connector 644.

Figure 34:
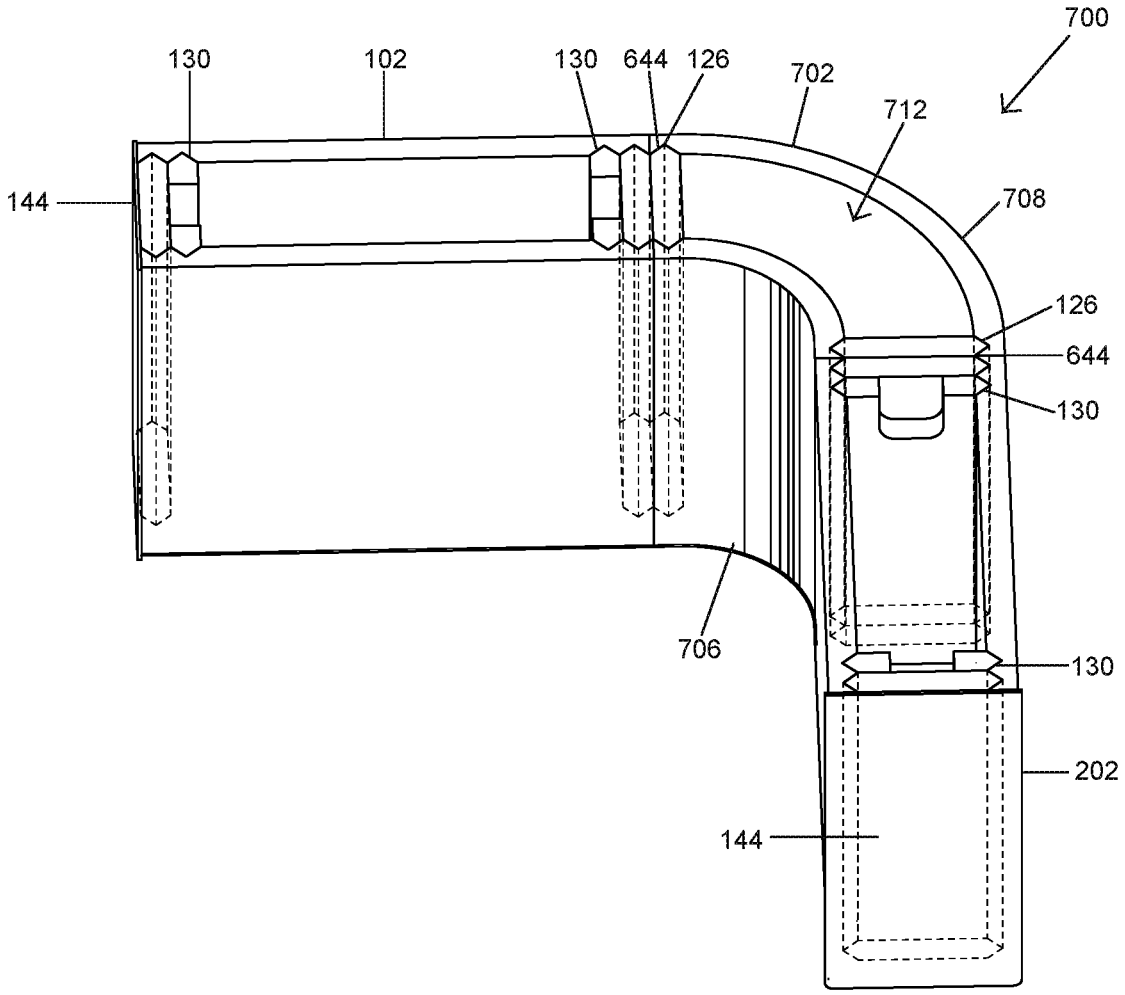
FIG. 34 illustrates a top, front, left perspective view of yet a further architectural fixture embodying the invention, with two linear beams, a curved beam disposed between the linear beams, and connectors for interconnecting the beams.
Figure 35:
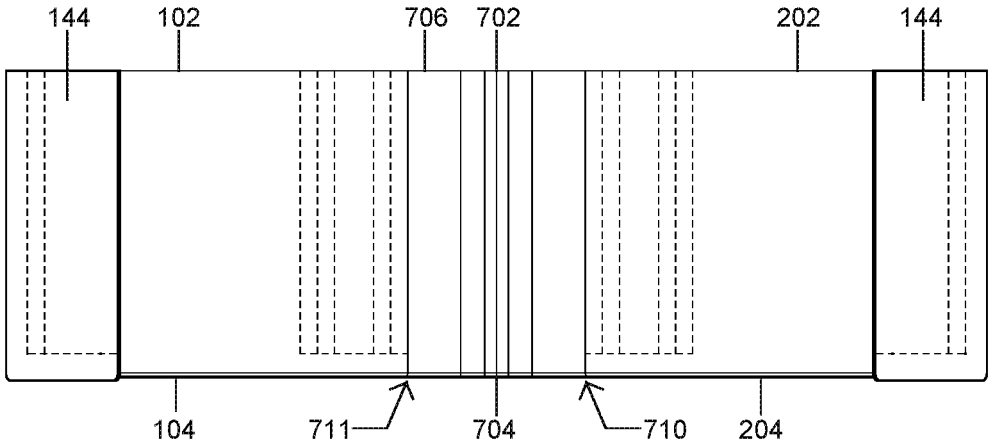
FIG. 35 illustrates a front side elevation view of the architectural fixture of FIG. 34.
Figure 36:
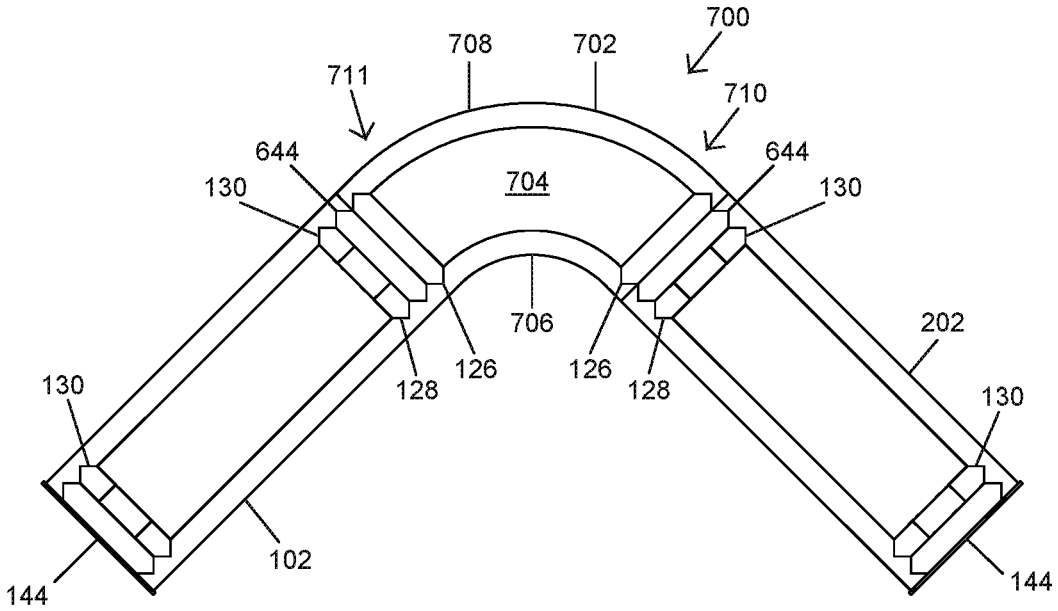
FIG. 36 illustrates a top plan view of the architectural fixture of FIG. 34.
Figure 37:
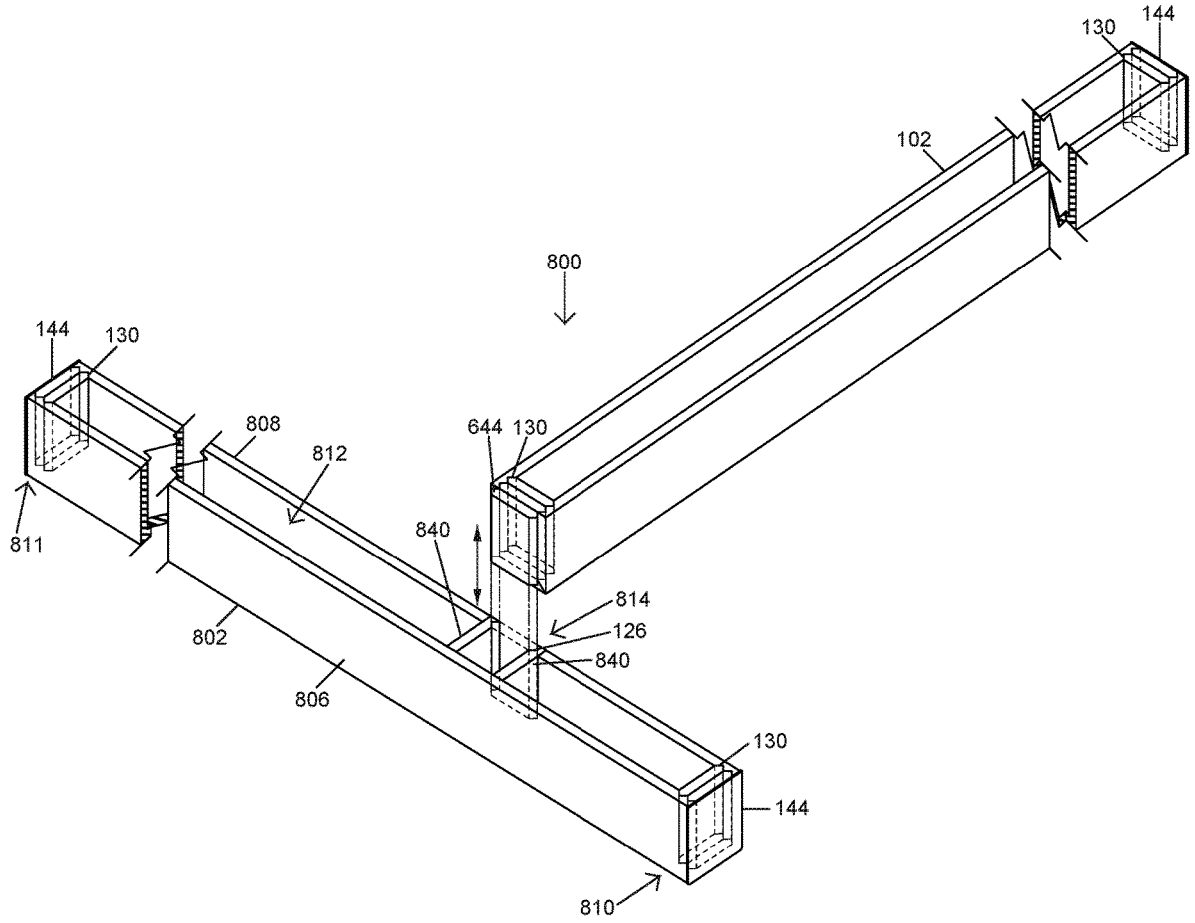
FIG. 37 illustrates a top, front, left perspective view of another architectural fixture embodying the invention, with two beams and a connector for interconnecting the two beams, showing the two beams prior to engagement, with a double-ended arrow indicating directions of movement for the connector (already shown engaging one of the beams) to engage with/disengage from the beam(s)
Figure 38:
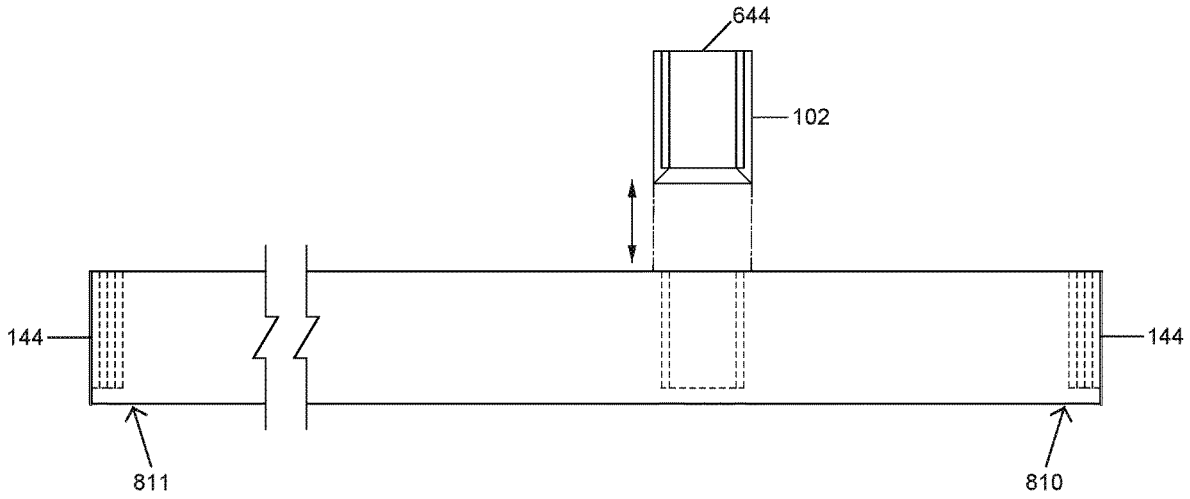
FIG. 38 illustrates a front elevation view of the architectural fixture of FIG. 37, with a double-ended arrow indicating directions of movement for the connector to engage with/disengage from the beams.
Figure 39:
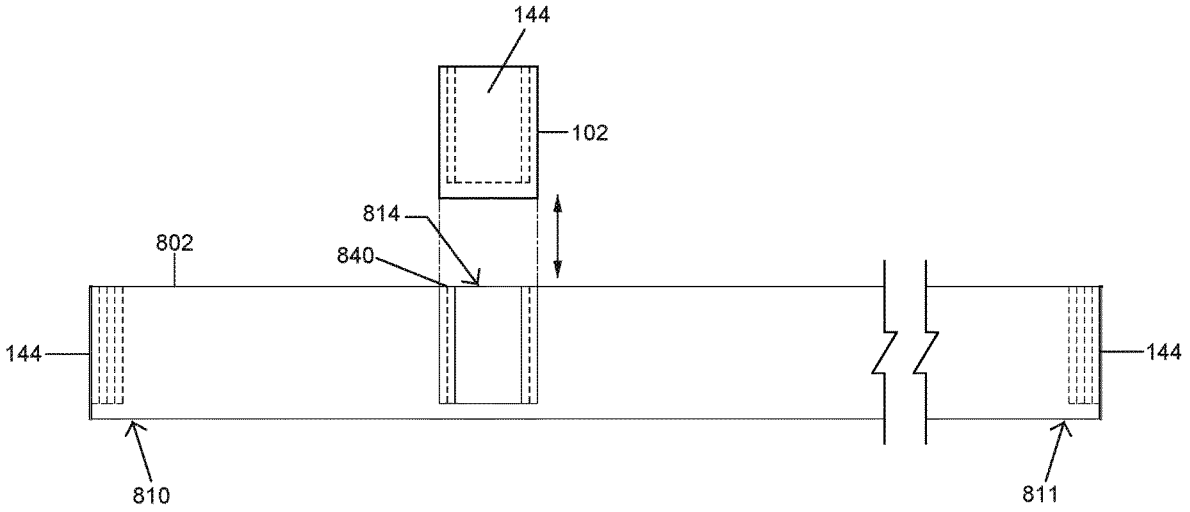
FIG. 39 illustrates a rear elevation view of the architectural fixture of FIG. 37, with a double-ended arrow indicating directions of movement for the connector to engage with/disengage from the beams.
Figure 40:
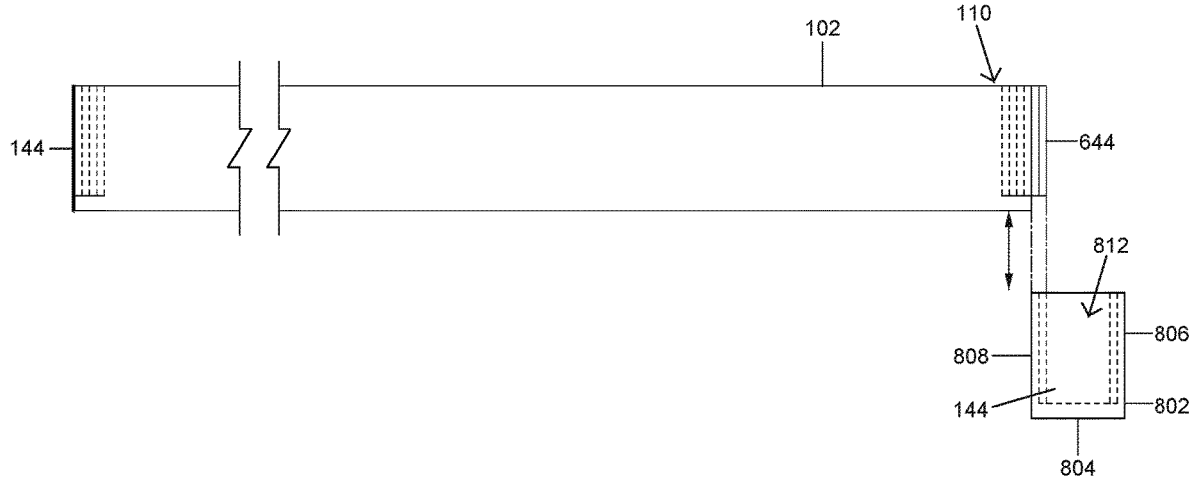
FIG. 40 illustrates a left side elevation view of the architectural fixture of FIG. 37, with a double-ended arrow indicating directions of movement for the connector to engage with/disengage from the beam.
Figure 41:
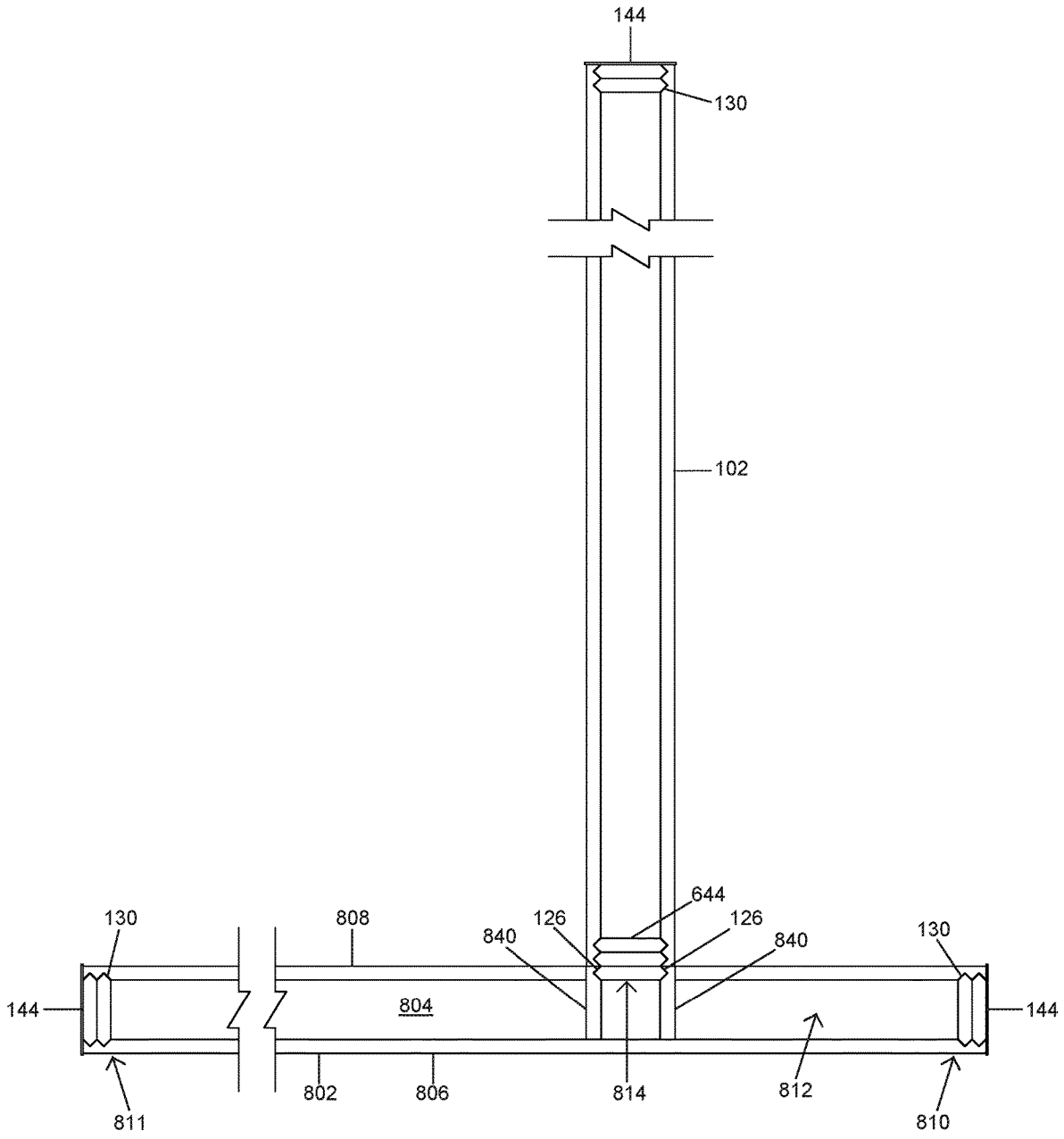
FIG. 41 illustrates a top plan view of the architectural fixture of FIG. 37, with the beams in engagement.

In accordance with a further embodiment of the invention, an architectural fixture assembly 700 is illustrated in FIGS. 34-36. The assembly 700 has many similar, if not identical, features as described above in reference to the assemblies 100, 200, 300, 400, 500, 600 except that the assembly 700 describes an embodiment with at least three beams 102, 202, 702 where the beam 702 is curved, and disposed between the other beams 102, 202. Except for purposes of clarity, reference numbers used to describe features in the assemblies 100, 200, 300, 400, 500, 600 will be used to describe identical/similar features in the assembly 700.

The curved beam 702 is generally U-shaped, and includes a bottom side 704, a first side 706, a second side 708, a first end 710, and a second end 711, wherein interior surfaces of the first, second, and bottom sides 706, 708, 704 of the second beam 702 define an interior portion 712. Except for the beam 702 including a single curve (as shown) or a plurality of curves along a length of the curved beam 702, the curved beam 702 is otherwise identical to the other beams 102, 202 in design and construction. The shape of the beam 702 depends on the number of curves along the length of the beam 702. As shown, the beam 702 is curved such that the first and second ends of the beam 702 are ninety (90) degrees to each other. In another example, the beam 702 may be configured into a general U-shape by including just a single curve or a pair of curves to create the general U-shape of the beam 702. In yet another example, the beam 702 may be configured into a general S-shape by using a plurality of curves along the length of the beam 702 to create the general S-shape of the beam 702. The beam 702 may be configured into any desired curved shape by adjusting the number of curves along the length of the beam. The curved beam 702 may be connected to a generally linear beam or another curved beam, as desired. As seen, the beams 102, 202 are each generally linear, with the curved beam 702 disposed therebetween in order to provide a ninety (90) degree transition from one beam 102, 202 to the other beams 202, 102. Architectural fixture assemblies of various designs can be created using a combination of linear and curved beams. The interior surfaces of the first and second sides 706, 708 of the second beam 702 each include a generally V-shaped alignment notch 126 disposed generally adjacent to the first and second end 710, 711 of the second beam 702. If desired, the curved beam 702 may also include a spacer 130 engaging a generally V-shaped alignment notch 128 generally adjacent to the generally V-shaped alignment notch 126. Except for purposes of clarity, reference numbers used to describe features in the assemblies 100, 200, 300, 400, 500, 600 will be used to describe identical/similar features in the assembly 700.

A connector 644, described above, may be used to join the first and curved beams 102, 702. Likewise, a connector 644, described above, may also be used to join the second and curved beams 202, 702. Architectural fixture assemblies of various designs can be created using a combination of linear and curved beams joined by any one or more of the connectors 244, 344, 444, 544, 644. The connector 644 is configured to engage the first and curved beams 102, 702 (as well as the second and curved beams 202, 702) in an end-to-end configuration. As set forth above, the connector 644 slidably engages the first and curved beams 102, 702 when each generally V-shaped side of the connection keys 148 slidably engages a particular one of the generally V-shaped alignment notches 126 of the beams 102, 702. That is, the generally V-shaped sides of the one of the connection keys 148 are configured to slidably engage the generally V-shaped alignment notches 126 of the first beam 102, and the generally V-shaped sides of the other connection key 148 are configured to slidably engage the generally V-shaped alignment notches 126 of the curved beam 702. The connector 644 connects the second and curved beams 202, 702 in a similar, if not identical, manner. In the alternative, various other connectors (e.g., connector 244, 344, 444, 544, etc.) may be used to provide an end-to-end configuration, such that the connector (e.g., connector 244, 344, 444, 544, etc.) is disposed between the beams 102, 702 (with the second and curved beams 202, 702 connected end-to-end in a similar manner). A particular connector (e.g., connector 244, 344, 444, 544, 644, etc.) may be used to connect the first and curved beams 102, 702, and the same or a different connector (e.g., connector 244, 344, 444, 544, 644, etc.) may be used to connect the second and curved beams 202, 702. The above-discussed embodiment of the curved beam is illustrative only. In the alternative, a curved beam can include a curve of any desired radius, or a plurality of curves of any desired radius (e.g., with all the curves having the same radii, some of the curves having a particular radius but other curves of the plurality having another radius or differing radii, all of the curves having different radii). The direction of the curve(s) of any particular beam may be as desired by a user. In another alternative, various curved beams (of any desired radius and/or radii) can be joined together to form an assembly.

In accordance with a further embodiment of the invention, an architectural fixture assembly 800 is illustrated in FIGS. 37-41. The assembly 800 has many similar, if not identical, features as described above in reference to the assemblies 100, 200, 300, 400, 500, 600, 700 except that the assembly 800 describes an embodiment where two beams 102, 802 engage each other in a generally T-shaped configuration. Except for purposes of clarity, reference numbers used to describe features in the assemblies 100, 200, 300, 400, 500, 600, 700 will be used to describe identical/similar features in the assembly 800.

The second beam 802 is generally U-shaped, and includes a bottom side 804, a first side 806, a second side 808, a first end 810, and a second end 811 wherein interior surfaces of the first, second, and bottom sides 806, 808, 804 of the second beam 802 define an interior portion 812. Except for a break or gap 814 in the first and/or second sides 806, 808 of the second beam 802, the second beam 802 is otherwise similar to, if not identical, to the first beam 102 in design and construction. The break or gap 814 extends from a top side of the first and/or second sides 806, 808 to a top surface of the bottom side 804 of the second beam 802. In the illustrated embodiment, there is a break 814 in the second side 808 but, in an alternative embodiment, the break 814 may be on the first side 806. Likewise, in alternative embodiments, the first side 806 and/or the second side 808 may include a plurality of breaks 814 for providing a point(s) of engagement for other beam(s), with breaks 814 on the first side 806 aligned and/or not aligned with breaks 814 on the second side 808. The location of the break 814 on the beam 802 is for illustrative purposes only, and the break(s) 814 may be located anywhere along the length of the beam 802. Lateral supports 840 may be placed in the interior portion 812 of the beam 802, and secured to the first and second sides 806, 808 in order to provide additional structural support to the second beam 802. Each lateral support 840 includes a generally V-shaped alignment notch 126 such that there are a pair of alignment notches 126, with each alignment notch 126 generally aligned with, and disposed on an opposite side of the break 814 from the other alignment notch 126. Except for purposes of clarity, reference numbers used to describe features in the assemblies 100, 200, 300, 400, 500, 600, 700 will be used to describe identical/similar features in the assembly 800.

A connector 644, described above, may be used to join the first and second beams 102, 802. The connector 644 is configured to engage the first and second beams 102, 802 in a generally T-shaped configuration. The connector 644 slidably engages the first and second beams 102, 802 when each generally V-shaped side of the connection keys 148 slidably engages a particular one of the generally V-shaped alignment notches 126 of the beams 102, 802. That is, the generally V-shaped sides of the one of the connection keys 148 are configured to slidably engage the generally V-shaped alignment notches 126 at the first end 110 of the first beam 102, and the generally V-shaped sides of the other connection key 148 are configured to slidably engage the generally V-shaped alignment notch 126 of the lateral supports 840 of the second beam 802. In the alternative, various other connectors (e.g., connector 244, 344, 444, 544, etc.) may be used such that the connector (e.g., connector 244, 344, 444, 544, etc.) is disposed between the beams 102, 802 (in this manner, additional beams may be joined to create a desired configuration with the beams 102, 802).

Figure 42:
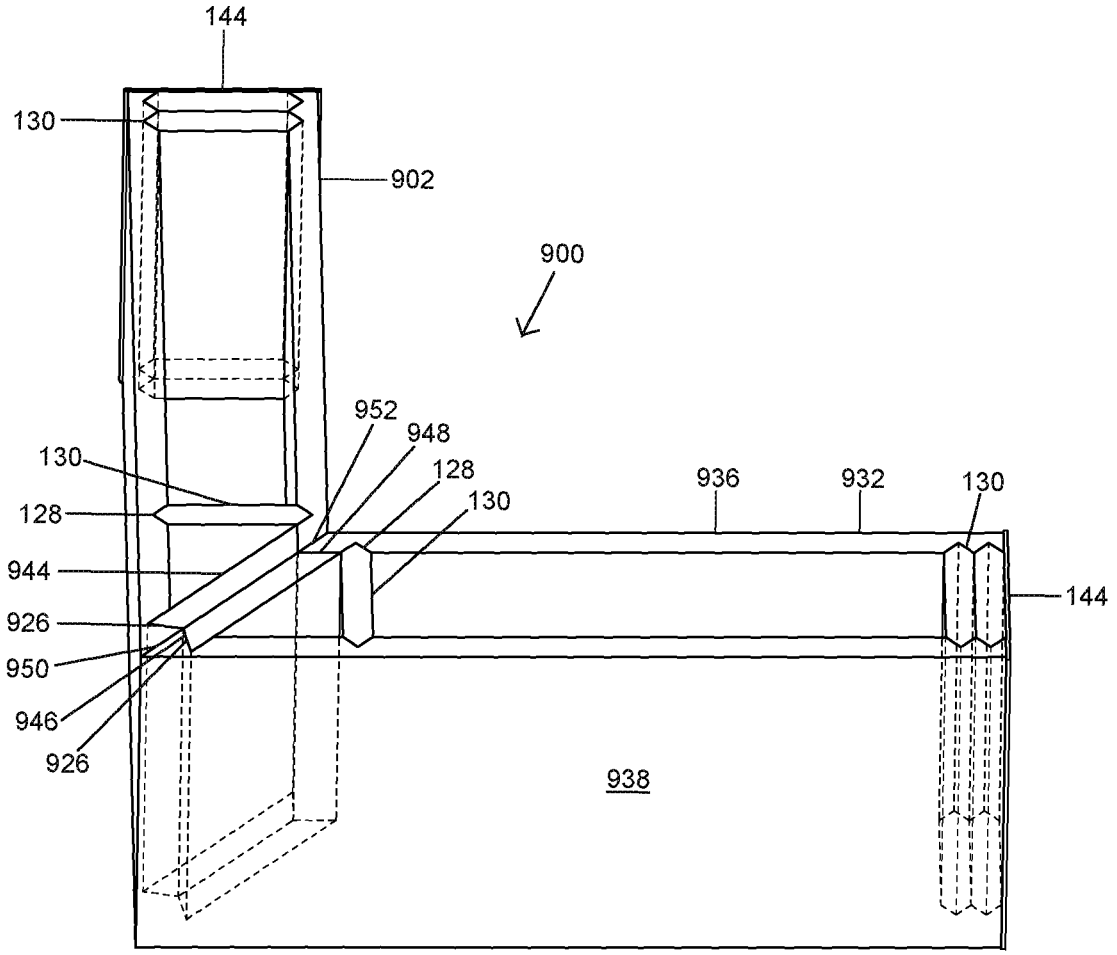
FIG. 42 illustrates a top, front, left perspective view of yet another architectural fixture embodying the invention, with two beams engaging at angled ends of the beams, and a connector for interconnecting the beams such that the beams engage at a right (i.e., ninety (90) degree) angle in a generally L-shaped configuration.
Figure 43:
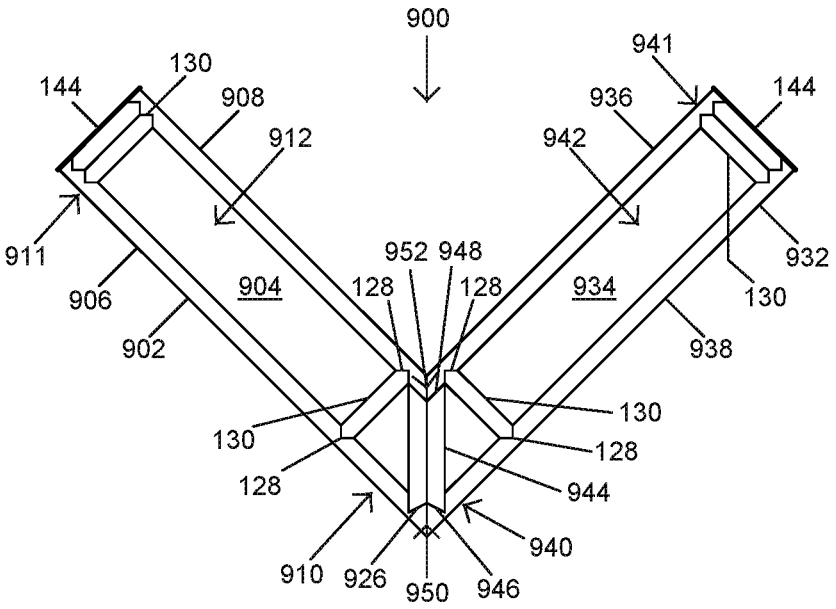
FIG. 43 illustrates a top plan view of the architectural fixture of FIG. 42.

In accordance with a further embodiment of the invention, an architectural fixture assembly 900 is illustrated in FIGS. 42-43. The assembly 900 has many similar, if not identical, features as described above in reference to the assemblies 100, 200, 300, 400, 500, 600, 700, 800 except that the assembly 900 describes an embodiment where two beams 902, 932 are connected end-to-end, with each beam 902, 932 including an angled first end that is connected to the angled first end of the other beam. Except for purposes of clarity, reference numbers used to describe features in the assemblies 100, 200, 300, 400, 500, 600, 700, 800 will be used to describe identical/similar features in the assembly 900.

The architectural fixture assembly 900 includes a generally U-shaped first beam 902 having a bottom portion or side 904, a first side 906, a second side 908, a first end 910, and a second end 911. Interior surfaces of the first, second, and bottom sides 906, 908, 904 of the beam 902 define an interior portion 912. The beam 902 may be made from a generally flat, elongated sheet similar in construction to the sheet 114, described above, and the beam 902 includes similar/identical structures (e.g., fold lines 122, V-shaped cuts 124, second alignment notches 128, etc.) as found in the beam 102, described above. Due to the inclusion of various features similar/identical to those of the sheet 114, the elongated sheet is folded from a flat configuration to the generally U-shaped configuration of the beam 902. The sheet 914 is also cut such that the first end 910 of the beam 902 is angled inwardly from the first side 906 to the second side 908.

The beam 902 also includes a first alignment notch 926 (formed in the sheet 914) on an interior surface of the first side 906 of the beam 902, and disposed generally adjacent to the first end 910 of the beam 902. However, unlike the first alignment notches 126 of the beam 102, the interior surface of the second side 908 of the beam 902 does not include a first alignment notch. With regard to the first end 910 of the beam 902, the first and second sides 906, 908 each have a second alignment notch 128 so that a spacer 130 may engage the beam 902. However, due to the first end 910 being at an angle, the second alignment notch 128 located on the second side 908 is closer to the first end 910 of the beam 902 than the second alignment notch 128 located on the first side 906 of the beam 902. The first alignment notch 126 of the first side 906 is closer to the first end 910 of the beam 902 than the second alignment notch 128 of the first side 906. The alignment notch 926 is in the shape of a generally V-shaped mitre cut. Alternatively, the alignment notch 926 may have various other shapes including, without limitation, a dovetail, and other types of joints found in woodworking including, without limitation, a tongue and groove joint, a dado joint, a finger joint, a mitre joint, a puzzle piece joint, and a half blind lap joint. Likewise, the second end 911 of the beam 902 may also include a spacer 130 engaging a pair of second alignment notches 128.

The architectural fixture assembly 900 includes a generally U-shaped second beam 932 having a bottom portion or side 934, a first side 936, a second side 938, a first end 940, and a second end 941. Interior surfaces of the first, second, and bottom sides 936, 938, 934 of the beam 902 define an interior portion 942. The second beam 932 may be a mirror image of the first beam 902 (e.g., the first end 940 of the beam 932 is angled outwardly from the first side 936 to the second side 938; a first alignment notch 926 is located on an interior surface of the second side 938 of the beam 932 but an interior surface of the first side 936 of the beam 902 does not include a first alignment notch; etc.). The second end 911 of the first beam 902 may be angled or straight, depending on the design needs of the user. Likewise, the second end 941 of the second beam 932 may be angled or straight, depending on the design needs of the user. In this manner, the second ends 911, 941 of the beams 902, 932 may have the same/similar features as the first end 120 (e.g., first and second alignment notches 126, 128, etc.) of the beam 102, the same/similar features as the first ends 910, 940 of the beams 902, 932, a mirror image of the first ends 910, 940 of the beams 902, 932, or a variation of any of the foregoing.

When the first ends 910, 940 of the beams 902, 932 are in direct engagement, the first side 906 of the first beam 902 and the second side 938 of the second beam 932 are configured to form a generally V-shaped first alignment feature 950. The generally V-shaped feature 950 includes the first alignment notch 926 of the first side 906 of the first beam 902, and the first alignment notch 926 of the second side 938 of the second beam 932. When the first ends 910, 940 of the beams 902, 932 are in direct engagement, the second side 908 of the first beam 902 and the first side 936 of the second beam 932 are configured to form a generally V-shaped second alignment feature 952.

A connector 944 is configured to engage the first and second beams 902, 932 in an end-to-end configuration. The connector 944 includes a generally V-shaped first side 946, and a generally V-shaped second side 948 opposite the first side 946. As illustrated, each of the generally V-shaped sides 946, 948 is in the form of a generally V-shaped notch. The connector 944 slidably engages the first and second beams 902, 932 when each generally V-shaped side 946, 948 slidably engages a particular one of the generally V-shaped alignment features 950, 952 of the beams 902, 932. That is, the generally V-shaped side 946 is configured to slidably engage the generally V-shaped first alignment feature 950, and the generally V-shaped side 948 is configured to slidably engage the generally V-shaped second alignment feature 952.

The respective angle of each of the first ends 910, 932 may be varied to meet the design needs of the user. For example, as seen in FIGS. 42-43, if the user needs the beams 910, 932 to meet at a right angle (i.e., ninety (90) degrees), the respective first ends 910, 940 of the beams 902, 932 could be angled at forty-five (45) degrees each, or at any angle desired by the user (e.g., the first end 910 at thirty (30) degrees and the first end 940 at sixty (60) degrees or vice versa, etc.).

Figure 44:
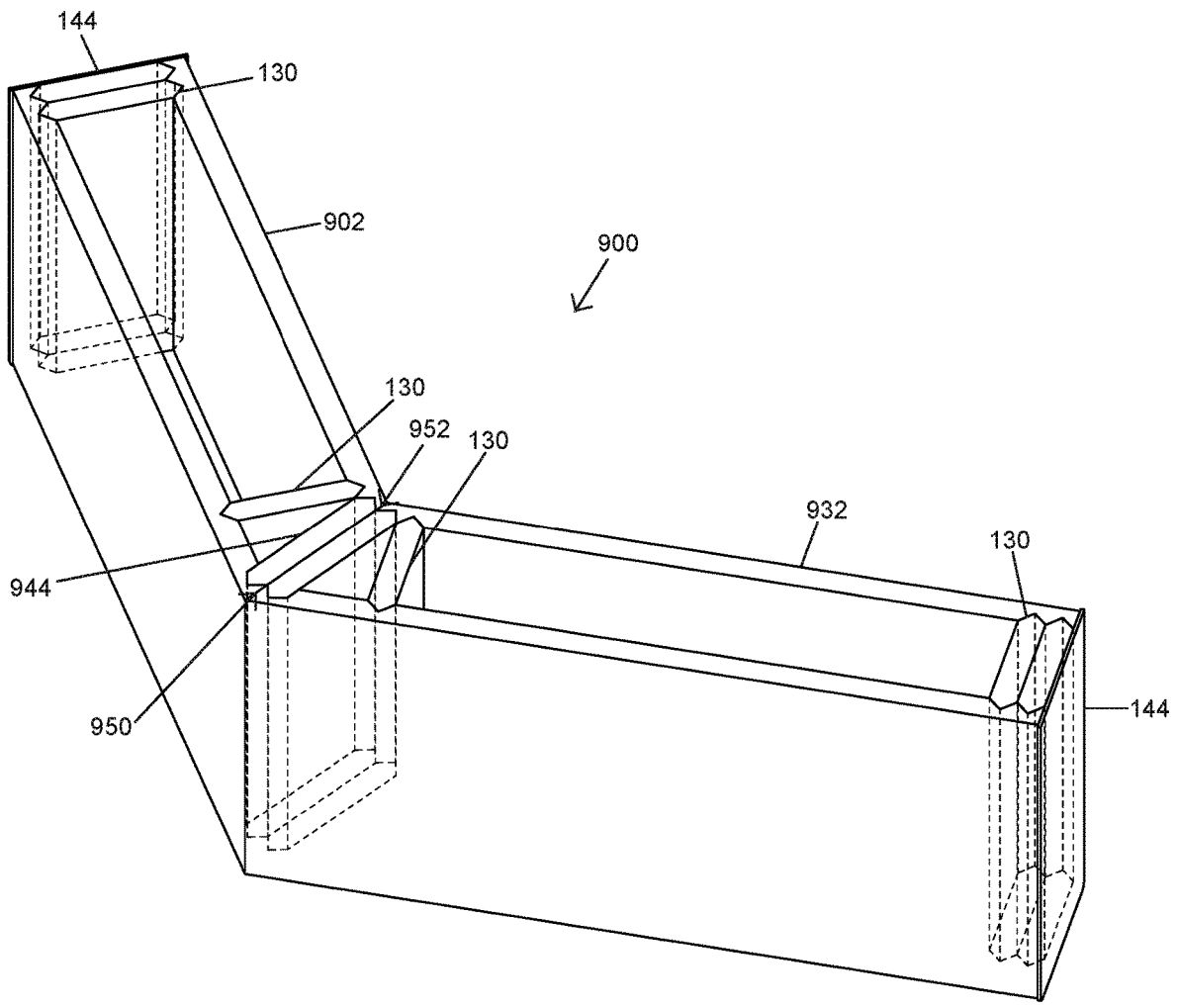
FIG. 44 illustrates a top, front, left perspective view of yet another architectural fixture embodying the invention, with two beams engaging at angled ends of the beams, and a connector for interconnecting the beams such that the beams engage at an angle in a generally V-shaped configuration.
Figure 45:
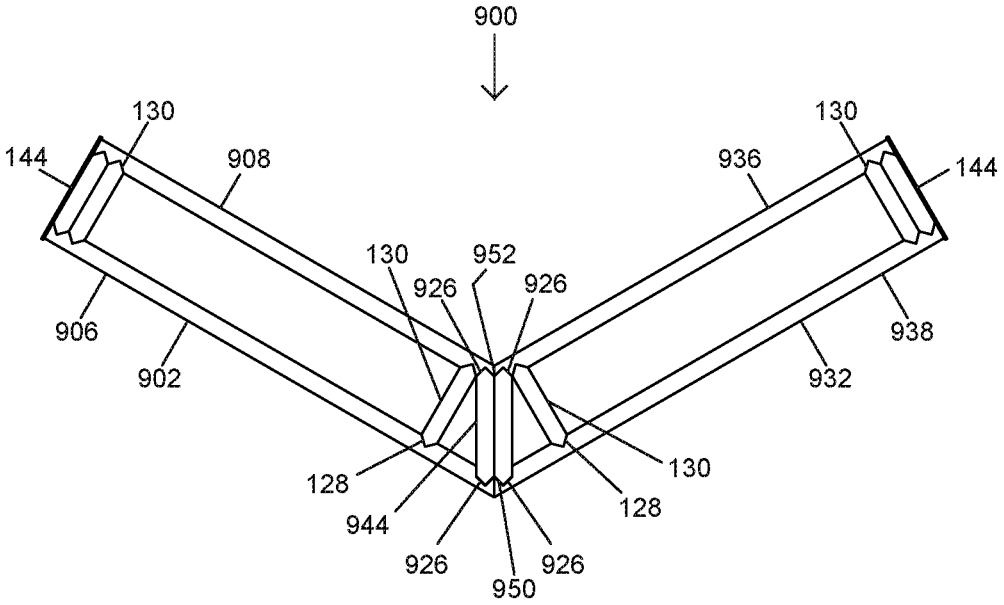
FIG. 45 illustrates a top plan view of the architectural fixture of FIG. 44.
Figure 46:
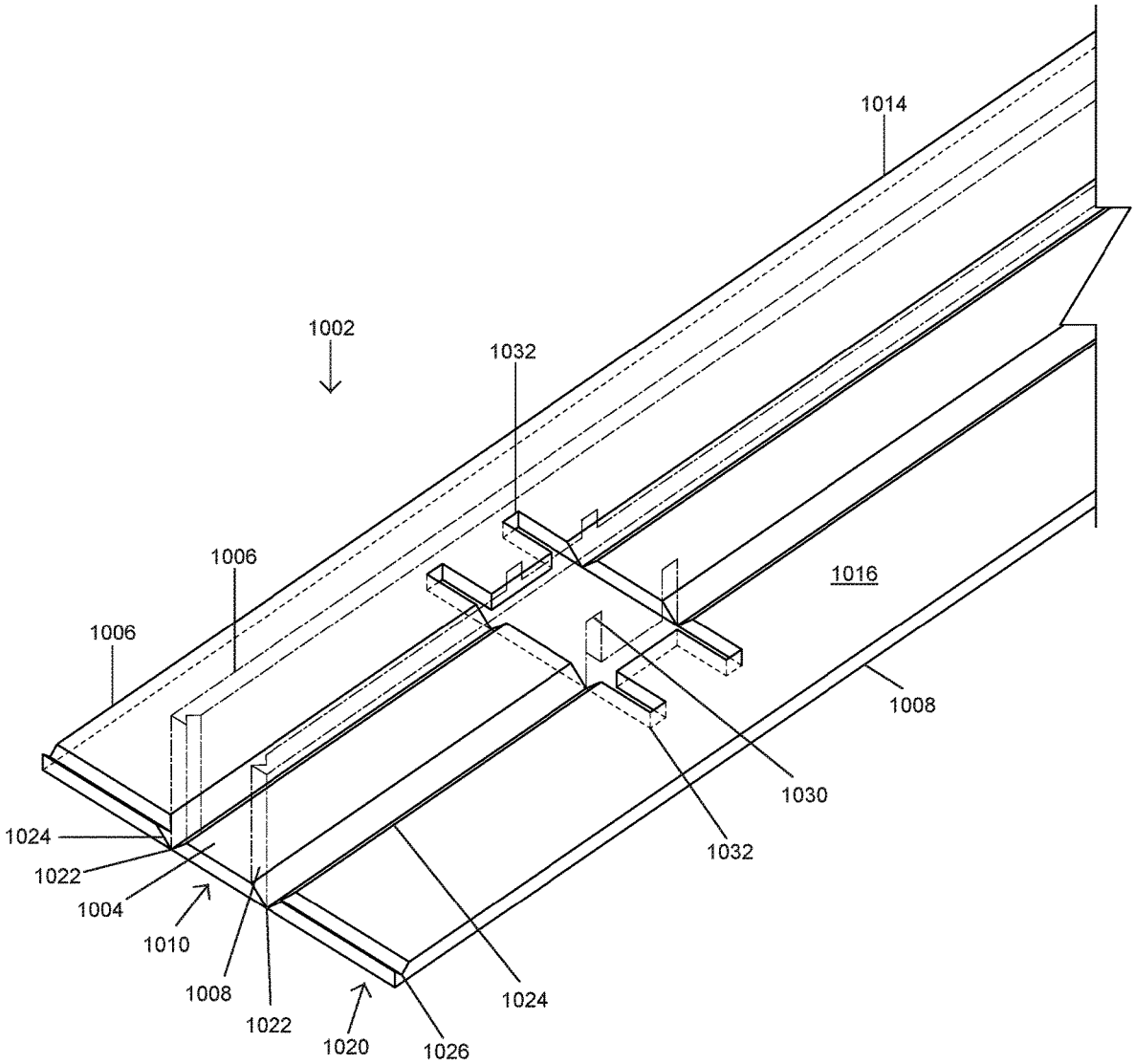
FIG. 46 illustrates a top, front, left perspective view of a first beam of an additional architectural fixture embodying the invention, where the beam is in a generally flat, unfolded configuration in solid lines, and shown in a folded, generally U-shaped configuration in broken lines.
Figure 47:
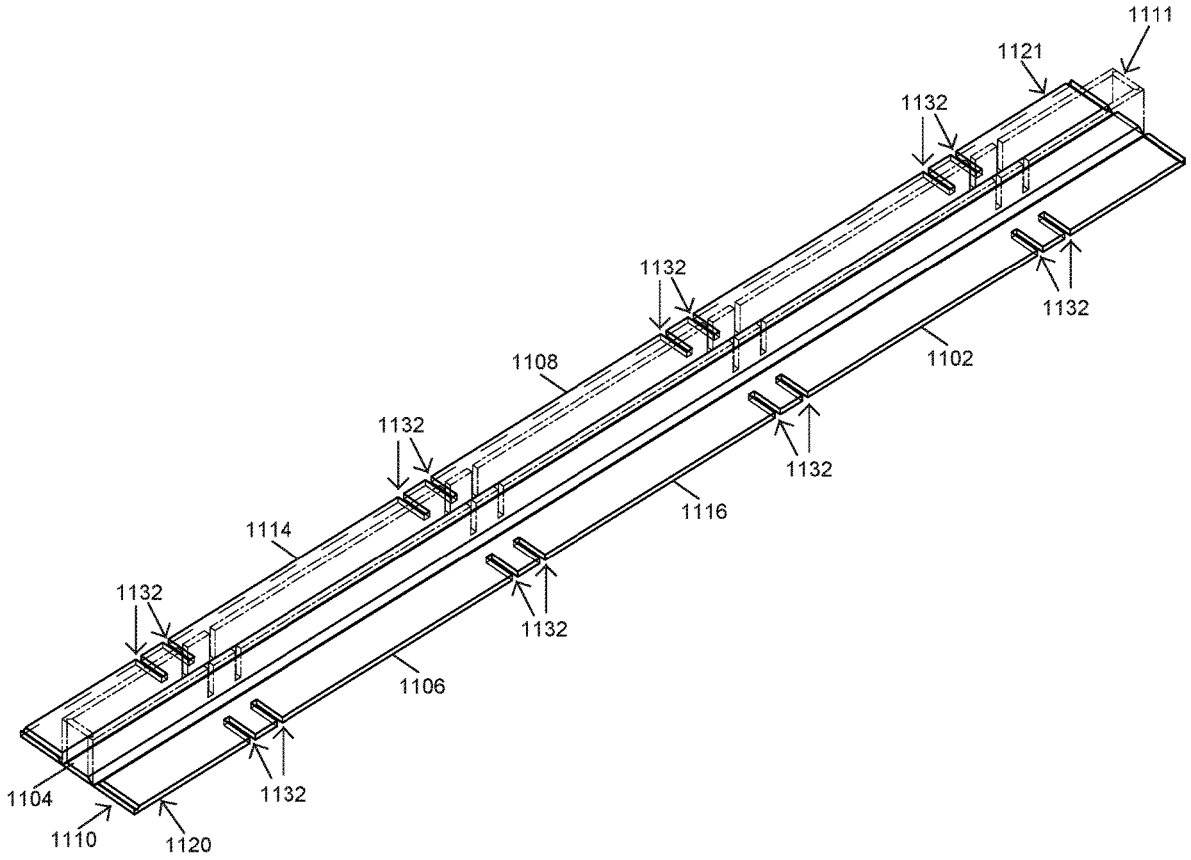
FIG. 47 illustrates a top, front, left perspective view of a second beam of the architectural fixture, where the beam is in a generally flat, unfolded configuration in solid lines, and shown in a folded, generally U-shaped configuration in broken lines.
Figure 48:
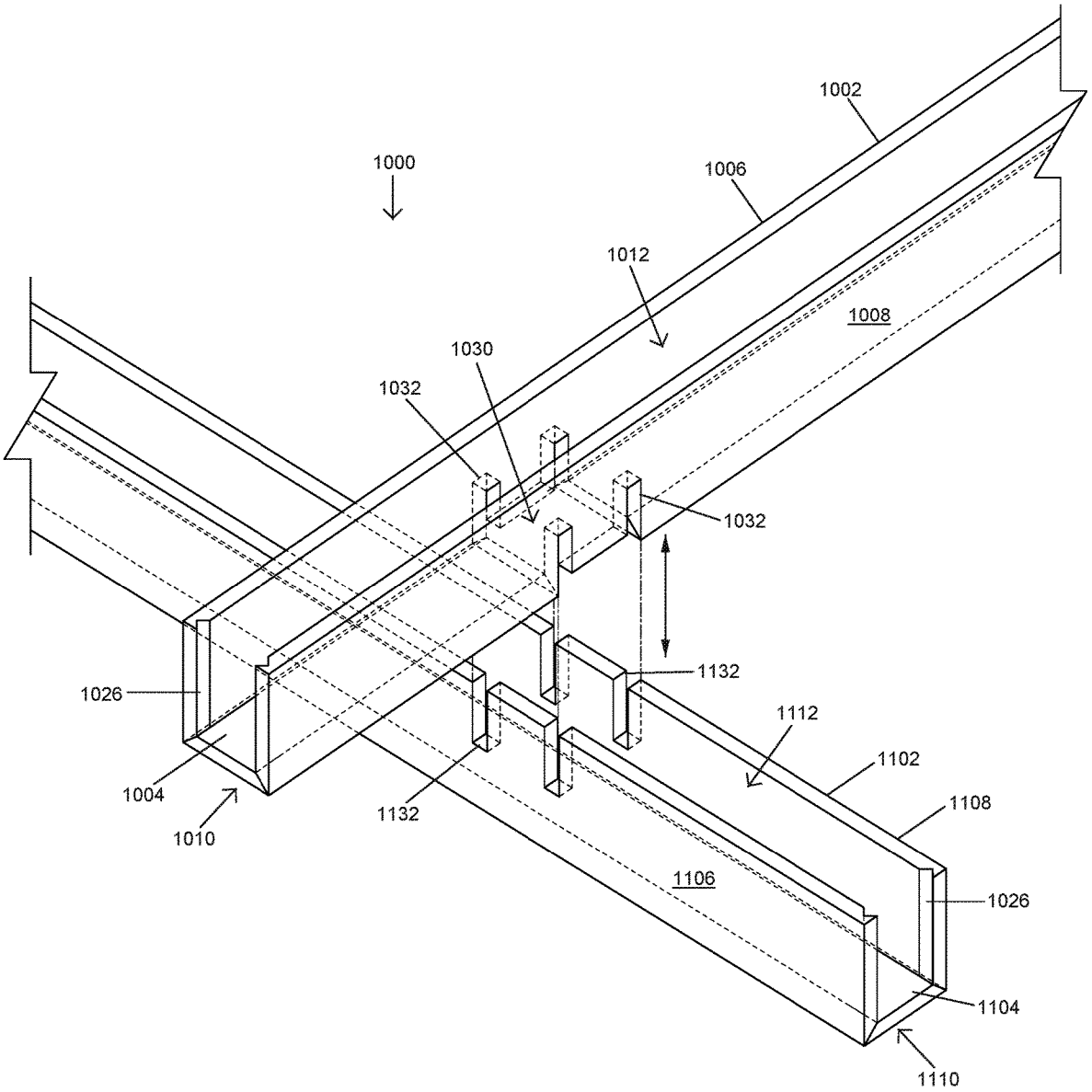
FIG. 48 illustrates a top, front, left perspective view of the beams of FIGS. 46 & 47 aligned for engagement, with a double-ended arrow indicating directions of movement for the beams to engage/disengage.
Figure 49:
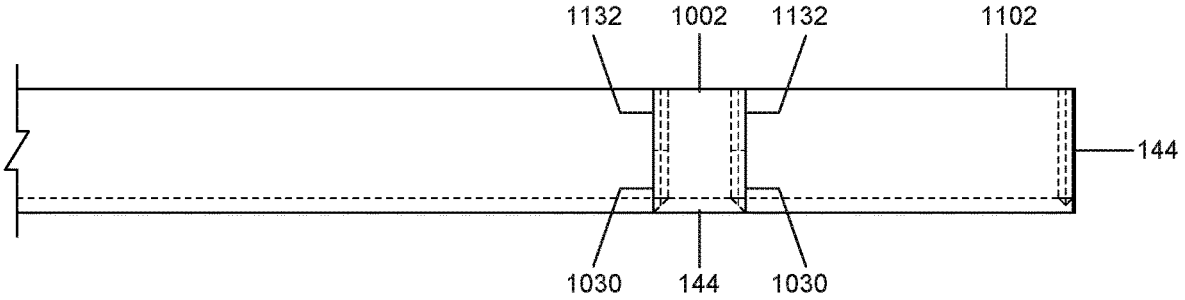
FIG. 49 illustrates a front side view of the beams of FIGS. 46-48 in engagement.
Figure 50:
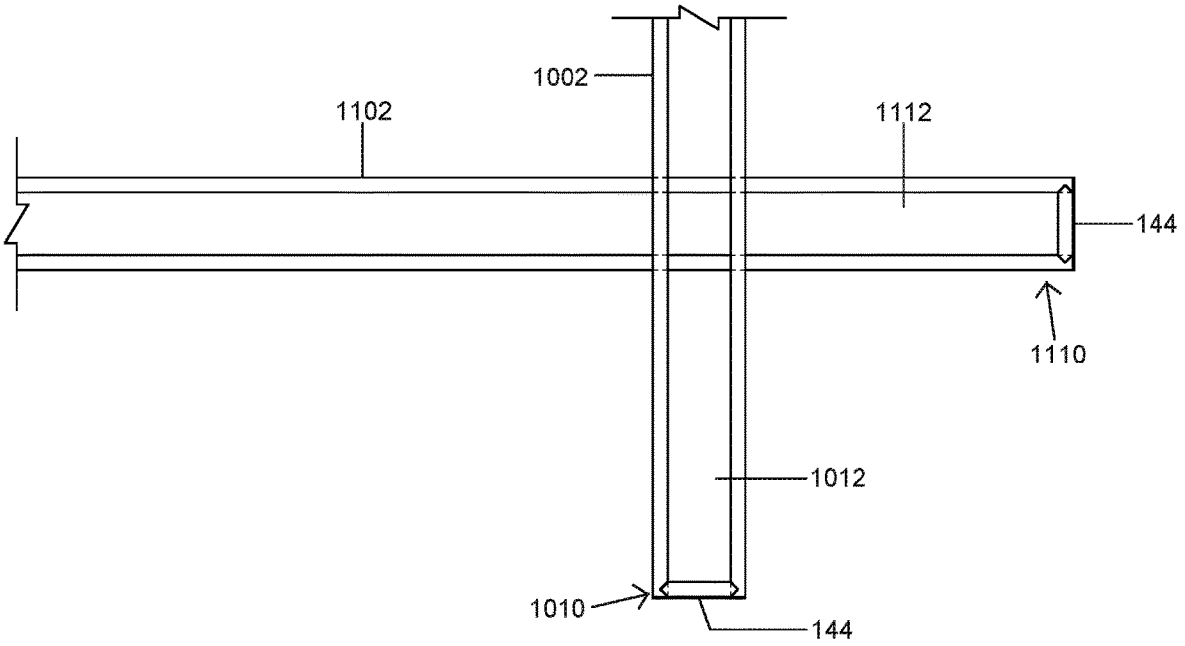
FIG. 50 illustrates a top plan view of the beams of FIGS. 46-48 in engagement.

FIGS. 44-45 illustrate an alternative embodiment where the beams 910, 932 meet at greater than ninety (90) degrees. In the foregoing alternative, first alignment notches 926 are located on interior surfaces of the first and second side 936, 938 of the beam 932, and interior surfaces of the first and second sides 906, 908 of the beam 902. The alignment notches 926 on the interior surface of the first side 906 and the interior surface of the second side 938 may be slightly modified to allow more engagement of the connector 944 with the sides 906, 938. In this embodiment, the connector 944 is similar to the connector 644.

Alternatively, the connector 944 may be formed by two (2) connection keys (not shown) joined together, where the front side of each connection key is fixedly attached to the front side of the other connection key. The connection keys are generally aligned with, and attached to, each other (e.g., the center and mid-points (i.e., of the height and width) of each connection key are generally aligned with the center and mid-points (i.e., the height and width) of the other connection key). Each connection key includes a pair of angled sides such that when the front sides of the connection keys are fixedly attached to each other, the combined sides of the connection keys (i.e., the sides of the connector 944) form a generally V-shaped alignment notch. In another alternative, the connector 944 includes three (3) plates 146, and two (2) connection keys (each connection key includes a pair of angled sides (only two (2) of the plates 146 have a connection key)) with the connector 944 disposed between the first and second beams 902, 932. The three (3) plates 146 are configured in the form of a triangle (e.g., an equilateral triangle, an isosceles triangle, a scalene triangle) when viewed from above, with each plate 146 forming a side of the triangle. Each connection key of the two (2) plates 146 having connector 944 is configured to engage a particular one of the first and second beams 902, 932 to form an angled beam configuration. The plate 146 that does not have a connection key acts as an "end cap," as described above. A plate may be attached to a bottom side of this alternative embodiment of the connector 944 for aesthetic purposes and/or to provide additional structural support to the connector 944.

Figure 98:
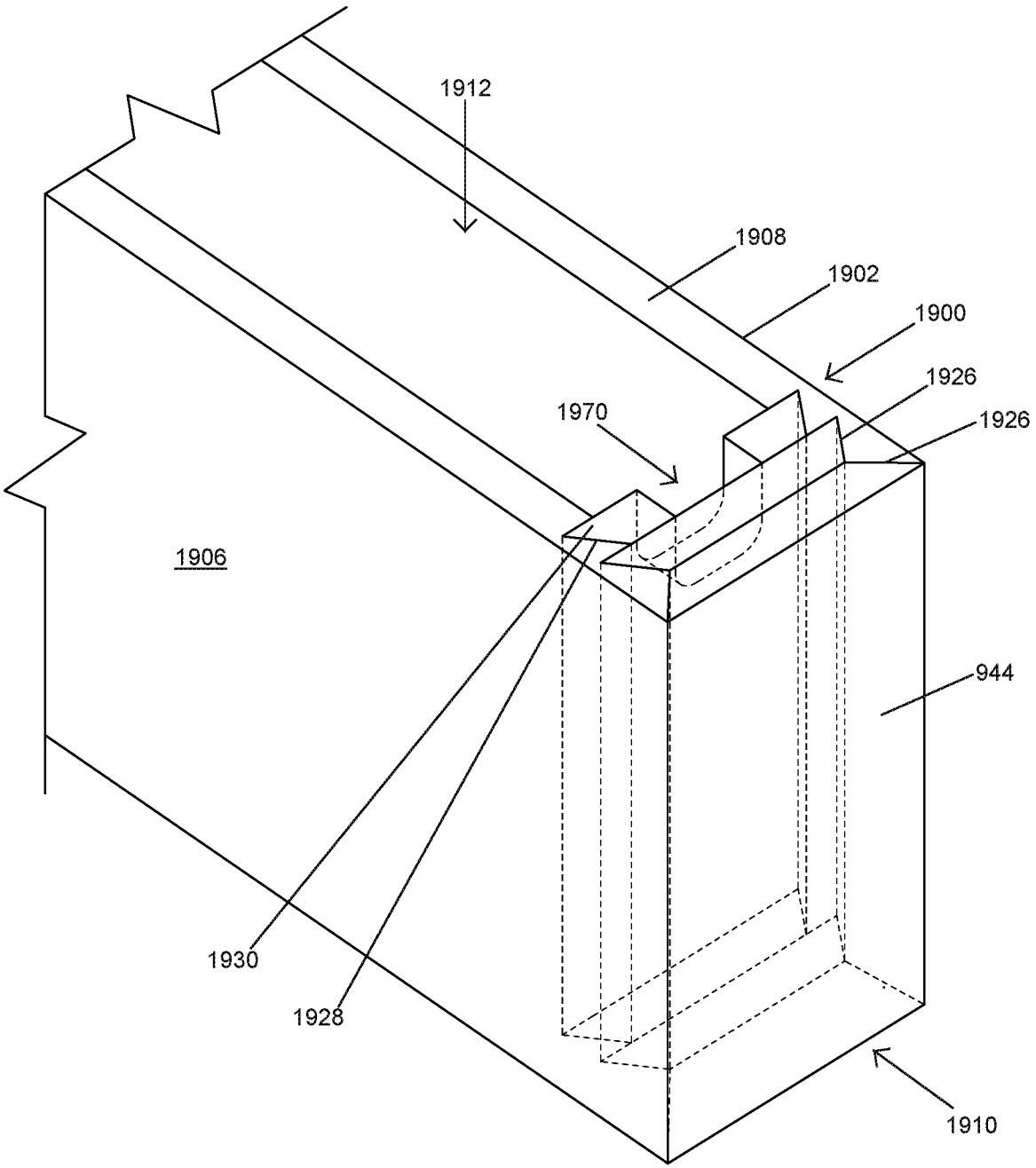
FIG. 98 illustrates a top, front, left perspective view of a beam of an architectural fixture embodying the invention, with a beam, and an outwardly facing side of a connector flush with an end of the beam.
Figure 99:
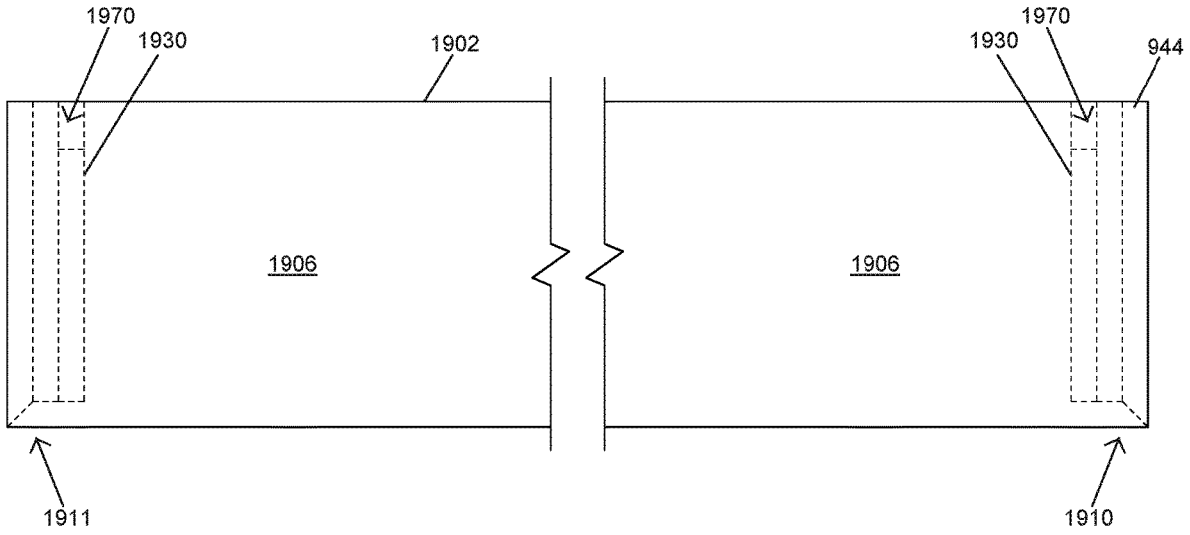
FIG. 99 illustrates a right side elevation view of the beam of FIG. 98 showing both ends of the beam.
Figure 100:
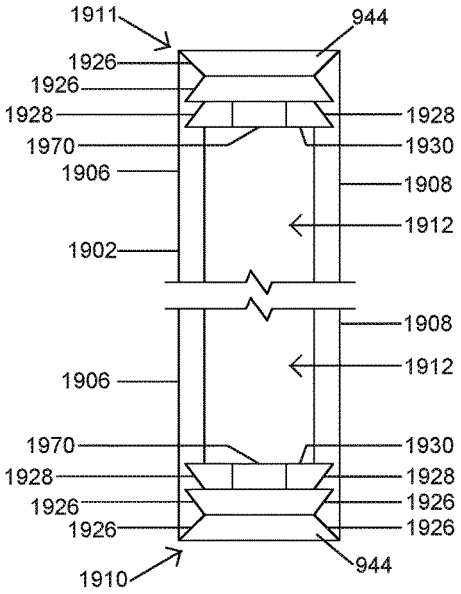
FIG. 100 illustrates a top plan view of the beam of FIG. 99.

In accordance with a further embodiment of the invention, an architectural fixture assembly 1900 is illustrated in FIGS. 98-100. The assembly 1900 has many similar, if not identical, features as described above in reference to the assemblies 100, 200, 300, 400, 500, 600, 700, 800, 900, except that the assembly 1900 describes an embodiment where an "end cap" is mitered to be seated or recessed within the boundaries of the beam itself rather than a portion extending outside of the boundaries of the beam itself. The assembly 1900 includes a generally U-shaped beam 1902 including a bottom side, a first side 1906, a second side 1908, a first end 1910, and a second end 1911, wherein interior surfaces of the first 1906, second 1908, and bottom sides of the beam 1902 define an interior portion 1912. The beam 1902 is substantially similar to the beam 102 in design and construction, except as otherwise noted. Except for purposes of clarity, reference numbers used to describe features in the assemblies 100, 200, 300, 400, 500, 600, 700, 800, 900 will be used to describe identical/similar features in the assembly 1900.

The beam 102, similar to the beam 102, may be made from a generally flat, elongated sheet 114 with a top side 116, a bottom side 118, a first end 120, and a second end 121. The sheet 114 has a thickness and a longitudinal axis running along a center of the sheet 114 between the first end 120 and the second end 121. A pair of fold lines 122 extend between the first end 120 and the second end 121. The fold lines 122 are disposed on the top side 116 of the sheet 114, on opposite sides of, and parallel with, the longitudinal axis. Each fold line 122 includes a generally V-shaped cut 124 on the top side 116 of the sheet 114 so that the sheet 114 may cleanly fold without substantially compressing or deforming the material of the sheet 114 that is otherwise present along the fold lines 122. The fold lines 122 define the bottom portion or side 104, first side 106, and second side 108 of the beam 102. The generally V-shaped cuts 124 may be configured to permit the exposed edges to abut in a flush manner when the first and second sides 106, 108 are folded at a desired angle. The general U-shape of the beam 102 is formed by the first side 106 being folded upwards about the fold line 122 until the sides of the generally V-shaped cut 124 engage, and the second side 108 being folded upwards about the fold line 122 until the sides of the generally V-shaped cut 124 engage. The first end 1906 of the beam 1902 and the first end 120 of the sheet 114 are the same end. The sheet 114 is folded from a flat configuration to the generally U-shaped configuration of the beam 1902.

The sheet 114 includes first and second connector alignment notches 1926 and spacer alignment notch 1928, generally adjacent to the first end 120 of the sheet 114 (the first and second connector alignment notches 1926 being closer to the first end 120 of the sheet 114 than the spacer alignment notch 1928), on the top side 116 of the sheet, on the portions of the sheet 114 defining the first and second sides 1906, 1908. Each alignment notch 1926, 1928 is in the shape of a generally V-shaped mitre cut (similar, if not identical to the alignment notch 926 seen in FIGS. 42-43). The first connector alignment notch 1926 (that is, the connector alignment notch 1926 closest to the very end of the beam 1902) is cut into the beam 1902 such that the cut extends to the very end of the sides 1906, 1908 of the beam 1902 at the first and second ends 1910, 1911. Alternatively, the alignment notches 1926, 1928 may have various other shapes including, without limitation, a v-cut (such as seen in regards to alignment notches 126, 128), dovetail, and other types of joints found in woodworking including, without limitation, a tongue and groove joint, a dado joint, a finger joint, a mitre joint, a puzzle piece joint, and a half blind lap joint. When the sheet 114 is folded into the generally U-shaped beam 1902, the interior surfaces of the first and second sides 1906, 1908 each include the first and second connector alignment notches 1926 disposed generally adjacent to the first end 1910 of the beam 1902, with the spacer alignment notch 1928 disposed generally adjacent to the first and second alignment notches 1926. Likewise, first and second alignment notches 1926, and spacer alignment notch 1928 are disposed generally adjacent to the second end 121 of the sheet 114. In this manner, the second end 121 of the sheet 114 may have the same/similar features as the first end 120 (e.g., first and second alignment notches 126, 128, etc.).

The assembly 1900 further includes a connector 944 (described above) slidably engaging the first and second alignment notches 1926 of the beam 1902. The connector 944 may be held in engagement with the first and second connector alignment notches 1926 by friction fit or, alternatively, an adhesive (placed on the first and second sides 946, 948 of the connector 944 and/or the first and second connector alignment notches 1926) may be used to hold the connector 944 in engagement with the beam 1902, and to hold the beam 1902 in the general U-shape. Alternatively, a plate installed above the connector 944 may be used to hold the connector 944 in engagement with the beam 1902. When the connector 944 fully engages the beam 1902, the front (outwardly facing) side of the connector 944 can serve as an "end cap" of the beam 1902, with the front side of the connector 944 being flush with the first end 1920 of the beam 1902. In the alternative, the first and second connector alignment notches 1926 can have the same shape as alignment notch 126, and the connector 644 may be used in place of the connector 944, with the front side of the connector 644 serving as an "end cap" of the beam 1902, with the front (outwardly facing) side of the connector 644 being flush with the first end 1920 of the beam 1902.

The assembly 1900 further includes a generally rectangular spacer 1930. The spacer 1930 may be made from the same material as the sheet 114/beam 1902. The spacer 1930 has a top side, a bottom side, a front side, a back side, a first side, and a second side on an opposite side of the spacer from the first side. The first and second sides are each generally V-shaped (to match the V-shaped mitre cut of the spacer alignment notch 1930). Alternatively, the first and second sides of the spacer 1930 may have various other shapes including, without limitation, a v-cut (such as seen in the spacer 130), a dovetail, and other types of joints found in woodworking including, without limitation, a tongue and groove joint, a dado joint, a finger joint, a mitre joint, a puzzle piece joint, and a half blind lap joint. The first and second sides of the spacer 1930 are sized, shaped, and configured to engage the generally V-shaped mitre cut spacer alignment notches 1928 of the first and second sides 1906, 1908 of the beam 1902. The first and second sides of the spacer 1930 may be slid into engagement with the generally V-shaped mitre cut alignment notches 1928 of the first and second sides 1906, 1908. An adhesive (placed on the first and second sides of the spacer 1930 and/or the generally V-shaped alignment notches 1928) may be used to hold the spacer 1930 in engagement with the beam 1902. Alternatively, a plate installed above the spacer 130 may be used to hold the spacer 130 in engagement with the beam 102. The spacer 1930 may be used to hold the beam 1902 in the general U-shape. Alternatively, or in combination with the spacer 1930, the abutting edges/sides of the generally V-shaped cut 124 may, for example, be locked into place using various means including, without limitation, brackets, fasteners and/or adhesives (e.g., an epoxy or the like); either alone or in various combinations with one or more of the others. A generally U-shaped recess 1970 may be formed in the spacer 1930 from the top side towards the bottom side. The generally U-shaped recess 1970 provides enough space for the user to maneuver their fingers in to install or remove the connector 944. The recess 1970 also allows various things (e.g., wiring, piping, ducts/ducting, etc.) to be routed towards the first end 1910 of the beam 1902. A flange 172 (e.g., a generally L-shaped flange) may be attached to the back side of the spacer 1930 by various fasteners including, without limitation, mechanical fasteners 178, chemical fasteners (e.g., adhesives), or the like.

The beam 1902/sheet 114 may be made using a sheet of one or more sound-absorbing/barrier (acoustical) materials including, but not limited to, fabric-covered synthetic polymer foam, fabric-covered glass wool composite material, or the like. Alternatively, the beam 1902/sheet 114 may be made from other sound-absorbing materials including, but not limited to, synthetic foam or nonwoven polymer (without fabric), or synthetic foam or nonwoven polymer covered by a perforated metallic sheet, wood, wool or the like. In the alternative, the beam 1902/sheet 114 may also be formed from a metallic sheet, a polymeric sheet, or the like. Metallic sheets, for example, may be pressed or bent into the required folded generally U-shape by various methods known in the art. Polymeric sheet stock, for example, may be pressed/bent under heating to obtain the required shape. Polymeric sheets having the required folded general U-shape, for example, may also be molded such as by injection molding directly into the required general U-shape.

As shown in FIGS. 46-50 for purposes of illustration, an embodiment of the present invention resides in an architectural fixture assembly 1000 where at least two beams 1002, 1102 are connected at a right angle to each other. Except for purposes of clarity, reference numbers used to describe features in the assemblies 100, 200, 300, 400, 500, 600, 700, 800, 900 will be used to describe identical/similar features in the assembly 1000. The architectural fixture assembly 1000 includes a generally U-shaped first beam 1002 having a bottom portion or side 1004, a first side 1006, a second side 1008, a first end 1010, and a second end 1011. Interior surfaces of the first, second, and bottom sides 1006, 1008, 1004 of the beam 1002 define an interior portion 1012.

The beam 1002 may be made from a generally flat, elongated sheet 1014 with a top side 1016, a bottom side (not shown except as the exterior surfaces of the bottom, first, and second sides 1004, 1006, 1008 of the folded beam 1002), a first end 1020, and a second end (not shown except as the second end 1011 of the beam 1002). The sheet 1014 has a thickness and a longitudinal axis running along a center of the sheet 1014 between the first end 1020 and the second end. A pair of fold lines 1022 extend between the first end 1020 and the second end 1021. The fold lines 1022 are disposed on the top side 1016 of the sheet 1014, on opposite sides of, and parallel with, the longitudinal axis. Each fold line 1022 includes a generally V-shaped cut 1024 on the top side 1016 of the sheet 1014 so that the sheet 1014 may cleanly fold without substantially compressing or deforming the material of the sheet 1014 that is otherwise present along the fold lines 1022. The fold lines 1022 define the bottom portion or side 1004, first side 1006, and second side 1008 of the beam 1002. The generally V-shaped cuts 1024 may be configured to permit the exposed edges to abut in a flush manner when the first and second sides 1006, 1008 are folded at a desired angle. The general U-shape of the beam 1002 is formed by the first side 1006 being folded upwards until the sides of the generally V-shaped cut 1024 engage, and the second side 1008 being folded upwards until the sides of the generally V-shaped cut 1024 engage. The first end 1010 of the beam 1002 and the first end 1020 of the sheet 1014 are the same end. The sheet 1014 is folded from a flat configuration to the generally U-shaped configuration of the beam 1002.

The sheet 1014 includes a first alignment notch 1026 generally adjacent to the first end 1020 of the sheet 1014, on the top side 1016 of the sheet 1014, on the portions of the sheet 1014 defining the first and second sides 1006, 1008. The first alignment notch 1026 is in the shape of a generally V-shaped cut. Alternatively, the alignment notch 1026 may have various other shapes including, without limitation, a dovetail, and other types of joints found in woodworking including, without limitation, a tongue and groove joint, a dado joint, a finger joint, a mitre joint, a puzzle piece joint, and a half blind lap joint. When the sheet 1014 is folded into the generally U-shaped beam 1002, the interior surfaces of the first and second sides 1006, 1008 each include a generally V-shaped first alignment notch 1026 disposed generally adjacent to the first end 1010 of the beam 1002. Another pair of alignment notches 1026, each alignment notch also in the form of a generally V-shaped cut, are disposed adjacent to the second end of the sheet 1014, on the top side 1016 of the sheet 1014, on the portions of the sheet 1014 defining the first and second sides 1006, 1008. In this manner, the second end of the sheet 1014 may have the same/similar features as the first end 1020 (e.g., first alignment notches 1026, etc.). In an alternative embodiment, in order to provide additional structural support to the first beam 1002, the first beam 1002 may also include a plurality of pairs of second alignment notches 128, and associated spacers 130 along the length of the beam 1002, in general, and near the first and second ends 1010, 1011 of the first beam 1002, in particular.

The bottom side 1004 includes an aperture 1030 disposed inwards along the beam 1002 from the first end 1010. The portions of the sheet 1014 defining the first and second sides 1006, 1008 each includes a pair of generally rectangular alignment notches 1032, each alignment notch 1032 being open on one end to the aperture 1030. The beam 1002 may include a plurality of apertures 1030 spaced apart along the length of the beam 1002 between the first and second ends 1020, 1021. Each aperture 1030 of the plurality of apertures 1030 is associated with two (2) pairs of alignment notches 1032, with each pair of alignment notches 1032 associated with a particular aperture 1030 being disposed on opposite sides of that particular aperture 1030 on one of the first and second sides 1006, 1008. Each pair of alignment notches 1032 on the first side 1006 of the first beam 1002 is aligned with a pair of alignment notches 1032 on the second side 1008 of the first beam 1002. The alignment notches 1032 generally extend from a bottom edge of each side 1006, 1008 upwards towards a generally middle portion of each side 1006, 1008.

The beam 1002/sheet 1014 may be made using a sheet of one or more sound-absorbing/barrier (acoustical) materials including, but not limited to, fabric-covered synthetic polymer foam, fabric-covered glass wool composite material, or the like. Alternatively, the beam 102/sheet 114 may be made from other sound-absorbing materials including, but not limited to, synthetic foam or nonwoven polymer (without fabric), or synthetic foam or nonwoven polymer covered by a perforated metallic sheet, wood, wool or the like. In the alternative, the beam 1002/sheet 1014 may also be formed from a metallic sheet, a polymeric sheet, or the like. Metallic sheets, for example, may be pressed or bent into the required folded generally U-shape by various methods known in the art. Polymeric sheet stock, for example, may be pressed/bent under heating to obtain the required shape. Polymeric sheets having the required folded generally U-shape, for example, may also be molded such as by injection molding directly into the required generally U-shape.

The assembly 1000 further includes a generally U-shaped second beam 1102 including a bottom side 1104, a first side 1106, a second side 1108, a first end 1110, and a second end 1111, wherein interior surfaces of the first, second, and bottom sides 1106, 1108, 1104 of the second beam 1102 define an interior portion 1112. The beam 1102 may be made from a generally flat, elongated sheet 1114 (similar to elongated sheet 1014) with a top side 1116, a bottom side (not shown except as the exterior surfaces of the bottom, first, and second sides 1104, 1106, 1108 of the folded beam 1102), a first end 1120, and a second end 1121.

Figure 51:
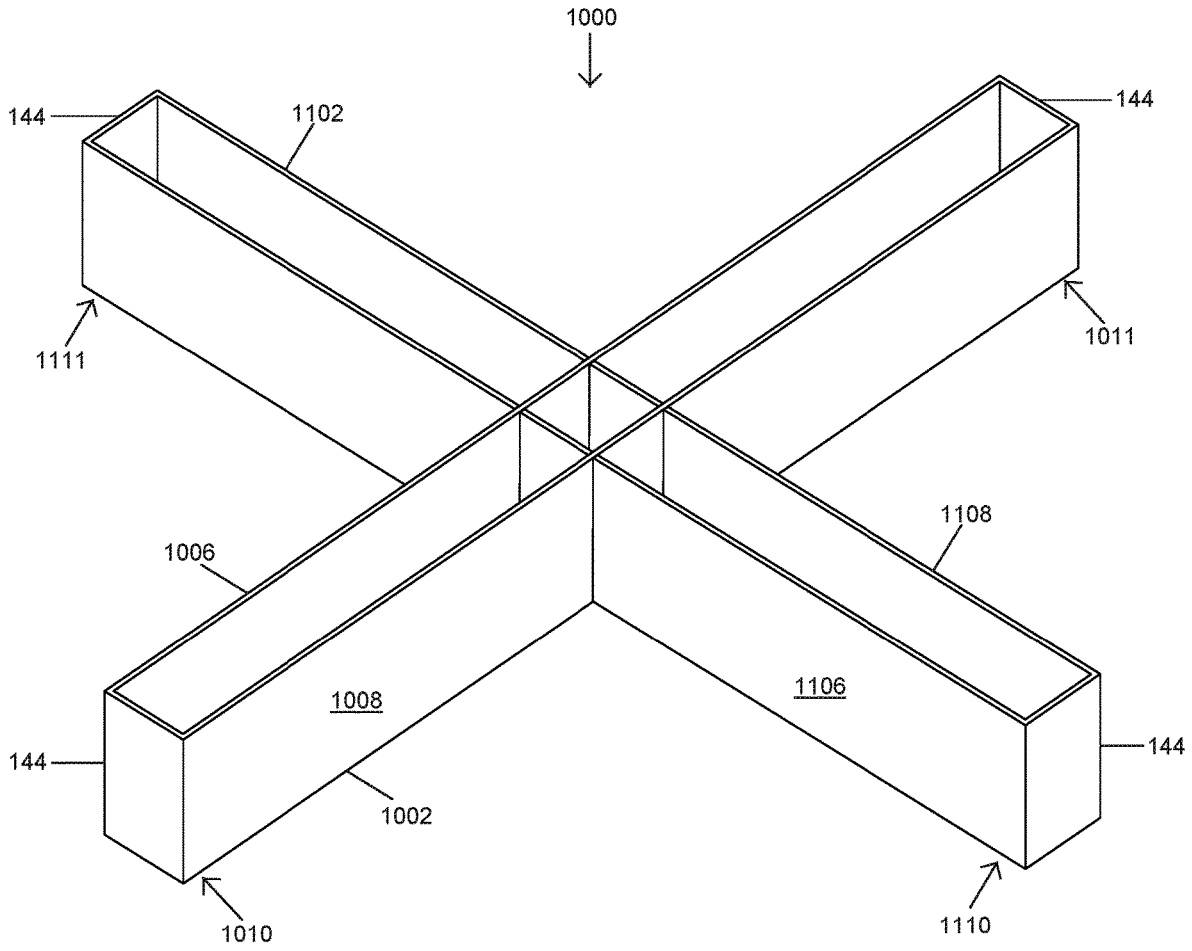
FIG. 51 illustrates a top, front, left perspective view of yet another architectural fixture embodying the invention, with two beams directly in a generally cross-shaped or generally X-shaped configuration.

The second beam 1102 is generally identical to the first beam 1002 in design and construction, except that, for example, the second beam 1102 does not include an aperture equivalent to the aperture 1030 and, in another example, each side 1106, 1108 has at least one pair of alignment notches 1132 generally extending from a top edge of each side 1106, 1108 downwards towards a generally middle portion of each side 1106, 1108. Each pair of alignment notches 1132 on the first side 1106 of the second beam 1102 is aligned with a pair of alignment notches 1132 on the second side 1108 of the second beam 1102. The beam 1102 may be made from a generally flat, elongated sheet that is constructed in a manner similar to the elongated sheet 1014 of the first beam 1002. Alignment notches 1032 of the first beam 1002 are configured to engage alignment notches 1132 of the second beam 1102. In this manner, the first and second sides 1006, 1008, 1106, 1108 of each beam 1002, 1102 each include at least one pair of notches 1032, 1132. The pairs of notches 1132 of the second beam 1102 generally extends downward from a top side of the second beam 1102 towards the bottom side 1104 of the second beam 1102, and the pairs of notches 1032 of the first beam 1002 generally extends upward from the bottom side 1004 of the first beam 1002 towards a top side of the first beam 1002. The alignment notches 1032, 1132 of the first and second beams 1002, 1102 engage each other such that a first notch 1032 of the pair of notches 1032 of the first side 1006 of the first beam 1002 engage a second notch 1132 of the pair of notches 1132 of the first side 1106 of the second beam 1102 and a second notch 1032 of the pair of notches 1032 of the first side 1006 of the first beam 1002 engage a second notch 1132 of the pair of notches 1132 of the second side 1108 of the second beam 1102; and wherein a first notch 1032 of the pair of notches 1032 of the second side 1008 of the first beam 1002 engage a first notch 1132 of the pair of notches 1132 of the first side 1106 of the second beam 1102 and a second notch 1032 of the pair of notches 1032 of the second side 1008 of the first beam 1002 engages a first notch 1132 of the pair of notches 1132 of the second side 1108 of the second beam 1102. As seen in FIG. 51, in one particular embodiment of the assembly 1000, there are only two (2) beams 1002, 1102, and each of the first and second sides 1006, 1008, 1106, 1108 of each beam 1002, 1102 include only one pair of notches 1032, 1132 (not shown for clarity) to create a generally cross-shaped or generally X-shaped beam configuration.

Figure 52:
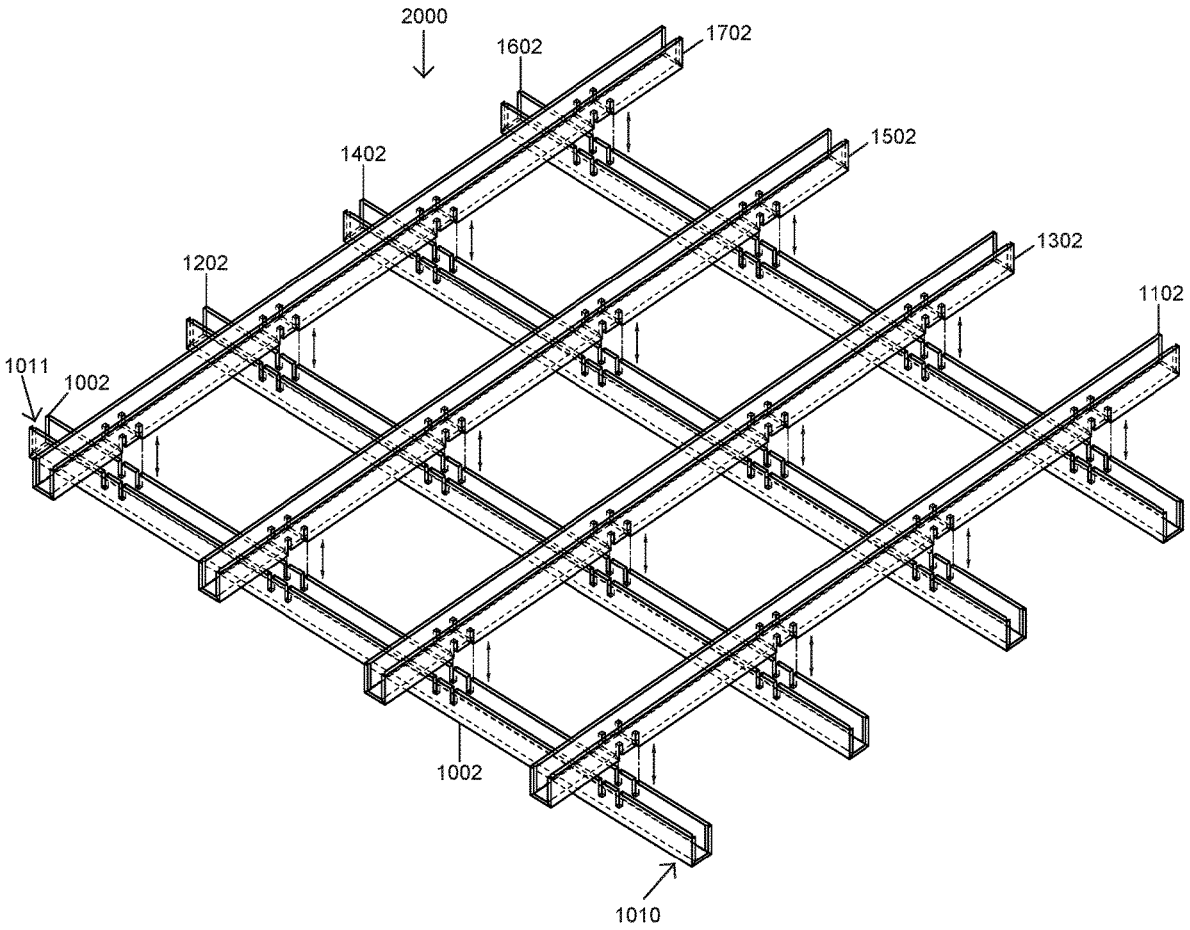
FIG. 52 illustrates a top, front, left perspective view of an architectural fixture embodying the invention, with eight beams forming a generally lattice-shaped configuration (four beams of FIG. 46 and four beams of FIG. 47 are shown aligned for engagement, with double-ended arrows indicating directions of movement for four beams of FIG. 46 to engage with/disengage from the four beams of FIG. 47)

As seen in FIG. 52, a lattice assembly 2000 may be constructed by expanding upon the assembly 1000 to further include at least one additional of beam. In another example, six (6) additional beams, including a third beam 1202, a fourth beam 1302, a fifth beam 1402, a sixth beam 1502, a seventh beam 1602, and an eighth beam 1702, may be added to the assembly 1000 to form the lattice assembly 2000. The third beam 1202, fourth beam 1302, fifth beam 1402, sixth beam 1502, seventh beam 1602, and eighth beam 1702 each include a plurality of alignment notches that are similar to the alignment notches 1032, 1132 of the first and second beams 1002, 1102. The third beam 1202, fifth beam 1402, and seventh beam 1602 are parallel with and similar/identical to the first beam 1002, and (for purposes of illustration only) may be referred to as "longitudinal" beams, while the fourth beam 1302, sixth beam 1502, and eighth beam 1702 are parallel with and similar/identical to the second beam 1102, and (for purposes of illustration only) may be referred to as "lateral" beams. Each of the first and second sides 1006, 1008 of the first beam 1002 (as well as the first and second sides of the third, fifth, and seventh beams 1202, 1402, 1602) include additional pairs of alignment notches 1032. Each of the first and second sides 1106, 1108 of the second beam 1102 (as well as the first and second sides of the fourth, sixth beam, and eighth beams 1302, 1502, 1702) include additional pairs of alignment notches 1132. Particular alignment notches 1032 of each "longitudinal" beam engage particular alignment notches 1132 of each "lateral" beam (each "longitudinal" beam engages all the "lateral" beams), and alignment notches 1132 of each "lateral" beam engage particular alignment notches 1032 of each "longitudinal" beams (each "lateral" beam engages all "longitudinal" beams). The engagement of the alignment notches 1032, 1132 allows the top and bottom surfaces of the engaged beams 1002, 1102, 1202, 1302, 1402, 1502, 1602, 1702 to be generally planar and aligned.

Figure 53:
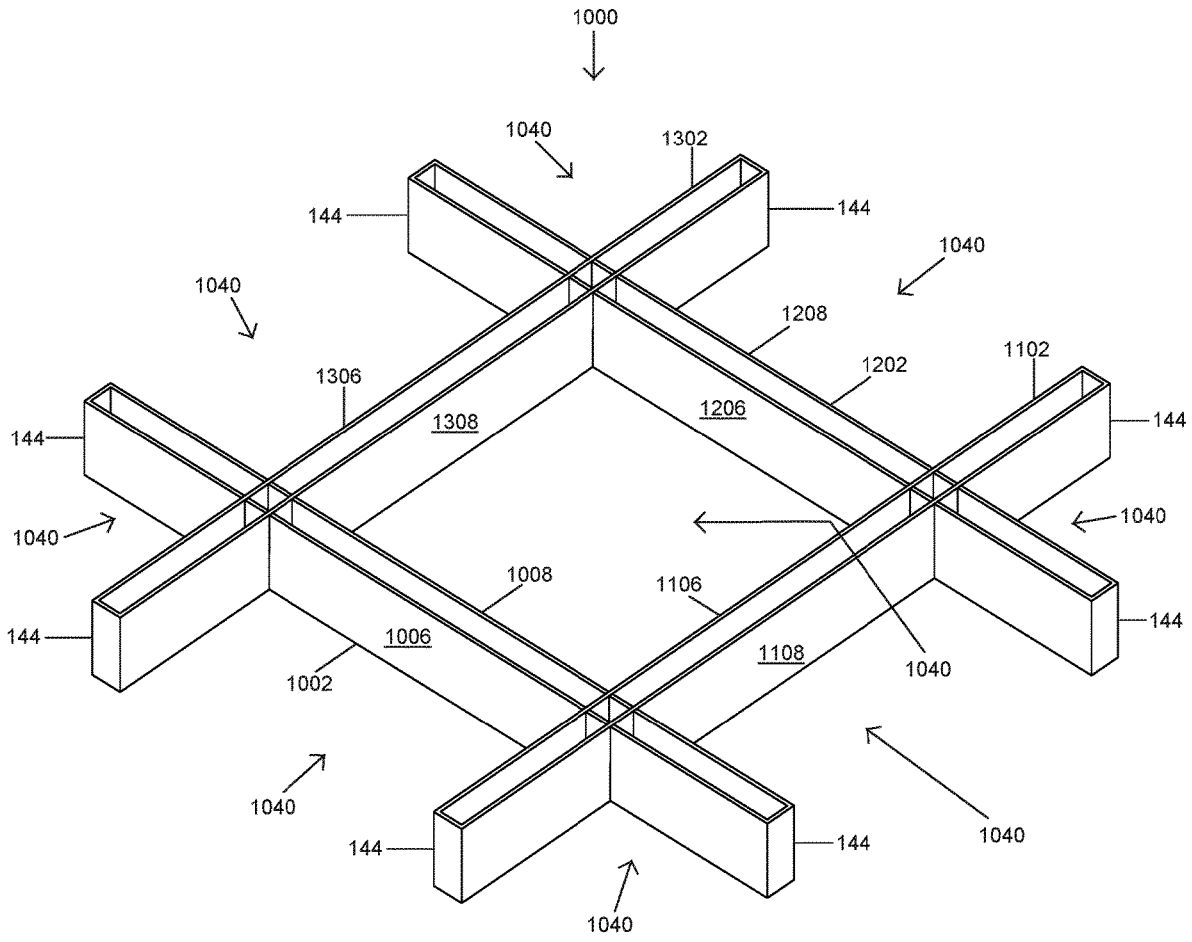
FIG. 53 illustrates a top, front, left perspective view of a further architectural fixture embodying the invention, with four beams of generally equal dimensions forming a generally lattice-shaped configuration.
Figure 54:
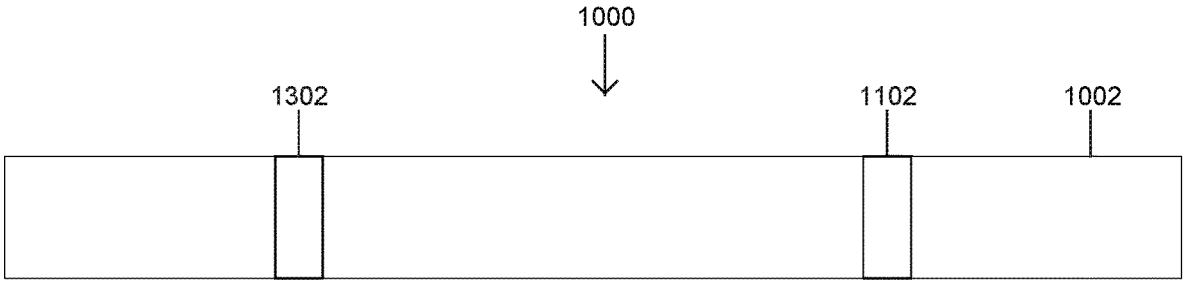
FIG. 54 illustrates a front side view of the architectural fixture of FIG. 53.

As pointed out above, the eight (8) beam configuration of the lattice assembly 2000 described above is merely illustrative, and a lattice assembly may be created using any number/arrangement of longitudinal and lateral beams. For example, as seen in FIGS. 53-54, a four (4) beam lattice assembly could be created that gives the appearance of a tic-tac-toe board, with two (2) longitudinal beams engaging two (2) lateral beams. The third beam 1202 is parallel with and similar/identical to the first beam 1002, and (for purposes of illustration only) those beams 1002, 1202 may be referred to as "longitudinal" beams, while the fourth beam 1302 is parallel with and similar/identical to the second beam 1102, and (for purposes of illustration only) those beams 1102, 1302 may be referred to as "lateral" beams. Each of the first and second sides 1006, 1206, 1008, 1208 of the first and third beam 1002, 1202 (i.e., the "longitudinal" beams) include additional pairs of alignment notches 1032. Each of the first and second sides 1106, 1306, 1108, 1308 of the second and fourth beams 1102, 1302 (i.e., the "lateral" beams) include additional pairs of alignment notches 1132. Particular alignment notches 1032 of each "longitudinal" beam engage particular alignment notches 1132 of each "lateral" beam (each "longitudinal" beam engages all the "lateral" beams), and alignment notches 1132 of each "lateral" beam engage particular alignment notches 1032 of each "longitudinal" beams (each "lateral" beam engages all "longitudinal" beams). The engagement of the alignment notches 1032, 1132 of the beams 1002, 1102, 1202, 1302 allows the top and bottom surfaces of the engaged beams 1002, 1102, 1202, 1302 to be generally planar and aligned. In this manner, an architectural fixture assembly could be created to give the appearance of an in-progress tic-tac-toe game, where a four (4) beam lattice assembly 1000 creates the appearance of a tic-tac-toe board, and other beam assemblies (e.g., in X-shaped and O-shaped beam configurations (a combination of curved and linear beams can be connected to create an O-beam configuration)) can be used to create the appearance of game pieces in the appropriate openings of the lattice.

Figure 90:
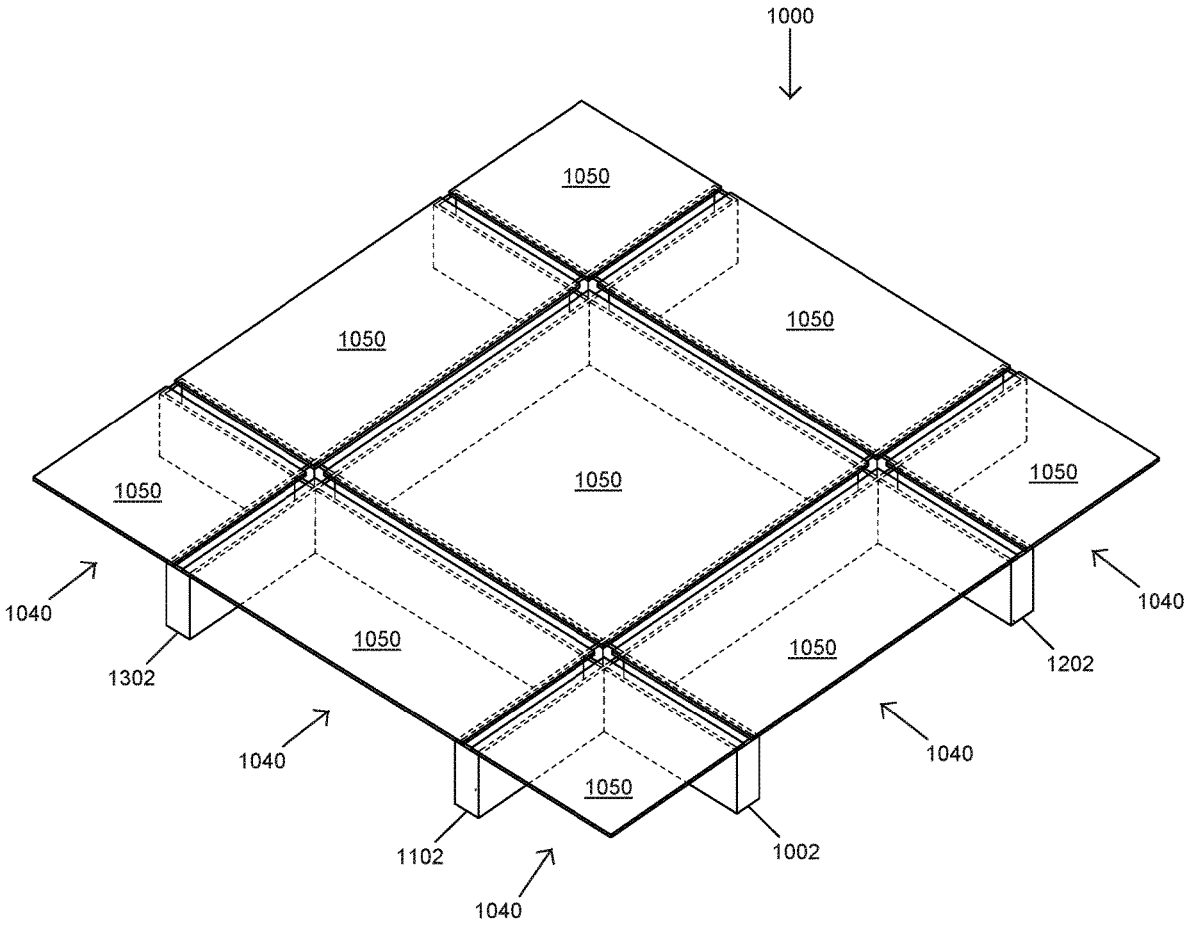
FIG. 90 illustrates a top, front, left perspective view of still another architectural fixture embodying the invention, similar to the assembly illustrated in FIG. 53, but with "infill" or "coffer" panels that span between each bay of the lattice.
Figure 91:
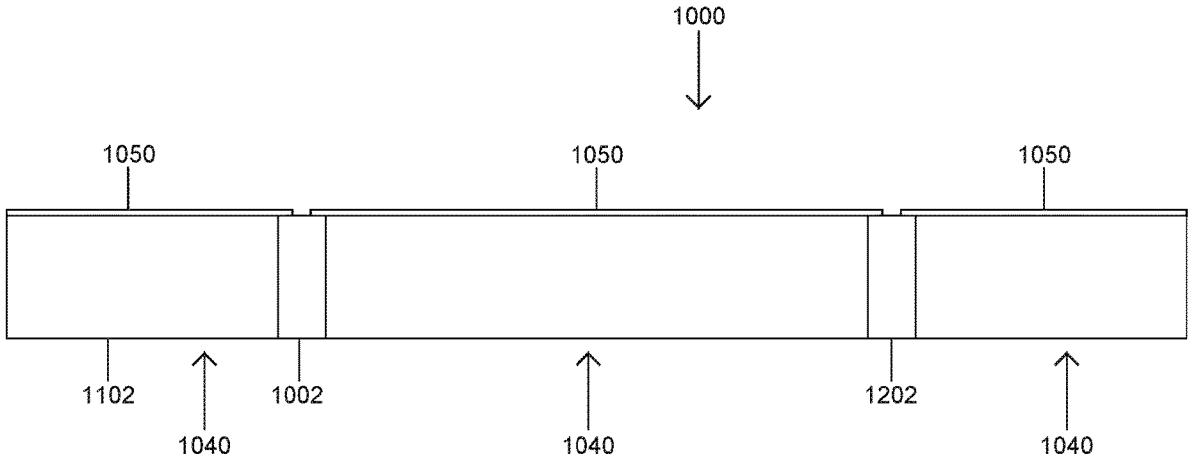
FIG. 91 illustrates a front side elevation view of the architectural fixture of FIG. 90.

As seen in FIGS. 90-91, a lattice assembly, such as the lattice assembly 1000 illustrated in FIG. 53, can include "infill" or "coffer" panels 1050 that span between each bay 1040 of the lattice (a bay 1040 being the open space formed by the beams of the lattice). The coffer 1050 is set on top of the beams 1002, 1102, 1202, 1302 to cover the bays 1040. The coffer 1050 is a generally flat sheet of material. The coffer 1050 may be made from the same material which the beams 1002, 1102, 1202, 1302 are made from. The coffer 1050 may also be made from various other materials including transparent or translucent plastic, metal, or the like.

Figure 55:
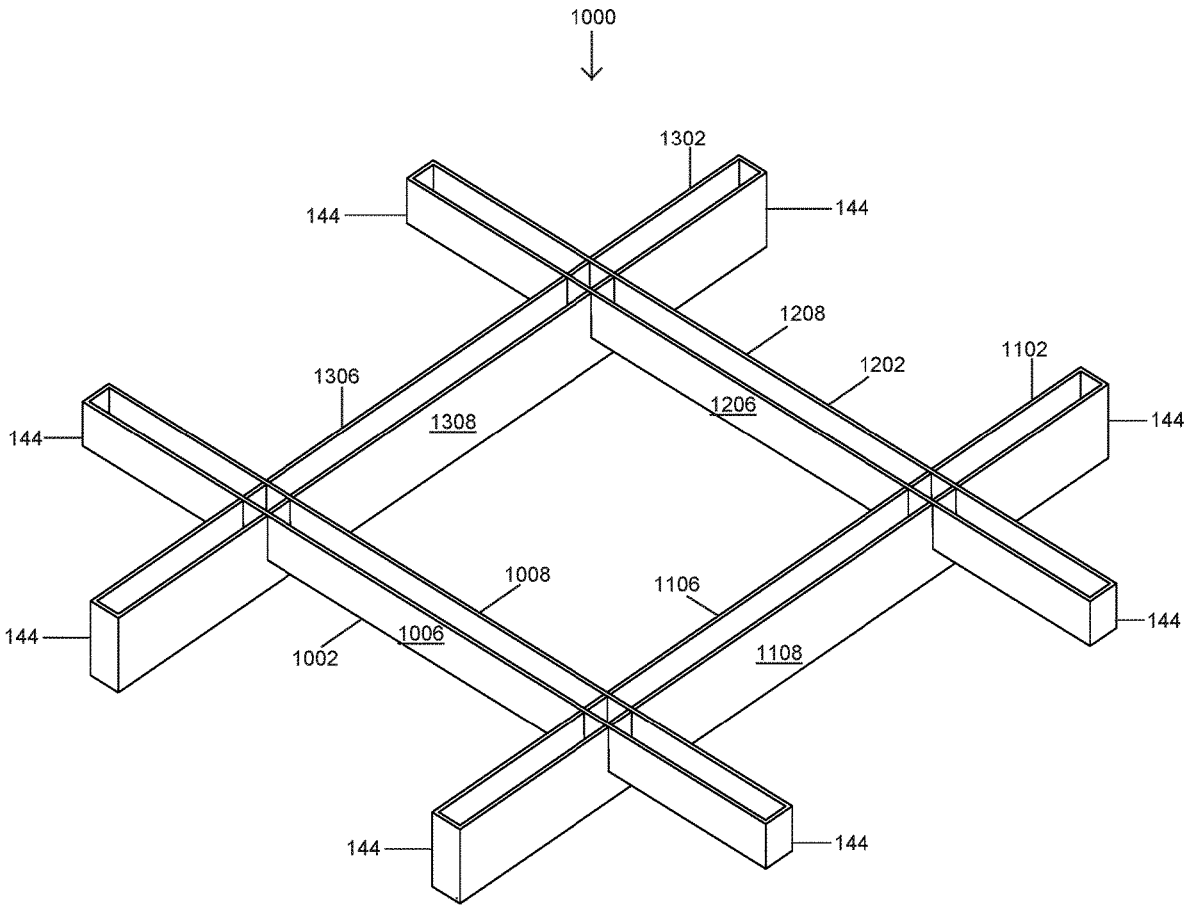
FIG. 55 illustrates a top, front, left perspective view of a further architectural fixture embodying the invention, with a first pair of beams of generally equal dimensions and a second pair of beams of generally equal dimensions forming a generally lattice-shaped configuration.
Figure 56:
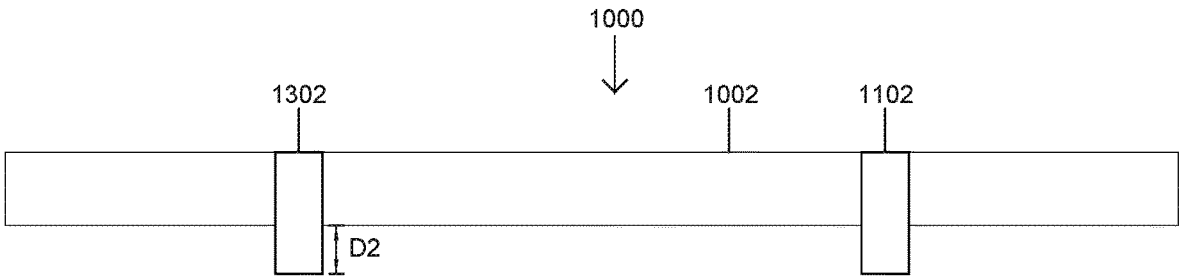
FIG. 56 illustrates a front side elevation view of the architectural fixture of FIG. 55.
Figure 57:
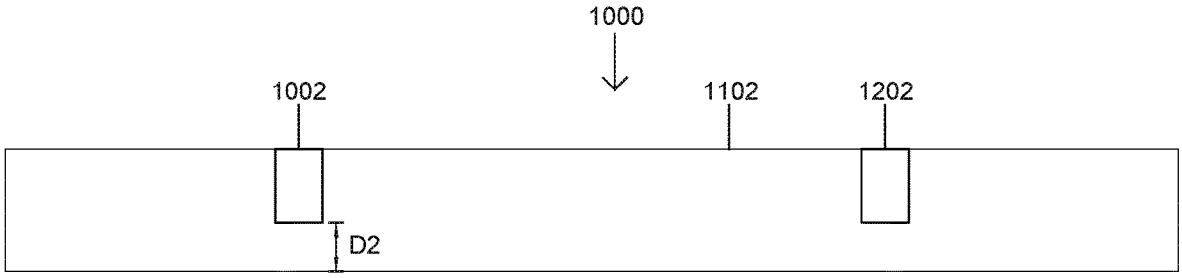
FIG. 57 illustrates a left side elevation view of the architectural fixture of FIG. 55.

As seen in FIGS. 55-57, another example four (4) beam lattice assembly illustrates two (2) longitudinal beams engaging two (2) lateral beams, where the first and second sides 1006, 1206, 1008, 1208 of the first and third beams 1002, 1202 (i.e., the "longitudinal" beams) are smaller in height than the first and second sides 1106, 1306, 1108, 1308 of the second and fourth beams 1102, 1302 (i.e., the "lateral" beams). The alignment notches 1032, 1132 of the beams 1002, 1102, 1202, 1302 are configured such that the engagement of the alignment notches 1032, 1132 allows the top surfaces of the engaged beams 1002, 1102, 1202, 1302 to be generally planar and aligned, the bottom surfaces of the "longitudinal" beams 1002, 1202 to be generally planar and aligned, and the bottom surfaces of the "lateral" beams 1102, 1302 to be generally planar and aligned. However, the alignment notches 1032, 1132 of the beams 1002, 1102, 1202, 1302 are configured such that the engagement of the alignment notches 1032, 1132 results in the bottom surfaces of the "longitudinal" beams 1002, 1202 being generally parallel to the bottom surfaces of the "lateral" beams 1102, 1302 with the bottom surfaces of the "longitudinal" beams 1002, 1202 being separated from the bottom surfaces of the "lateral" beams 1102, 1302 by a distance D2.

Figure 58:
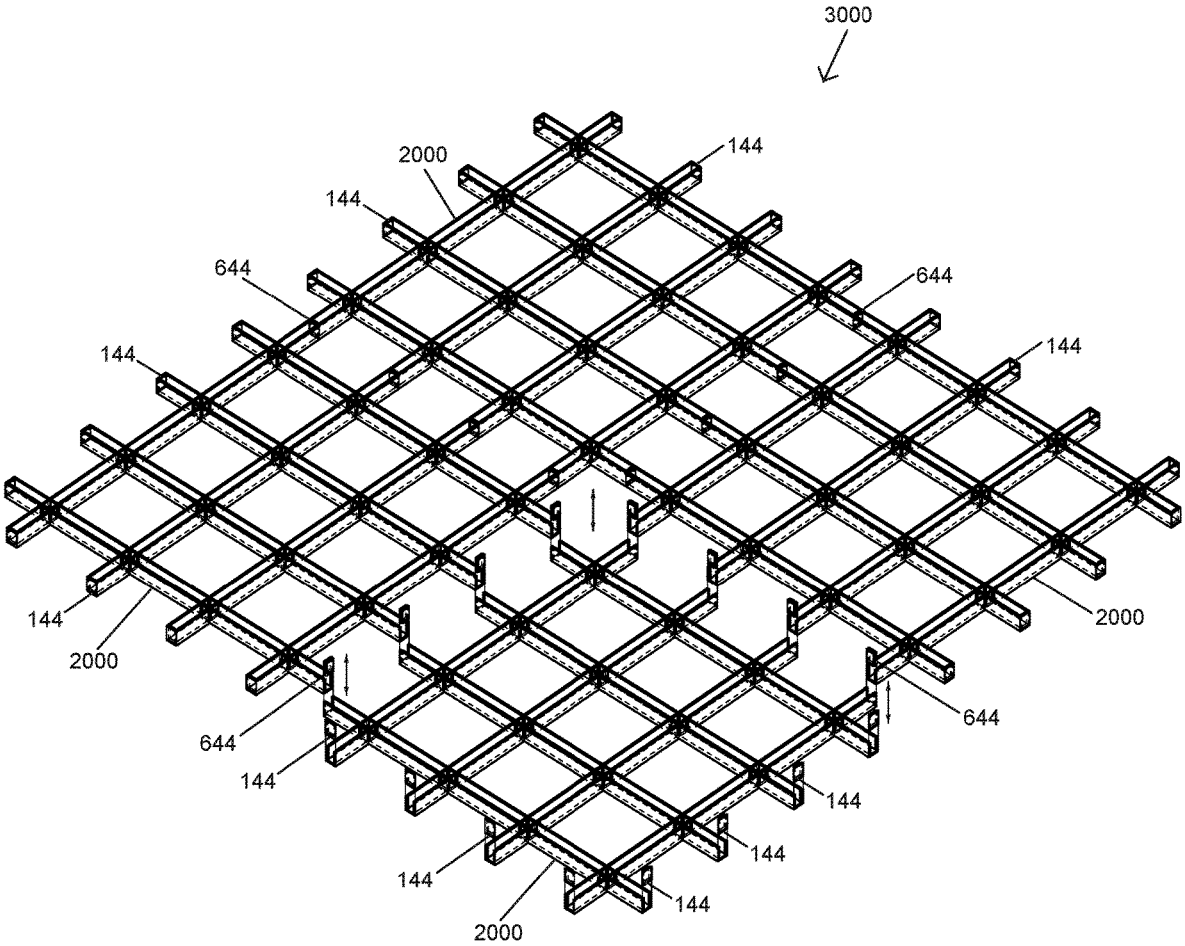
FIG. 58 illustrates a top, front, left perspective view of still another architectural fixture embodying the invention, where four of the architectural fixtures of FIG. 52 are joined into a single super lattice-shaped configuration (three of architectural fixtures of FIG. 52 shown already joined, with the fourth architectural fixture aligned with the other architectural fixtures for engagement therewith), with double-ended arrows indicating directions of movement for the fourth architectural fixture to engage with/disengage from the other architectural fixtures.
Figure 59:
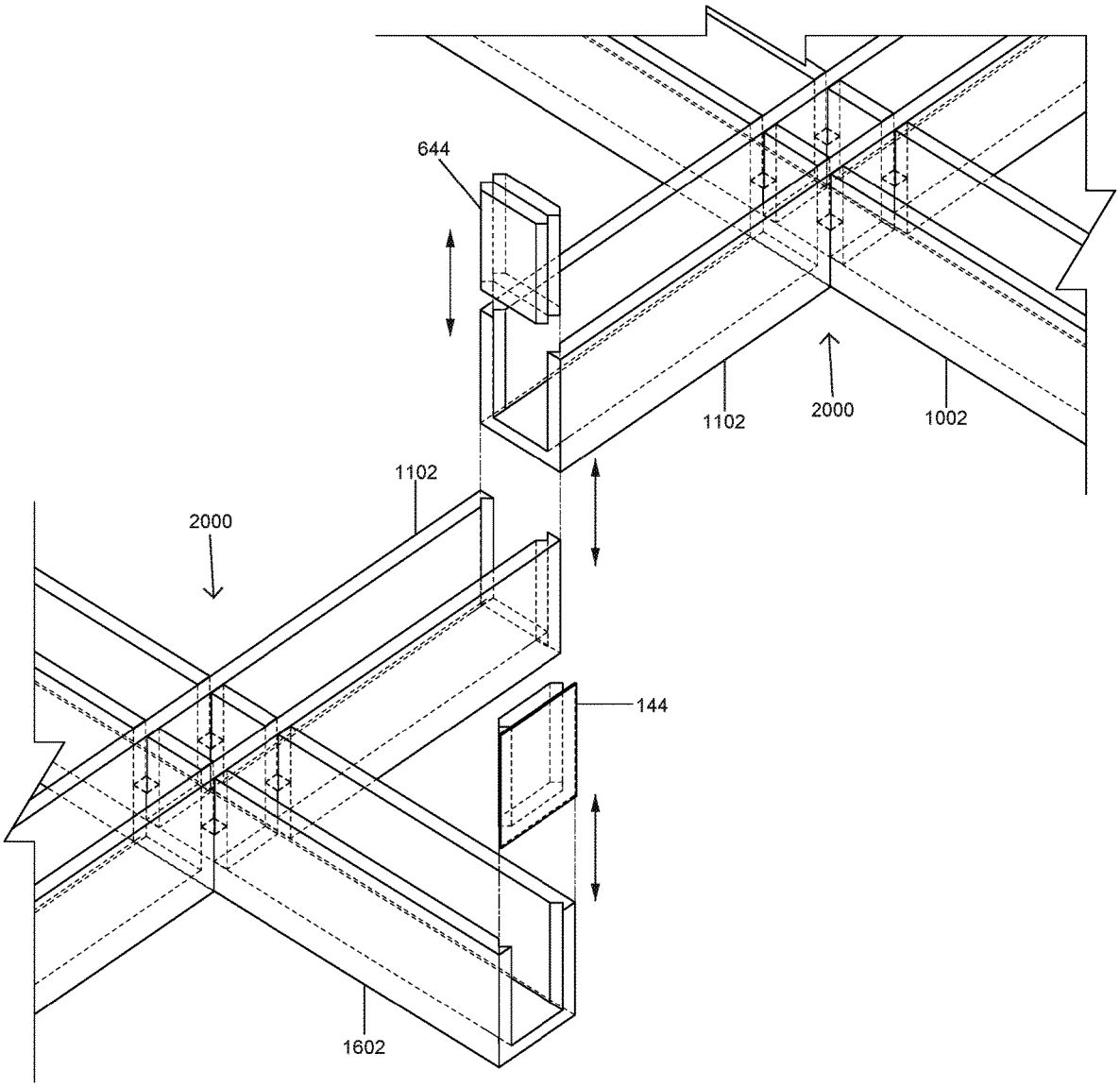
FIG. 59 illustrates a top, front, left perspective enlarged view of the portion of FIG. 58 where a portion of the fourth architectural fixture is aligned for engagement with a portion of the other architectural fixtures, with double-ended arrows indicating directions of movement for the fourth architectural fixture to engage with/disengage from the other (already engaged) architectural fixtures as well as for various connectors to engage individual beams and/or interconnect beams of adjacent architectural fixtures of FIG. 52.

As seen in FIGS. 58-59, four (4) lattice assemblies 2000 are arranged to form a super lattice assembly 3000. However, any number of lattice assemblies 2000 may be joined together to form a super lattice assembly, depending on the desired size/shape of the larger lattice assembly. Connectors 644 may be used to connect the ends of beams of adjacent lattice assemblies 2000, and connectors 144 may be used to create "end caps" on the ends of beams that are not adjacent to other lattice assemblies 2000.

While the embodiments shown in the figures exemplify fixtures in which a lattice module includes four (4) lateral beams engaging four (4) longitudinal beams, and a lattice assembly includes four (4) joined lattice modules, it should be readily understood that the invention also provides corresponding embodiments in which an individual lattice module may include just a single lateral beam engaging just a single longitudinal beam (with any number of those individual lattice modules joined together into a larger lattice assembly of regular or irregular shape), or an individual lattice module including any number of a plurality of lateral beams engaging any number of a plurality of longitudinal beams (with any number of those individual lattice modules joined together into a larger lattice assembly of regular or irregular shape). Likewise, a lattice assembly includes any number of lattice modules arranged various combinations of side-to-side and/or linear arrangements with neighboring lattice modules joined to each other in regular or irregular shapes.

Figure 60:
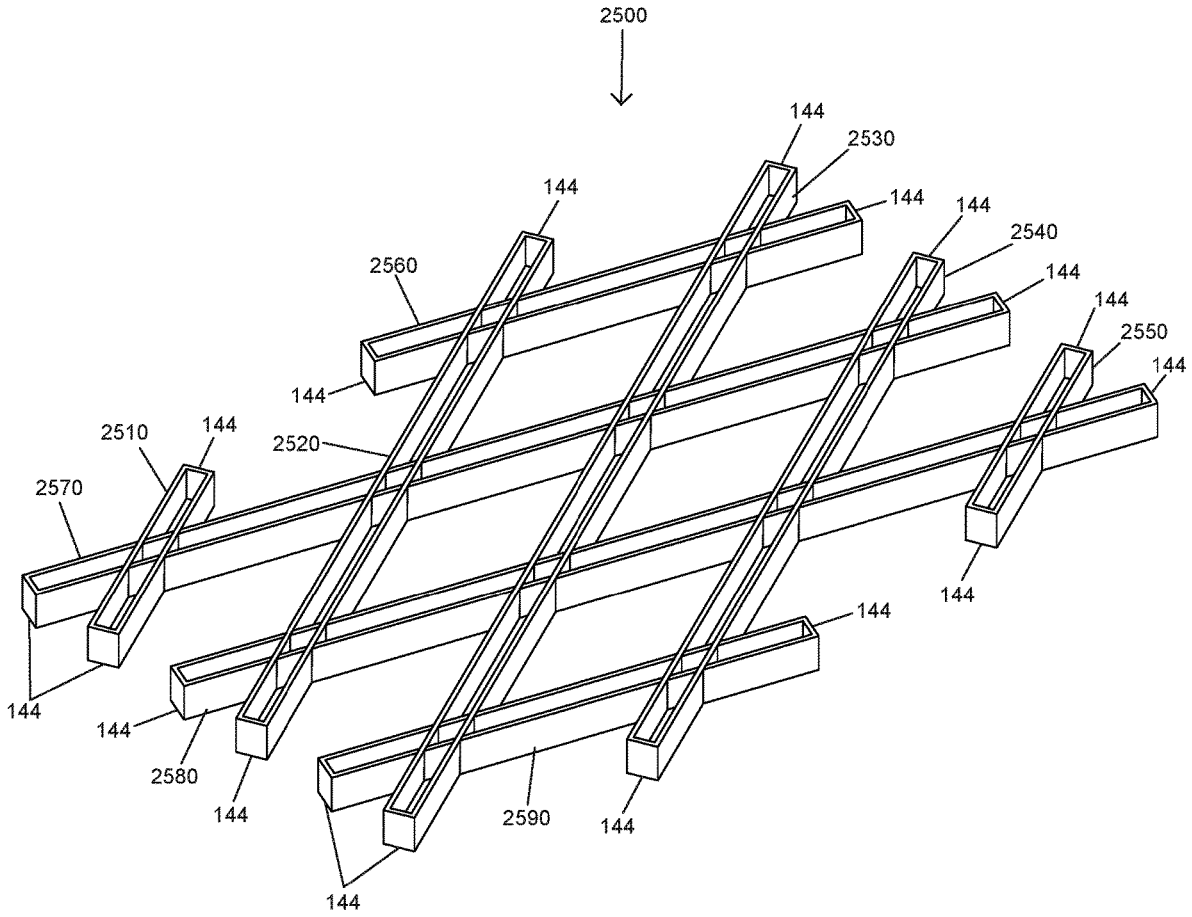
FIG. 60 illustrates a top, front, left perspective view of yet a further architectural fixture embodying the invention, with a number of beams forming a generally diamond-shaped lattice configuration.
Figure 61:
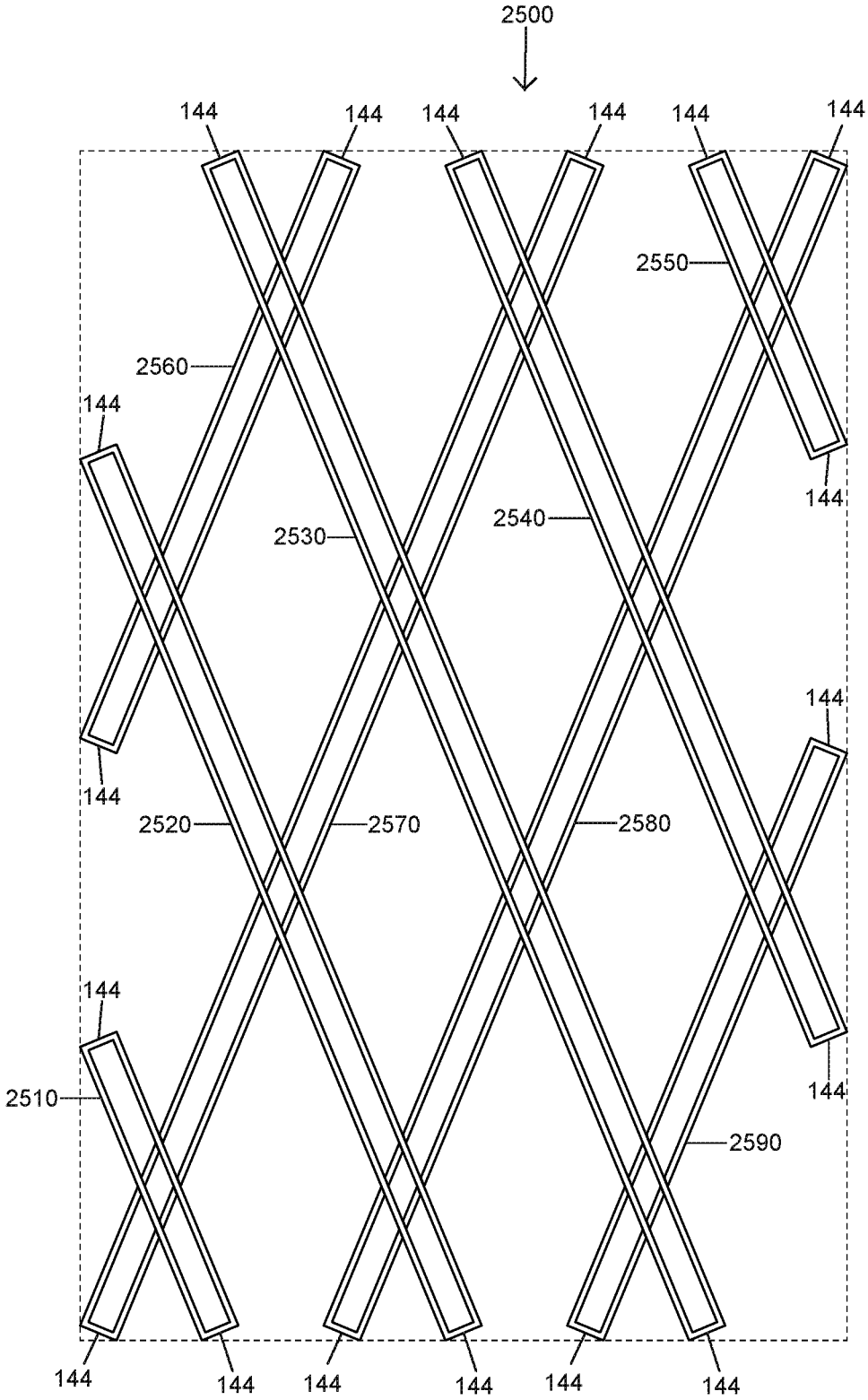
FIG. 61 illustrates a top plan view of the architectural fixture of FIG. 60.

Furthermore, lattice assemblies are not limited to arrangements where a plurality of longitudinal beams engage a plurality of lateral beams. For example, as seen in FIGS. 60-61, a lattice assembly 2500 may be configured with a first set of parallel beams (e.g., beams 2510, 2520, 2530, 2540, 2550) engaging a second set of parallel beams (e.g., beams 2560, 2570, 2580, 2590) at an angle other than a right angle (i.e., ninety (90) degrees). While all the beams of the lattice assembly 2500 could be of equal length, such as that seen above in lattice assembly 2000, if a user desires to fit the lattice assembly 2500 roughly within a footprint (e.g., a roughly rectangular footprint, such as that outlined by dashed lines in FIG. 61), one or more (even all) of the beams in the first set of parallel beams (e.g., beams 2510, 2520, 2530, 2540, 2550) may be of different lengths, and one or more (even all) of the beams in the second set of parallel beams (e.g., beams 2560, 2570, 2580, 2590) may be of different lengths. In the illustrated lattice configuration, while some beams engage more than one other beam, some beams do not engage more than one other beam. Except for individual length, the first set of parallel beams 2510, 2520, 2530, 2540, 2550 are otherwise generally identical to the first beam 1002 in design and construction. Likewise, except for individual length, the second set of parallel beams 2560, 2570, 2580, 2590 are otherwise generally identical to the second beam 1102. The first set of parallel beams 2510, 2520, 2530, 2540, 2550 engage the second set of parallel beams 2560, 2570, 2580, 2590 at an angle other than a right angle (i.e., ninety (90) degrees) due to the alignment notches 1032, 1132 in the first and second sides of the beams 2510, 2520, 2530, 2540, 2550, 2560, 2570, 2580, 2590 being formed on a diagonal across the thicknesses of the first and second sides of the beams 2510, 2520, 2530, 2540, 2550, 2560, 2570, 2580, 2590. Thus, when the alignment notches 1032 of the first set of parallel beams 2510, 2520, 2530, 2540, 2550 engage the alignment notches 1132 of the second set of parallel beams 2560, 2570, 2580, 2590, the second set of parallel beams 2560, 2570, 2580, 2590 engage the first set of parallel beams 2510, 2520, 2530, 2540, 2550 at an angle other than a generally right angle (i.e., ninety (90) degrees). The angle of the diagonal of the alignment notches 1032, 1132 correlates with the angle at which the first set of parallel beams 2510, 2520, 2530, 2540, 2550 intersect the second set of parallel beams 2560, 2570, 2580, 2590.

Figure 62:
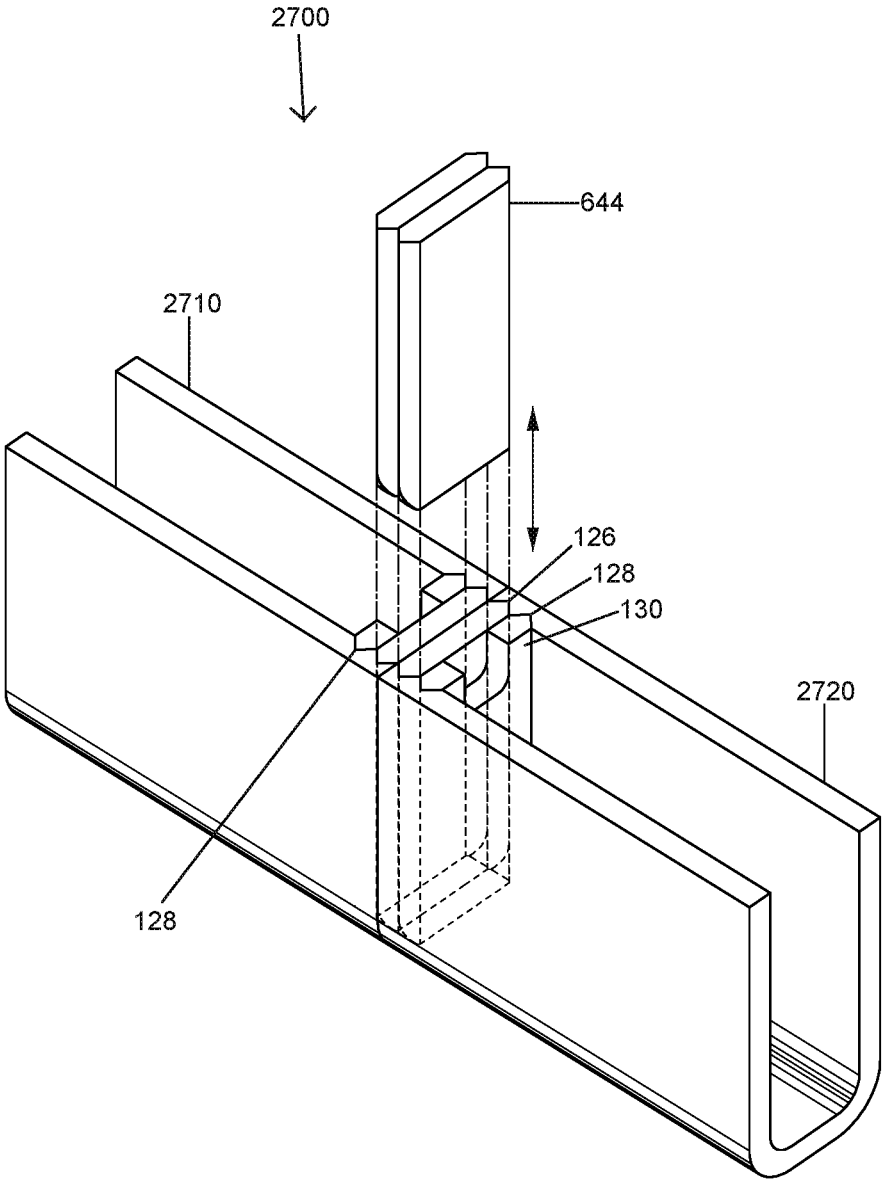
FIG. 62 illustrates a top, front, left perspective view of still another architectural fixture embodying the invention, with two beams and a connector for interconnecting the two beams, with a double-ended arrow indicating directions of movement for the connector to engage with/disengage from the beams.
Figure 63:
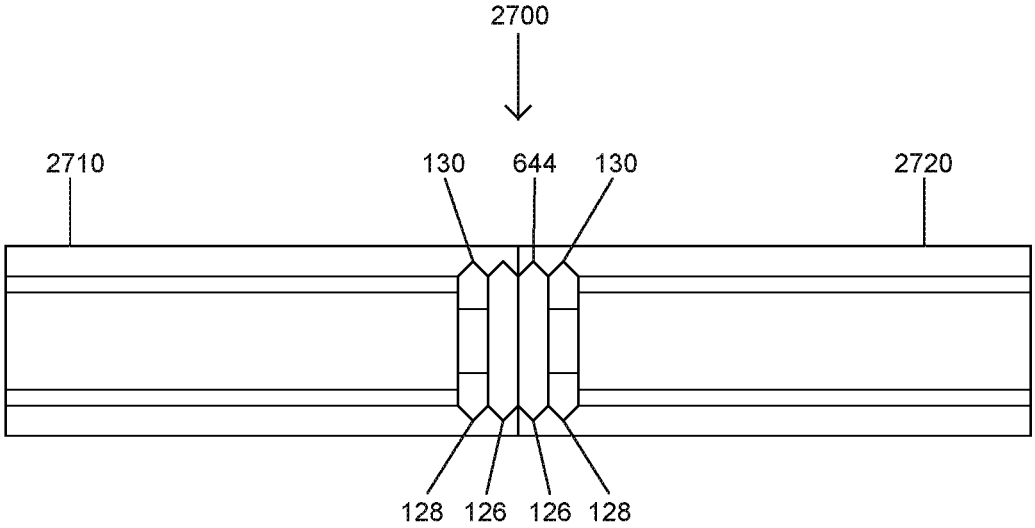
FIG. 63 illustrates a top plan view of the architectural fixture of FIG. 62.

With regard to (but not limited to) the assemblies 100, 200, 300, 400, 500, 600, 700, 800, 900, 1000, 2000, 2500 described above, while the generally vertical sides (e.g., the first and second sides) of the generally U-shaped beams meet the generally horizontal side (e.g., the bottom side) at a generally right angle (i.e., ninety (90) degrees), the generally U-shaped beams of the assemblies 100, 200, 300, 400, 500, 600, 700, 800, 900, 1000, 2000, 2500 may alternatively be formed such that the generally vertical sides curve into the generally horizontal side, as seen in FIGS. 62-63 which illustrates an architectural fixture assembly 2700. The general U-shape of the beams could be formed by curving the sheet instead of making v-cuts along fold lines. In the alternative, the beam could be thermoformed into the general U-shape. The assembly 2700, similar to the assembly 600 described above, includes a generally U-shaped first beam 2710 connected to a generally U-shaped second beam 2720 by a connector 644. Likewise, all the other assemblies 100, 200, 300, 400, 500, 700, 800, 900, 1000, 2000, 2500 described above may be configured with beams similar to the beams 2710, 2720 of the assembly 2700.

Where a connector is used to connect a plurality of beams around a "node," the shape of a desired beam configuration can be configured by using a connector having a desired configuration (e.g., a particular polygonal shape, when viewed from above, with each side of the particular polygonal shape being a plate 146, but each plate 146 not necessarily being attached to a connection key 148). In this manner, the desired configuration includes a number of plates 146 of the plurality of plates 146 of the connector (i.e., the number of plates being all of the plurality of plates 146 or being any number of the plates 146 that is less than all of the plurality of plates 146) where the number of plates 146 includes a connection key 148 extending away therefrom and engaging a particular one of a plurality of beams.

Figure 64:
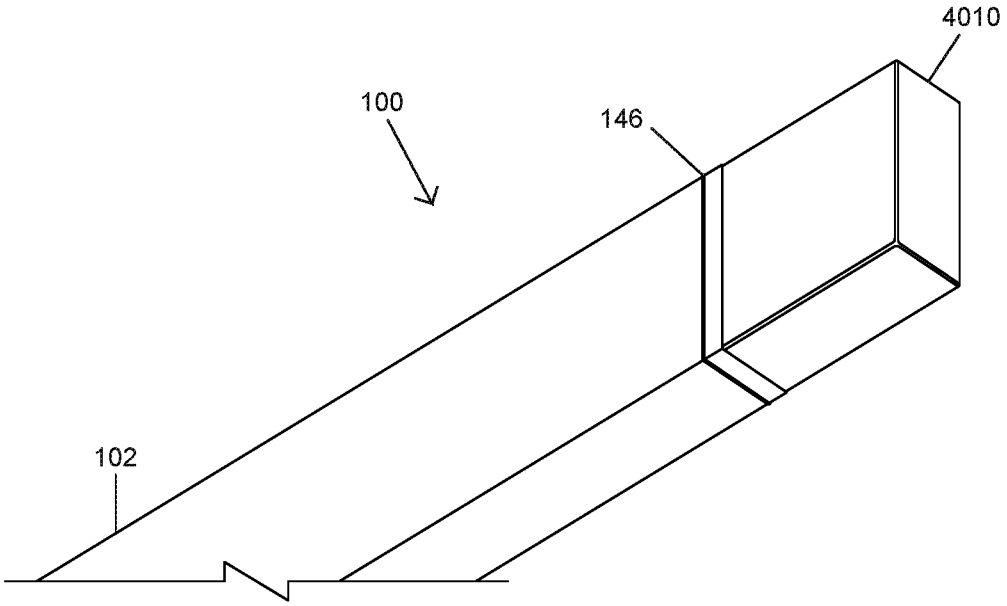
FIG. 64 illustrates a bottom, front left perspective view of a connector adapted to act as an attachment point for a light fixture operationally engaging the plate of the connector.
Figure 65:
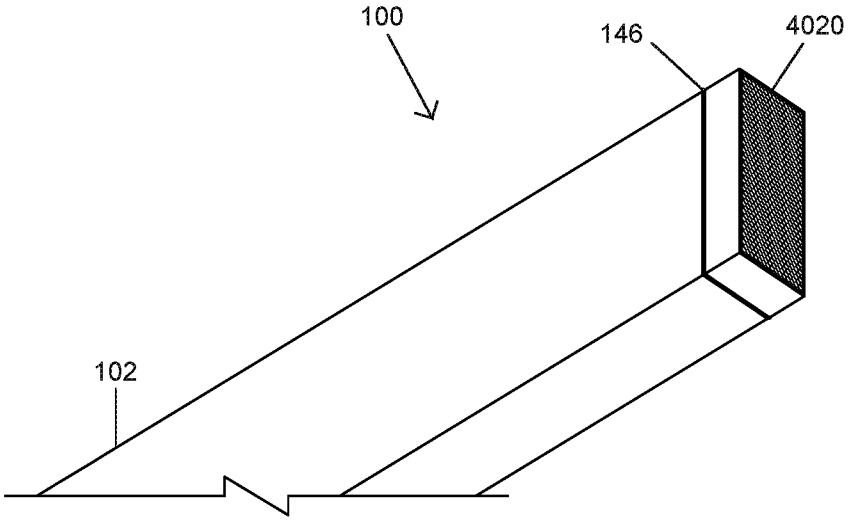
FIG. 65 illustrates a bottom, front left perspective view of a connector adapted to act as an attachment point for an audio speaker operationally engaging the plate of the connector.
Figure 66:
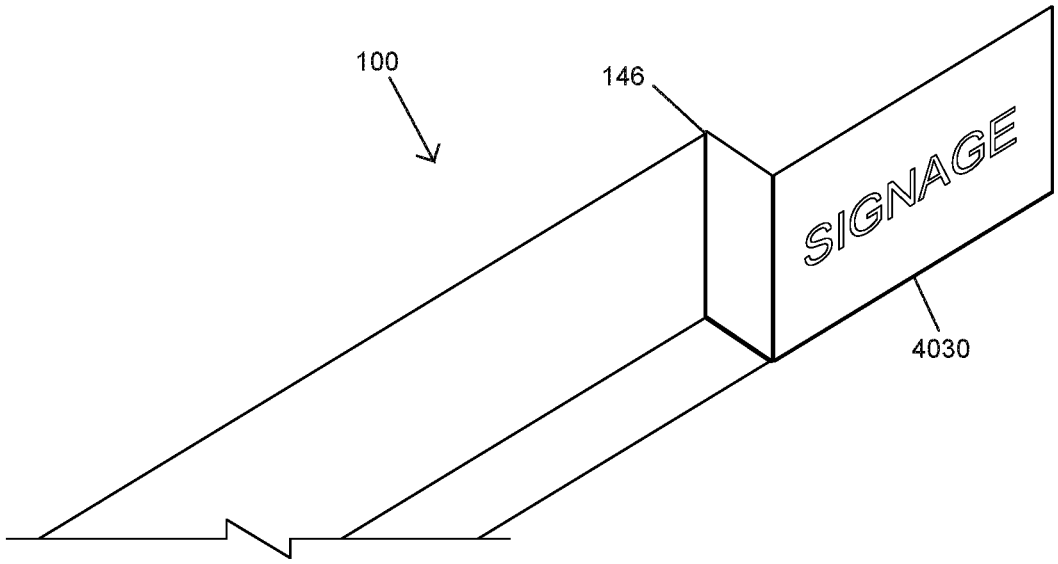
FIG. 66 illustrates a bottom, front left perspective view of a connector adapted to act as an attachment point for a sign operationally engaging the plate of the connector.
Figure 67:
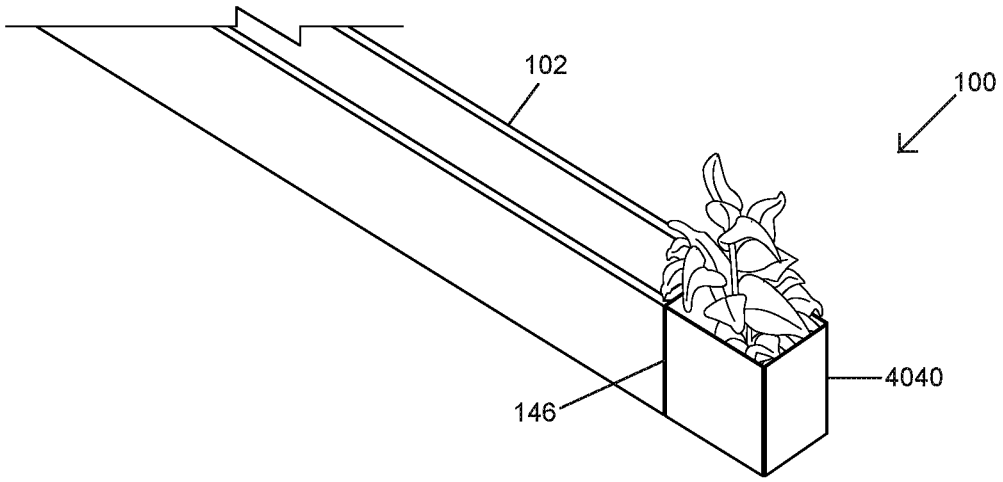
FIG. 67 illustrates a top, front left perspective view of a connector adapted to act as an attachment point for a planter operationally engaging the plate of the connector.
Figure 68:
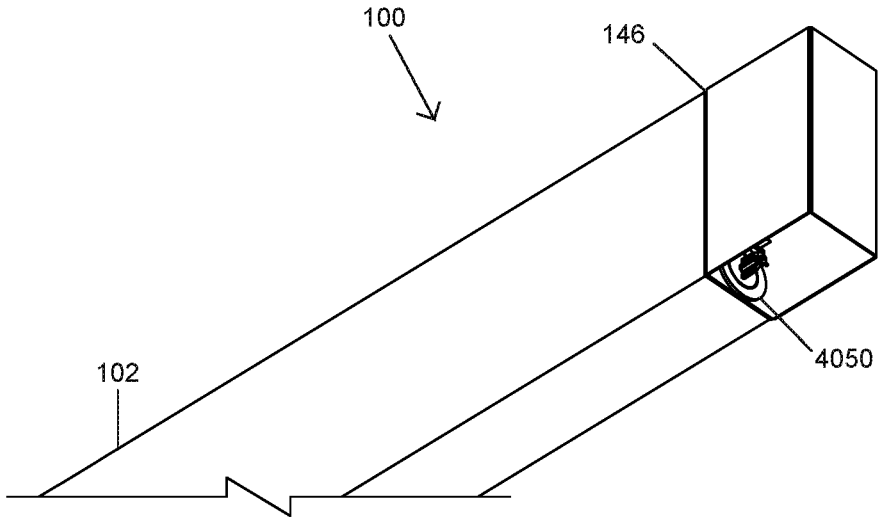
FIG. 68 illustrates a bottom, front left perspective view of a connector adapted to act as an attachment point for a sprinkler of a sprinkler system operationally engaging the plate of the connector.

The various connectors 144, 244, 344, 444, 544, 644, 744, 844, 944 discussed above may also be adapted for use in conjunction with a variety of devices or objects. For example, the front side 166 of the plate 146 of the connector 144 may also be adapted to act as an attachment point for a variety of devices or objects. For example, as seen in FIG. 64, the assembly 100 may further include a light fixture 4010 operationally engaging the plate 146. In a further example, as illustrated in FIG. 65, the assembly 100 may further include an audio speaker 4020 operationally engaging the plate 146. In another example, as seen in FIG. 66, the assembly 100 may further include a sign 4030 operationally engaging the plate 146. In an additional example, as seen in FIG. 67, the assembly 100 may further include a planter 4040 operationally engaging the plate 146. In yet another example, as seen in FIG. 68, the assembly 100 may further include a sprinkler 4050 of a sprinkler system operationally engaging or otherwise extending through an aperture in the plate 146. The front side 166 of the plate 146 of the connector 144 may also be sized and shaped so as to be recessed within the beam such that the front side 166 of the plate 146 is flush with the boundary of the first end 110 of the beam 102. In another alternative, the beam 1902 may include a recess on the first end 110 to receive the plate 146, with the plate 146 sized and shaped to be received within the recess. Alternatively, the connector 144 may include only the connection key 148 (i.e., there is no plate 146) with the front, outwardly facing side 154 of the connection key 148 being flush with the boundary of the first end 110 of the beam 102.

Figure 69:
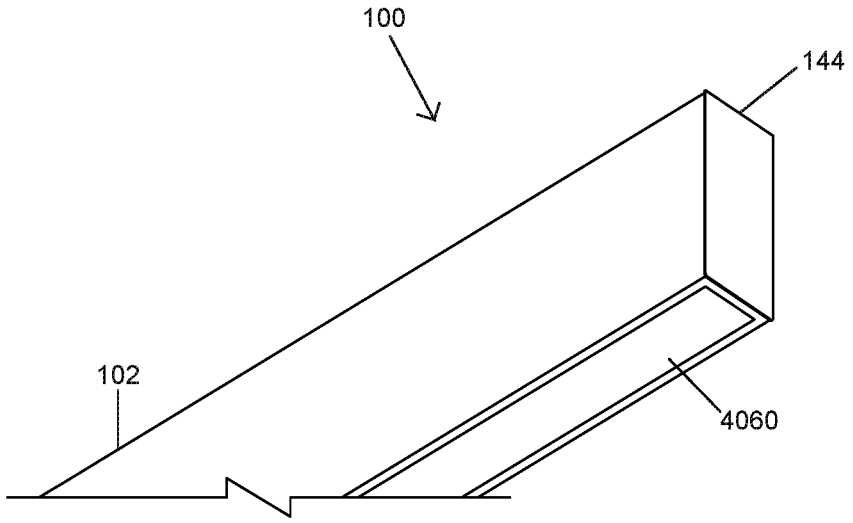
FIG. 69 illustrates a bottom, front left perspective view of a light fixture at least partially disposed within the interior portion of a beam.
Figure 70:
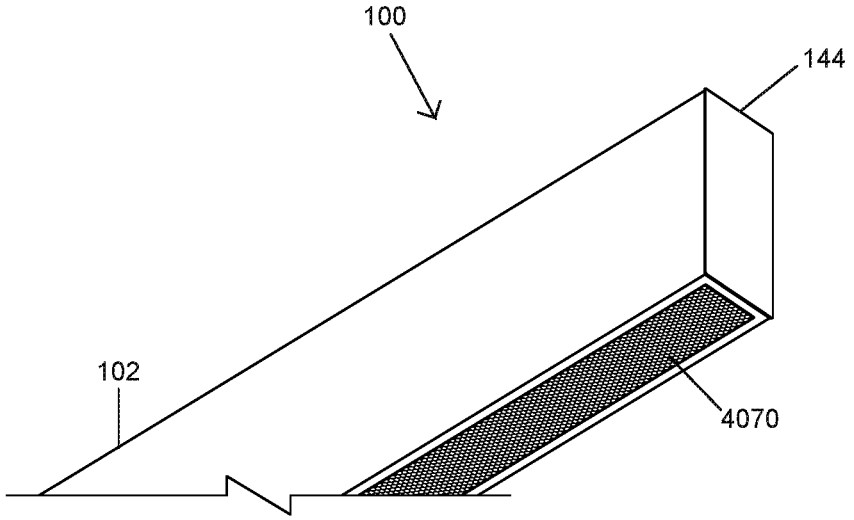
FIG. 70 illustrates a bottom, front left perspective view of a speaker of an audio system at least partially disposed within the interior portion of a beam.
Figure 71:
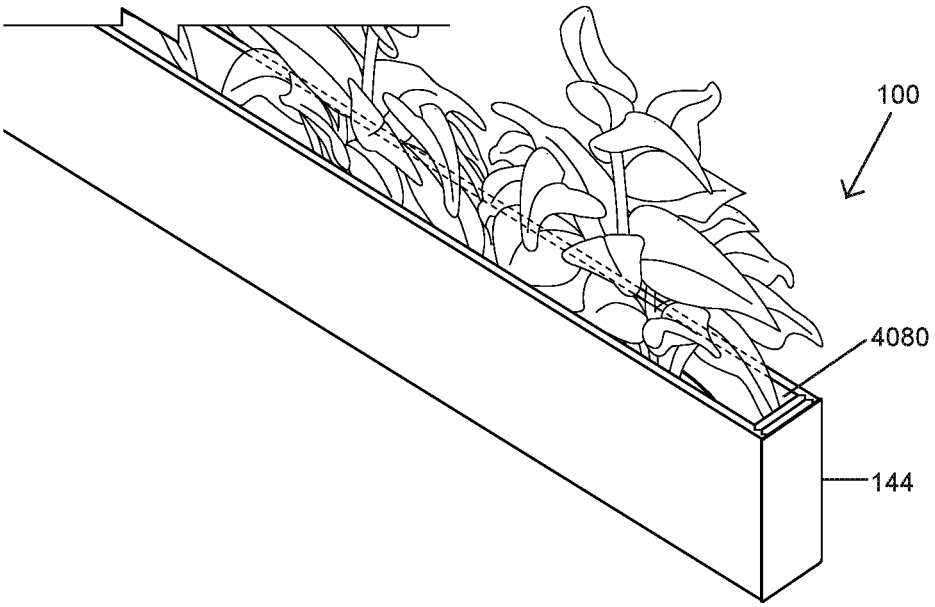
FIG. 71 illustrates a top, front left perspective view of a planter at least partially disposed within the interior portion of a beam.
Figure 72:
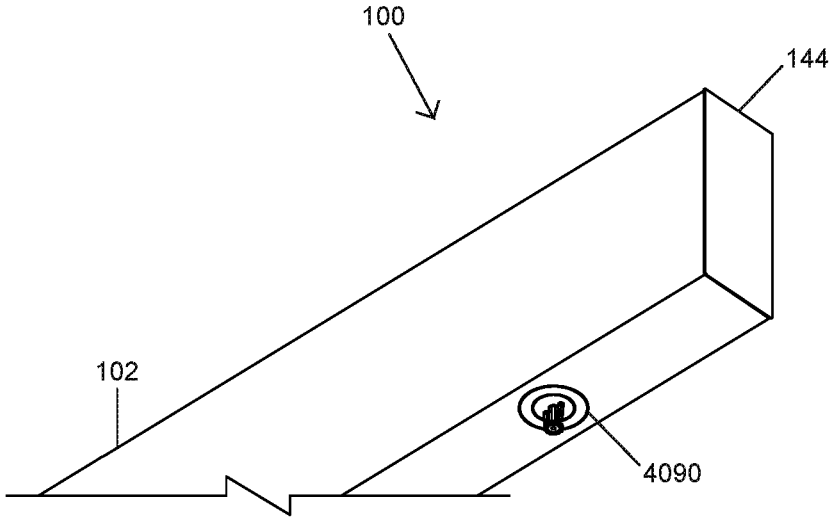
FIG. 72 illustrates a bottom, front left perspective view of a sprinkler of a sprinkler system at least partially disposed within the interior portion of a beam.
Figure 73:
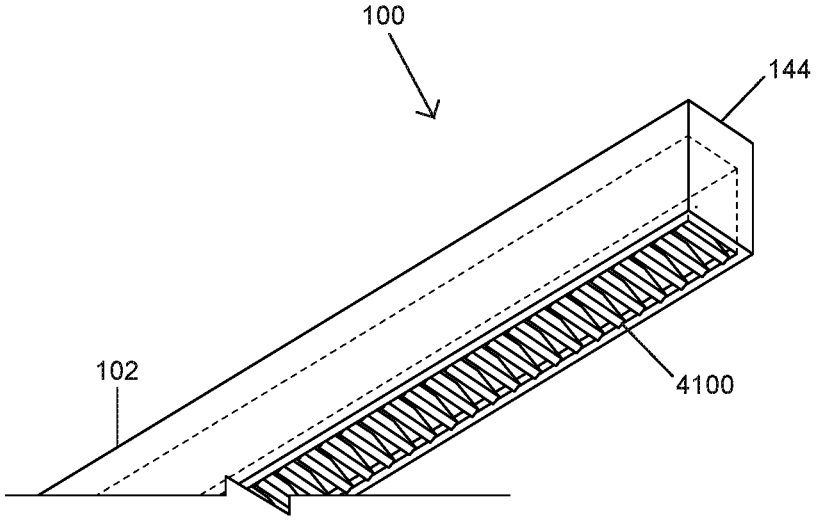
FIG. 73 illustrates a bottom, front left perspective view of a vent of a Heating Ventilation and Air Conditioning (HVAC) system at least partially disposed within the interior portion of a beam.
Figure 74:
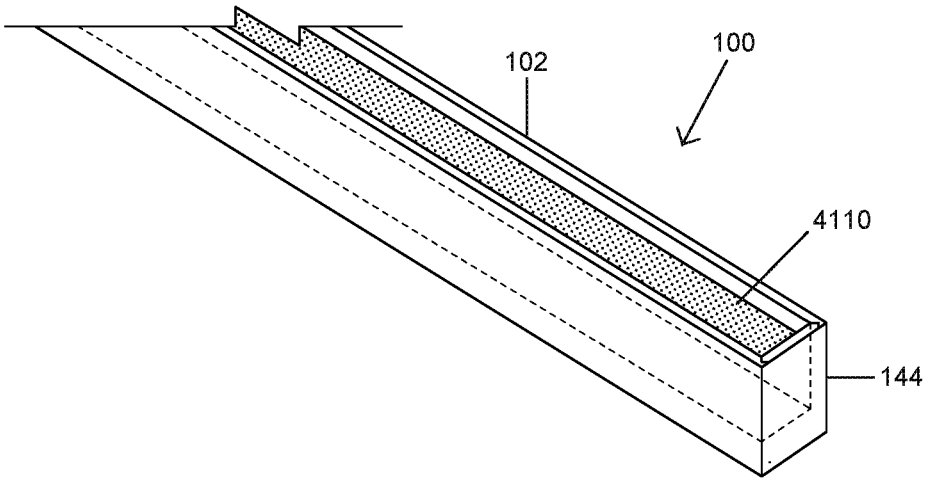
FIG. 74 illustrates a top, front left perspective view of additional sound-absorbing material at least partially disposed within the interior portion of a beam.
Figure 75:
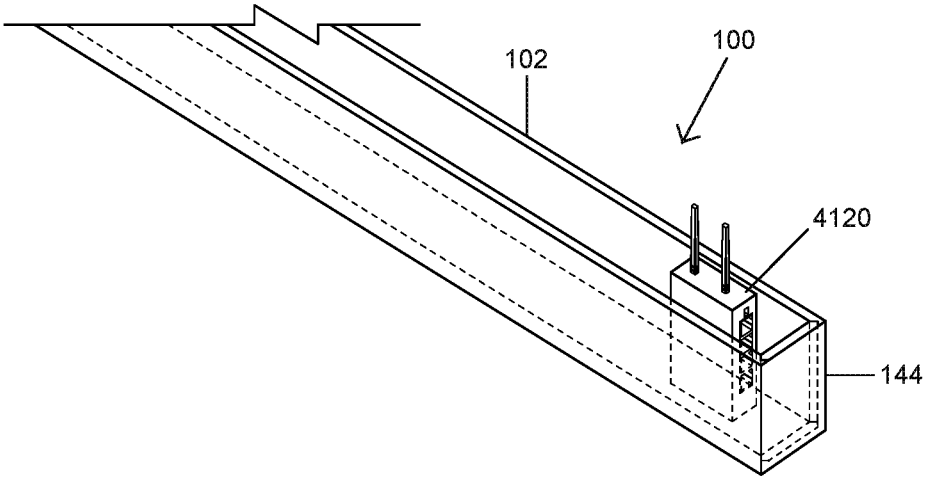
FIG. 75 illustrates a top, front left perspective view of a router or other wireless system at least partially disposed within the interior portion of a beam.
Figure 76:
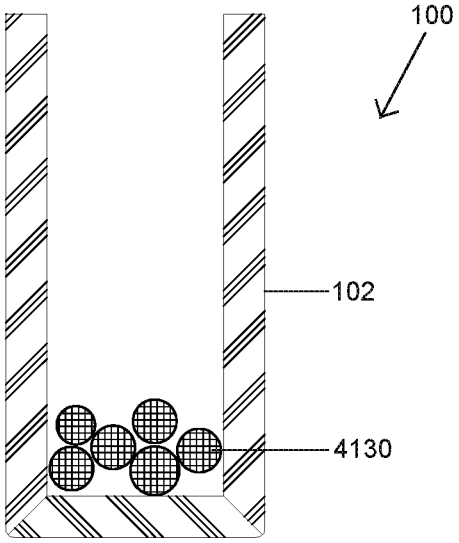
FIG. 76 illustrates a cross-sectional view of cables at least partially disposed within the interior portion of a beam such that the interior portion serves as a cable tray.
Figure 77:
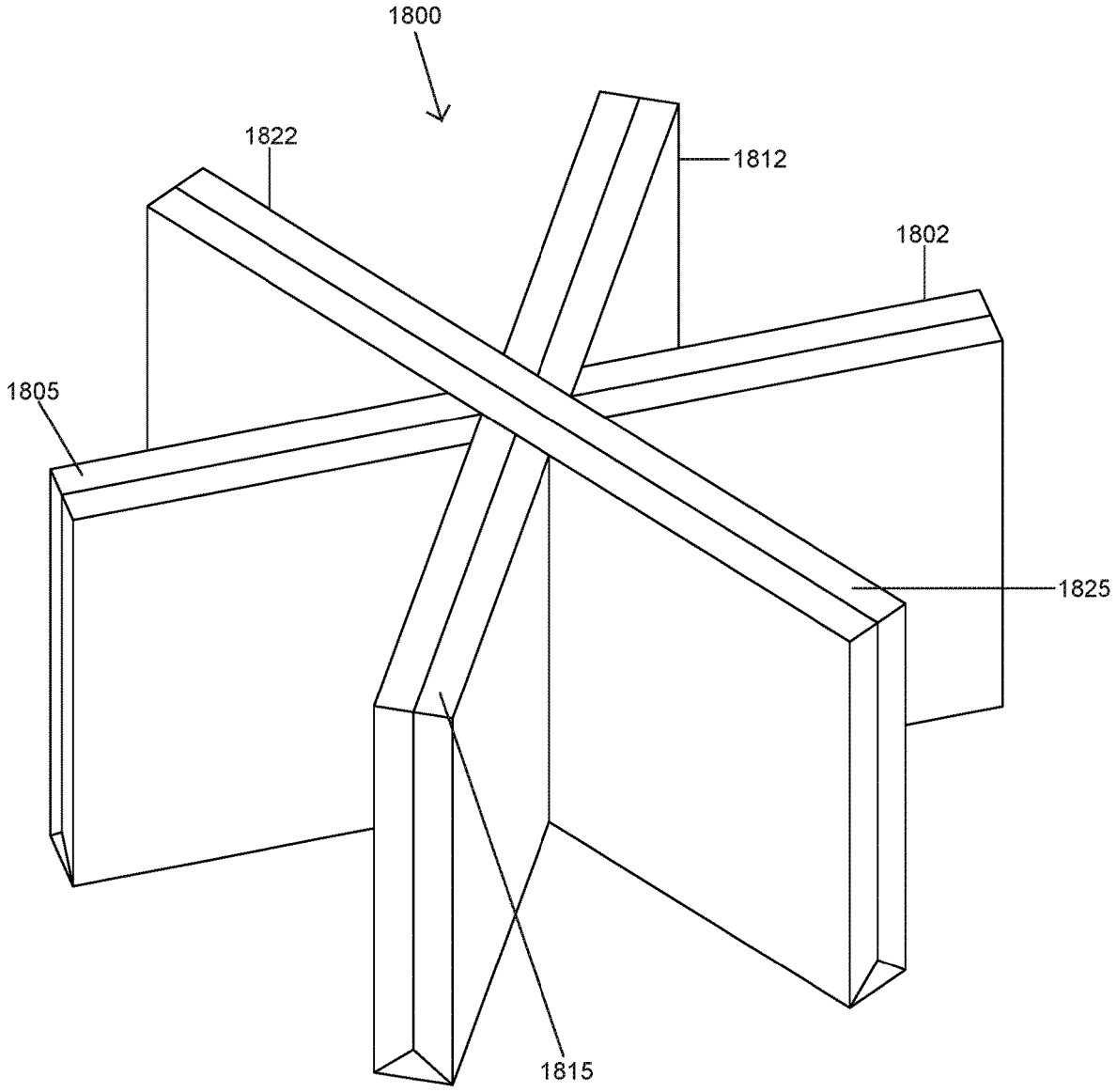
FIG. 77 illustrates a top, front, left perspective view of still another architectural fixture embodying the invention, with three engaged, intersecting beams.
Figure 78:
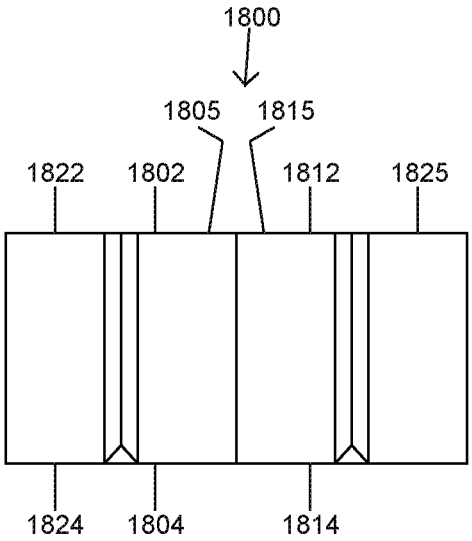
FIG. 78 illustrates a front side elevation view of the architectural fixture of FIG. 77.
Figure 79:
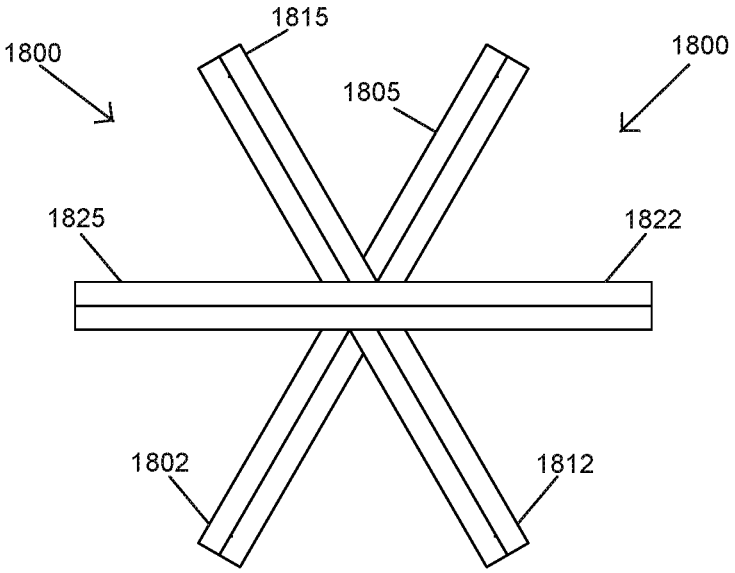
FIG. 79 illustrates a top plan view of the architectural fixture of FIG. 77, with the beams in engagement.

The interior portion 112, 212, 312, 412, 712, 812, 912, 1012, 1112 of at least one beam 102, 202, 302, 402, 702, 802, 902, 932, 1002, 1102, 1202, 1302, 1402, 1502, 1602, 1702, 1802, 1812, 1822, 1902, 5014, 5016 of the assemblies 100, 200, 300, 400, 500, 600, 700, 800, 900, 1000, 1800, 1900, 2000, 2500, 5000 may also be adapted for use in conjunction with a variety of devices or objects. For example, as seen in FIG. 69, at least one beam 102, 202, 302, 402, 702, 802, 902, 932, 1002, 1102, 1202, 1302, 1402, 1502, 1602, 1702, 1802, 1812, 1822, 1902, 5014, 5016 of the assemblies 100, 200, 300, 400, 500, 600, 700, 800, 900, 1000, 1800, 1900, 2000, 2500, 5000 includes a light fixture 4060 at least partially disposed within the interior portion 112, 212, 312, 412, 712, 812, 912, 1012, 1112. The at least one beam 102, 202, 302, 402, 702, 802, 902, 932, 1002, 1102, 1202, 1302, 1402, 1502, 1602, 1702, 1802, 1812, 1822, 1902, 5014, 5016 may be made from a light-diffusive material configured to give the beam the appearance of a glow when the light fixture is illuminated. This light-diffusive material may be made from various materials including, without limitation, a thin, non-woven polymer with translucent qualities; a translucent plastic; and the like. The light-diffusive material may diffuse light emitted from the light fixture in a manner that uniformly or non-uniformly diffuses light along the beam 102, 202, 302, 402, 702, 802, 902, 932, 1002, 1102, 1202, 1302, 1402, 1502, 1602, 1702, 1802, 1812, 1822, 1902, 5014, 5016. If the beam 102, 202, 302, 402, 702, 802, 902, 932, 1002, 1102, 1202, 1302, 1402, 1502, 1602, 1702, 1802, 1812, 1822, 1902, 5014, 5016 is made from a sound-absorbing material, the sound-absorbing material may also be a light-diffusive material. In a further example, as illustrated in FIG. 70, at least one beam 102, 202, 302, 402, 702, 802, 902, 932, 1002, 1102, 1202, 1302, 1402, 1502, 1602, 1702, 1802, 1812, 1822, 1902, 5014, 5016 of the assemblies 100, 200, 300, 400, 500, 600, 700, 800, 900, 1000, 1800, 1900, 2000, 2500, 5000 includes at least one speaker 4070 of an audio system at least partially disposed within the interior portion 112, 212, 312, 412, 712, 812, 912, 1012, 1112. In an additional example, as illustrated in FIG. 71, at least one beam 102, 202, 302, 402, 702, 802, 902, 932, 1002, 1102, 1202, 1302, 1402, 1502, 1602, 1702, 1802, 1812, 1822, 1902, 5014, 5016 of the assemblies 100, 200, 300, 400, 500, 600, 700, 800, 900, 1000, 1800, 1900, 2000, 2500, 5000 includes at least one planter 4080 at least partially disposed within the interior portion 112, 212, 312, 412, 712, 812, 912, 1012, 1112. In yet another example, as illustrated in FIG. 72, at least one beam 102, 202, 302, 402, 702, 802, 902, 932, 1002, 1102, 1202, 1302, 1402, 1502, 1602, 1702 of the assemblies 100, 200, 300, 400, 500, 600, 700, 800, 900, 1000, 1800, 1900, 2000, 2500, 5000 includes a portion of a sprinkler system 4090 at least partially disposed within the interior portion 112, 212, 312, 412, 712, 812, 912, 1012, 1112. In another example, as illustrated in FIG. 73, at least one beam 102, 202, 302, 402, 702, 802, 902, 932, 1002, 1102, 1202, 1302, 1402, 1502, 1602, 1702, 1802, 1812, 1822, 1902, 5014, 5016 of the assemblies 100, 200, 300, 400, 500, 600, 700, 800, 900, 1000, 1800, 1900, 2000, 2500, 5000 includes a portion of a Heating Ventilation and Air Conditioning (HVAC) system 4100 at least partially disposed within the interior portion 112, 212, 312, 412, 712, 812, 912, 1012, 1112. In a further example, as illustrated in FIG. 74, at least one beam 102, 202, 302, 402, 702, 802, 902, 932, 1002, 1102, 1202, 1302, 1402, 1502, 1602, 1702, 1802, 1812, 1822, 1902, 5014, 5016 of the assemblies 100, 200, 300, 400, 500, 600, 700, 800, 900, 1000, 1800, 1900, 2000, 2500, 5000 includes additional sound-absorbing material 4110 at least partially disposed within the interior portion 112, 212, 312, 412, 712, 812, 912, 1012, 1112. In yet an additional example, as illustrated in FIG. 75, at least one beam 102, 202, 302, 402, 702, 802, 902, 932, 1002, 1102, 1202, 1302, 1402, 1502, 1602, 1702, 1802, 1812, 1822, 1902, 5014, 5016 of the assemblies 100, 200, 300, 400, 500, 600, 700, 800, 900, 1000, 1800, 1900, 2000, 2500, 5000 includes a router or other wireless system at least partially disposed within the interior portion 112, 212, 312, 412, 712, 812, 912, 1012, 1112. In another example, as illustrated in FIG. 76, at least one beam 102, 202, 302, 402, 702, 802, 902, 932, 1002, 1102, 1202, 1302, 1402, 1502, 1602, 1702, 1802, 1812, 1822, 1902, 5014, 5016 of the assemblies 100, 200, 300, 400, 500, 600, 700, 800, 900, 1000, 1800, 1900, 2000, 2500, 5000 includes cables 4130 at least partially disposed within the interior portion 112, 212, 312, 412, 712, 812, 912, 1012, 1112 such that the interior portion 112, 212, 312, 412, 712, 812, 912, 1012, 1112 serves as a cable tray. The above examples are merely illustrative and not limiting. In conjunction with the above examples, the structure of the assemblies 100, 200, 300, 400, 500, 600, 700, 800, 900, 1000, 1800, 1900, 2000, 2500, 5000 may be adapted to secure various objects; provide routing of various electrical wiring, cabling (e.g., Ethernet, optical fibers, audio, etc.), water pipes/piping, ducts/ducting, and the like; or otherwise provide for the operation of various devices/equipment disposed within the interior portion 112, 212, 312, 412, 712, 812, 912, 1012, 1112. Various features found in individual assemblies may be used in other assemblies.

At least one beam (e.g., beam 102, 202, 302, 402, 702, 802, 902, 932, 1002, 1102, 1202, 1302, 1402, 1502, 1602, 1702, 1802, 1812, 1822, 1902, 5014, 5016) described above in connection with one or more of the assemblies 100, 200, 300, 400, 500, 600, 700, 800, 900, 1000, 1800, 1900, 2000, 2500, 5000 (or even all or part of at least one assembly (e.g., assembly 100, 200, 300, 400, 500, 600, 700, 800, 900, 1000, 1800, 1900, 2000, 2500, 5000)) may be configured (by itself, in combination with at least one other beam (e.g., beam 102, 202, 302, 402, 702, 802, 902, 932, 1002, 1102, 1202, 1302, 1402, 1502, 1602, 1702, 1802, 1812, 1822, 1902, 5014, 5016), or even in combination with all or part of at least one assembly (e.g., assembly 100, 200, 300, 400, 500, 600, 700, 800, 900, 1000, 1800, 1900, 2000, 2500, 5000)) to provide a particular type of structure or structural configuration. For example, at least one beam or portion of an assembly may be configured as a sound-absorbing furniture connection. For example, as a part of the box apron or structure of a table or as a desk divider. In another example, at least one beam or portion of an assembly may be configured as a frame or as part of a frame. Various examples of types of frames include, without limitation, a mirror frame, a picture frame, an ornamental frame around a doorway, and the like. In an additional example, at least one beam or portion of an assembly may be configured as a shelf. Various examples of types of shelves including, without limitation, a book shelf, a display shelf, a retail shelf, and the like. In yet another example, at least one beam or portion of an assembly may be configured as a table leg. For example, a leg or structure, such as for a coffee table, or a desk. In a further example, at least one beam or portion of an assembly may be configured as a desk divider. For example, a desk divider may be implemented in the form of a tall beam (e.g., generally 20-48 inches, but the beam can be sized as desired), or as an assembly of beams to form a frame, or as a structure to hold privacy panels. In yet a further example, at least one beam or portion of an assembly may be configured as a screen (e.g., a room divider, a privacy screen, etc.). Various configurations found in individual assemblies may be used in other assemblies.

The appearance of an assembly 100, 200, 300, 400, 500, 600, 700, 800, 900, 1000, 1800, 1900, 2000, 2500, 5000 may adjusted as desired by a user. For example, an assembly 100, 200, 300, 400, 500, 600, 700, 800, 900, 1000, 1800, 1900, 2000, 2500, 5000 may include additional connectors with one or more plates acting as an "end cap" where the plates of the additional connectors have different colors or finishes so that a user may change "the look" of at least one "end cap" of the assembly 100, 200, 300, 400, 500, 600, 700, 800, 900, 1000, 1800, 1900, 2000, 2500, 5000. In the foregoing example, the assembly 100, 200, 300, 400, 500, 600, 700, 800, 900, 1000, 1800, 1900, 2000, 2500, 5000 may have all "end cap" with identical colors or finishes or a mixture of "end caps" having different colors or finishes. In this manner, a user may create a space divided up into various areas (e.g., Red Area, Blue Area, Green Area, etc.) where the "end caps" of one or more overhead architectural fixture (e.g., any one or more of assemblies 100, 200, 300, 400, 500, 600, 700, 800, 900, 1000, 1800, 1900, 2000, 2500, 5000) are colored (e.g., red, blue, green, etc.) to help identify the designation of a particular area. In another example, the exterior surface of one or more beams of an assembly 100, 200, 300, 400, 500, 600, 700, 800, 900, 1000, 1800, 1900, 2000, 2500, 5000) can be configured with a printed exterior finish. In a further example, the exterior surface of one or more beams of an assembly 100, 200, 300, 400, 500, 600, 700, 800, 900, 1000, 1800, 1900, 2000, 2500, 5000) can be configured with moss (e.g., real or artificial) or some other matter attached to the exterior surface. The beams of an assembly 100, 200, 300, 400, 500, 600, 700, 800, 900, 1000, 1800, 1900, 2000, 2500, 5000 can be any length desired by a user, with various dimensions and proportions of the beam also being as desired by a user.

In accordance with an additional embodiment of the invention, an architectural fixture assembly 1800 is illustrated in FIGS. 77-89. The assembly 1800 has many similar, if not identical, features as described above in reference to the assemblies 100, 200, 300, 400, 500, 600, 700, 800, 900, 1000, 2000, except that the assembly 1800 describes an embodiment where three (3) beams 1802, 1812, 1822 are connected, and each beam 1802, 1812, 1822 is connected at an angle to the other two (2) beams. Each beam 1802, 1812, 1822 includes a bottom side 1804, 1814, 1824, a top side 1805, 1815, 1825, a first side 1806, 1816, 1826, a second side 1808, 1818, 1828, a first end 1810, 1820, 1830, and a second end 1811, 1821, 1831. The interior surfaces of the first and second sides 1806, 1816, 1826, 1808, 1818 1828 of each beam 1802, 1812, 1822 contact each other when the first and second sides 1806, 1816, 1826, 1808, 1818 1828 are folded together. The beams 1802, 1812, 1822 are similar to each other in design and construction, except for those portions of the beams 1802, 1812, 1822 directed to engaging the other beams. Except for purposes of clarity, reference numbers used to describe features in the assemblies 100, 200, 300, 400, 500, 600, 700, 800, 900, 1000, 2000 will be used to describe identical/similar features in the assembly 1800.

The beam 1802 may be made from a generally flat, elongated sheet 1834 with a top side 1836, a bottom side 1838, a first end 1840, and a second end 1841. The sheet 1834 has a thickness and a longitudinal axis running along a center of the sheet 1834 between the first end 1840 and the second end 1841. A pair of fold lines 1842 extend between the first end 1840 and the second end 1841. The fold lines 1842 are disposed on the top side 1836 of the sheet 1834, on opposite sides of, and parallel with, the longitudinal axis. Each fold line 1842 includes a generally V-shaped cut 1844 on the top side 1836 of the sheet 1834 so that the sheet 1834 may cleanly fold without substantially compressing or deforming the material of the sheet 1834 that is otherwise present along the fold lines 1842. The fold lines 1842 define the bottom portion or side 1804, first side 1806, and second side 1808 of the beam 1802. The folded first and second sides 1806, 1808 define the top side 1805 of the beam 1802. The generally V-shaped cuts 1844 may be configured to permit the exposed edges to abut in a flush manner when the first and second sides 1806, 1808 are folded at a desired angle. The general rectangular shape of the beam 1802 is formed by the first side 1806 being folded upwards until the sides of the generally V-shaped cut 1844 engage, and the second side 1808 being folded upwards until the sides of the generally V-shaped cut 1844 engage, and the interior surfaces of the first and second sides 1806, 1808 contact each other when the first and second sides 1806, 1808 are folded together. The first end 1810 of the beam 1802 and the first end 1840 of the sheet 1834 are the same end. The sheet 1834 is folded from a flat configuration to the generally rectangular-shaped configuration of the beam 1802.

The portions of the sheet 1834 defining the first and second sides 1806, 1808 each includes a generally rectangular alignment notch 1846. When the first and second sides 1806, 1808 are folded together, the alignment notches 1846 are aligned but give the appearance of being mirror images of each other. The walls of the alignment notches 1846 are angled such that the alignment notches 1846 will matingly engage the alignment notches 1866 of the second beam 1812 (the alignment notches 1866 of the second beam 1812 also having angled walls such that engagement of the alignment notches 1846, 1866 will result in the beams 1802, 1812 being at a particular angle with respect to one another). As illustrated, the notches 1846 are disposed about halfway along the length of the sheet 1834, but the notches 1846 can be positioned anywhere along the sheet 1834 as desired by the user. The alignment notch 1846 on the first side 1806 of the first beam 1802 is aligned with the alignment notch 1846 on the second side 1808 of the first beam 1802. The alignment notch 1846 generally extends from a top edge of the side 1806, 1808 downwards towards the bottom edge of the side 1806, 1806. The length of the alignment notches 1846 is configured such that the top and bottom edges of each beam 1802, 1812, 1822 are aligned.

The beam 1812 may be made from a generally flat, elongated sheet 1854 with a top side 1856, a bottom side 1858, a first end 1860, and a second end 1861. The sheet 1854 (similar to the sheet 1834) has a thickness and a longitudinal axis running along a center of the sheet 1854 between the first end 1860 and the second end 1861. A pair of fold lines 1842 extend between the first end 1860 and the second end 1861. The fold lines 1842 are disposed on the top side 1856 of the sheet 1854, on opposite sides of, and parallel with, the longitudinal axis. Each fold line 1842 includes a generally V-shaped cut 1844 on the top side 1856 of the sheet 1854 so that the sheet 1854 may cleanly fold without substantially compressing or deforming the material of the sheet 1854 that is otherwise present along the fold lines 1842. The fold lines 1842 define the bottom portion or side 1814, first side 1816, and second side 1818 of the beam 1812. The folded first and second sides 1816, 1818 define the top side 1815 of the beam 1812. The generally V-shaped cuts 1844 may be configured to permit the exposed edges to abut in a flush manner when the first and second sides 1816, 1818 are folded at a desired angle. The general rectangular shape of the beam 1812 is formed by the first side 1816 being folded upwards until the sides of the generally V-shaped cut 1844 engage, and the second side 1818 being folded upwards until the sides of the generally V-shaped cut 1844 engage, and the interior surfaces of the first and second sides 1816, 1818 contact each other when the first and second sides 1816, 1818 are folded together. The first end 1820 of the beam 1812 and the first end 1860 of the sheet 1854 are the same end. The sheet 1854 is folded from a flat configuration to the generally rectangular-shaped configuration of the beam 1812.

Figure 80:
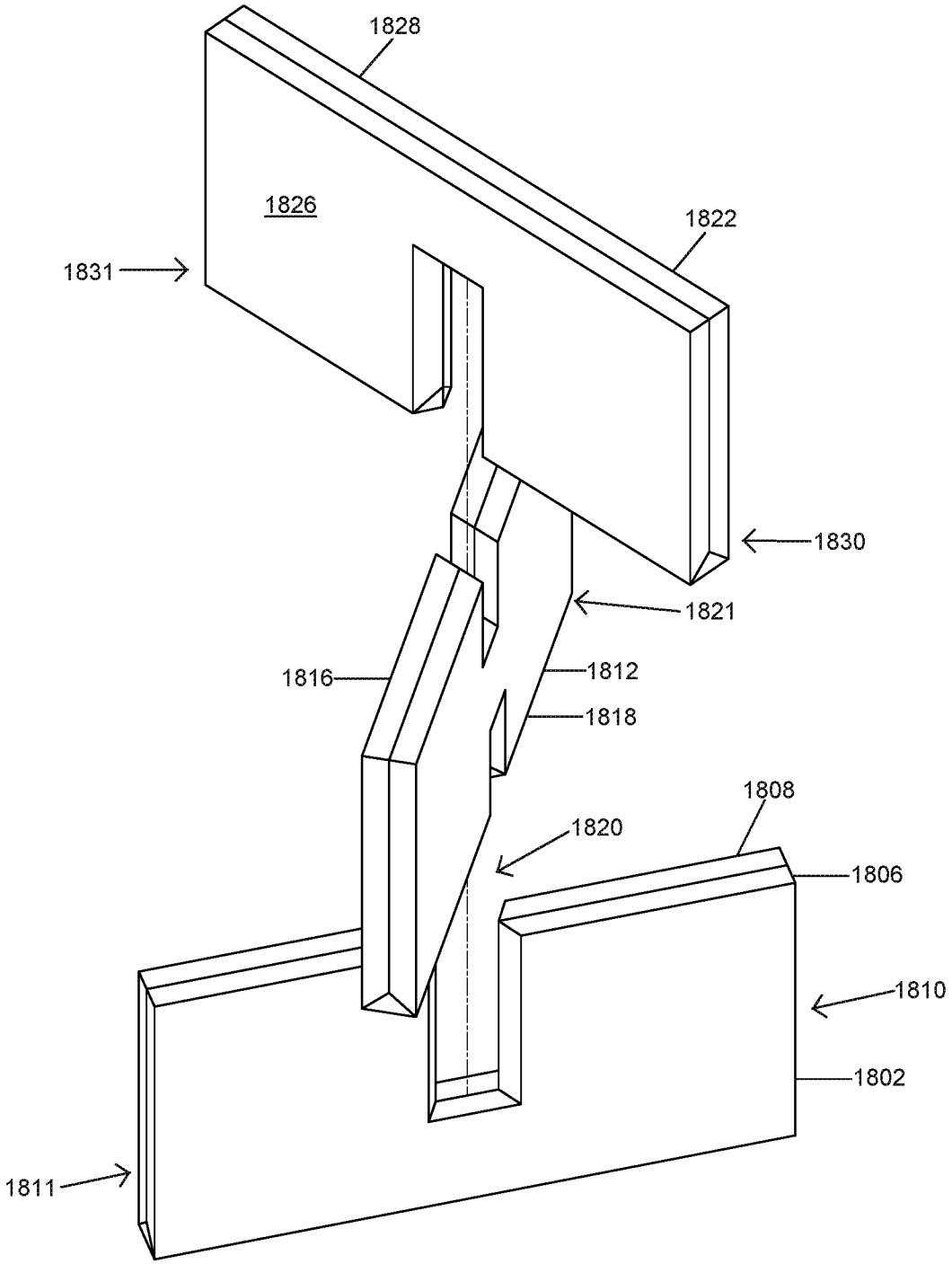
FIG. 80 illustrates a top, front, left perspective exploded view of the architectural fixture of FIG. 77, with a double-ended arrow indicating directions of movement for the beams to engage with/disengage from at least one other beam.
Figure 81:
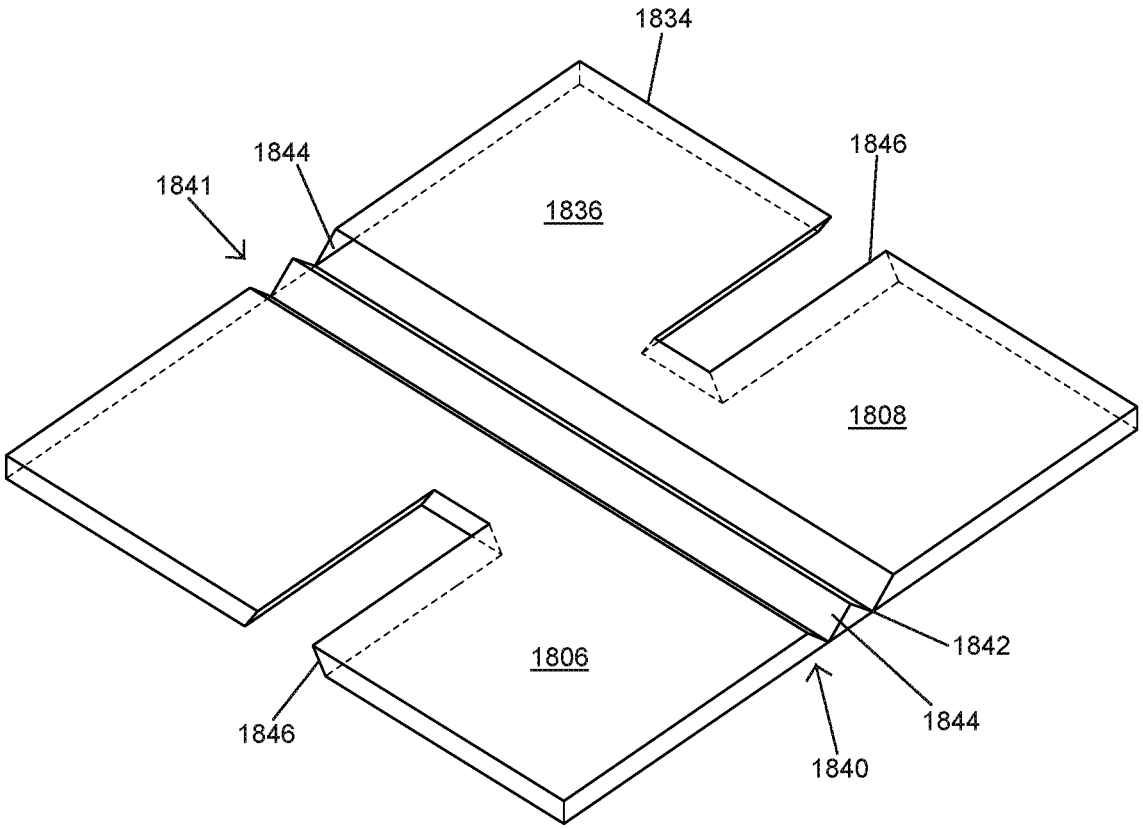
FIG. 81 illustrates a top, front, left perspective view of a first beam of the architectural fixture of FIG. 77.
Figure 82:
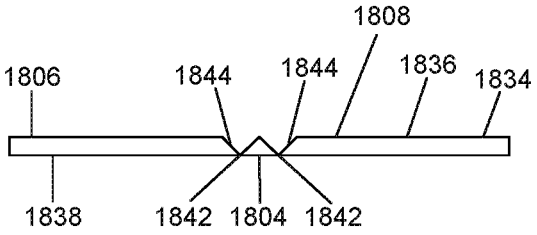
FIG. 82 illustrates a front side elevation view of first beam of FIG. 81.
Figure 83:
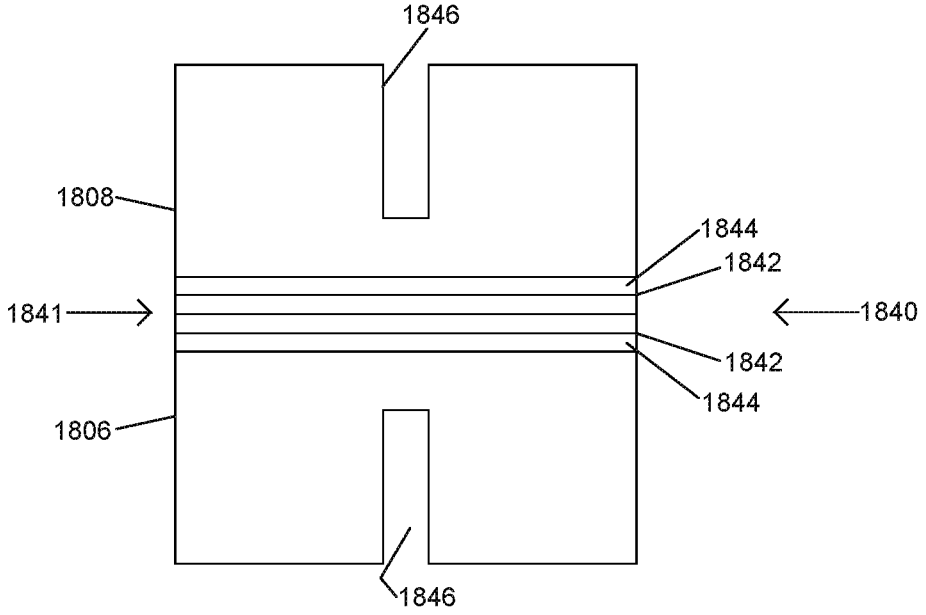
FIG. 83 illustrates a top plan view of the first beam of FIG. 81.
Figure 84:
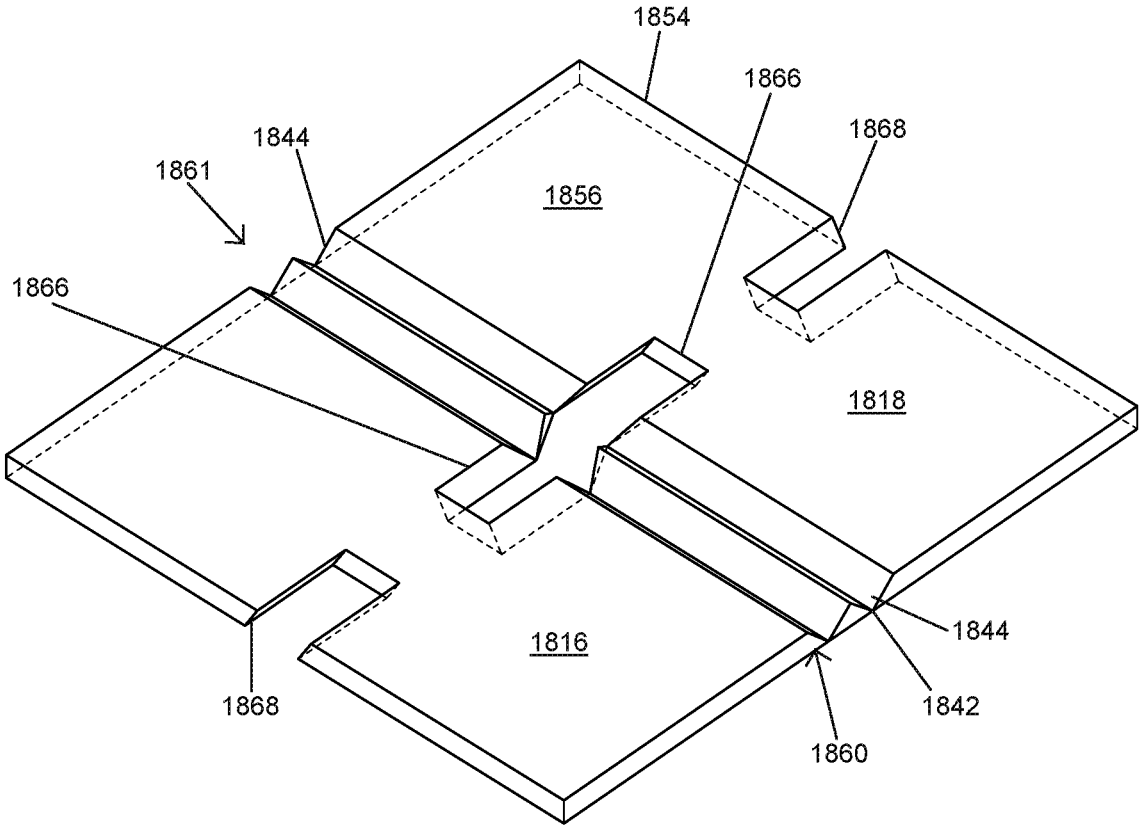
FIG. 84 illustrates a top, front, left perspective view of a second beam of the architectural fixture of FIG. 77.
Figure 85:
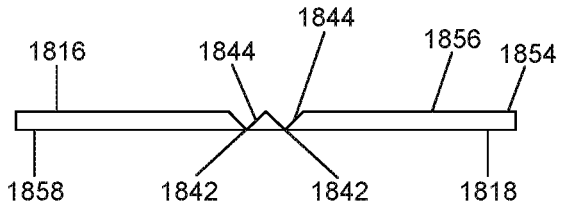
FIG. 85 illustrates a front side elevation view of the second beam of FIG. 84.
Figure 86:
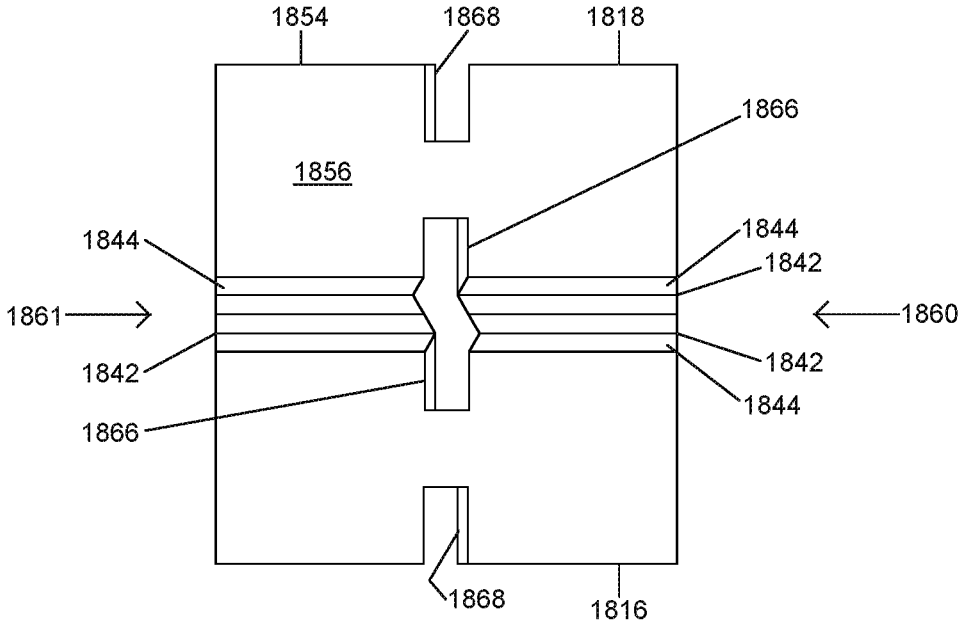
FIG. 86 illustrates a top plan view of the second beam of FIG. 84.
Figure 87:
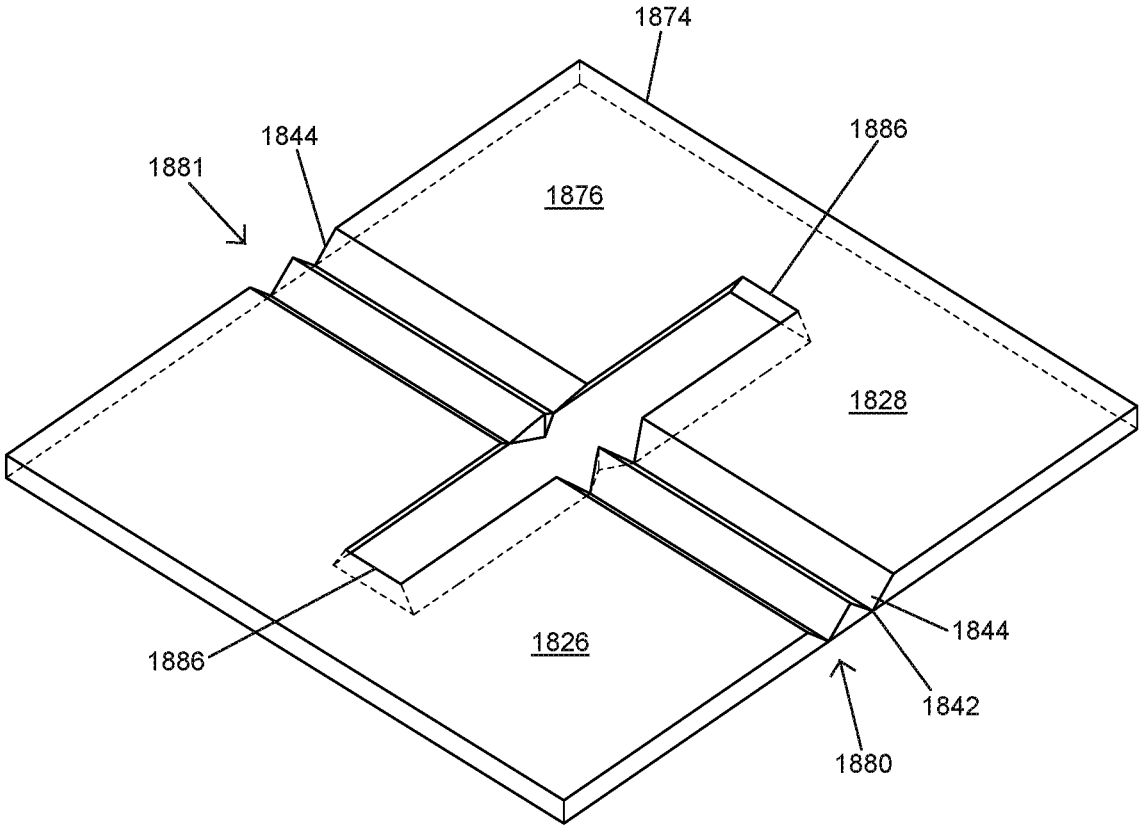
FIG. 87 illustrates a top, front, left perspective view of a third beam of the architectural fixture of FIG. 77.
Figure 88:
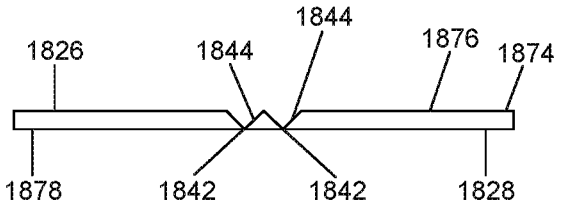
FIG. 88 illustrates a front side elevation view of the third beam of FIG. 87.
Figure 89:
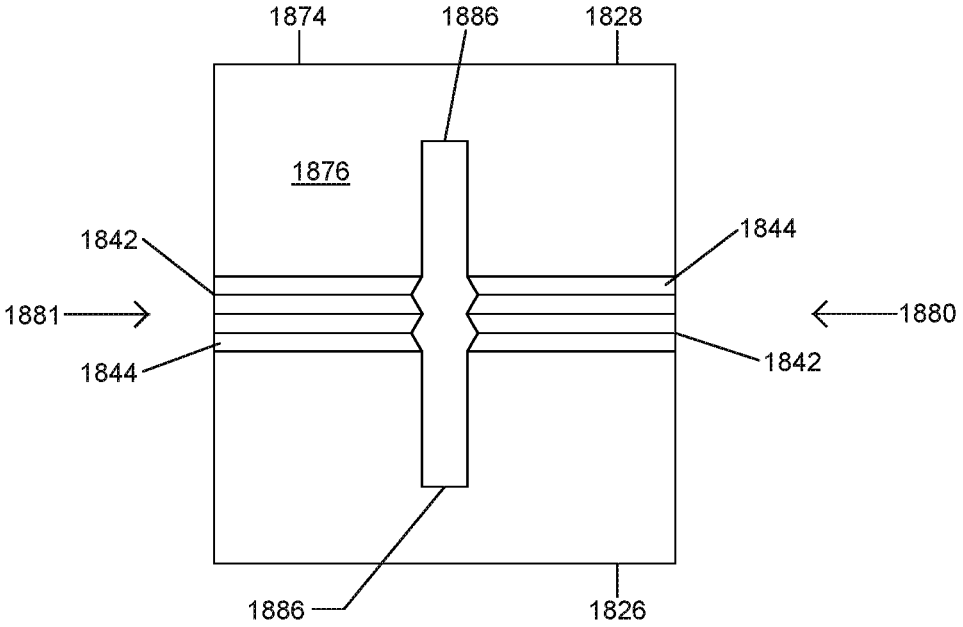
FIG. 89 illustrates a top plan view of the third beam of FIG. 87.

The portions of the sheet 1854 defining the first and second sides 1816, 1818 each include a generally rectangular alignment notch 1866, 1868. The alignment notches 1866, 1868 on the first and second sides 1816, 1818 are flipped images or reversed images in that they flip angles (i.e., one half of alignment notch 1866 is angling in one direction and the other half is angling in the other direction). Ultimately when the first and second sides 1816, 1818 fold up, the alignment notches 1866 1868 appear to be a continuous angle (as seen in FIG. 80). The walls of the alignment notches 1866, 1868 are angled such that the alignment notches 1866 will matingly engage the alignment notches 1846 of the second beam 1812 (the alignment notches 1866 of the second beam 1812 also having angled walls such that engagement of the alignment notches 1846, 1866 will result in the first and second beams 1802, 1812 being at a particular angle with respect to one another), and the alignment notches 1868 will matingly engage the alignment notches 1886 of the third beam 1822 (the alignment notches 1886 of the third beam 1822 also having angled walls such that engagement of the alignment notches 1866, 1886 will result in the second and third beams 1812, 1822 being at a particular angle with respect to one another). As illustrated, the notches 1866, 1868 are disposed about halfway along the length of the sheet 1834, but the notches 1866, 1868 can be positioned anywhere along the sheet 1854 as desired by the user. The alignment notches 1866, 1868 on the first side 1816 of the second beam 1812 are aligned with the alignment notches 1866, 1868 on the second side 1818 of the second beam 1812. The alignment notch 1866 generally extends from a bottom edge of the sides 1816, 1818 upwards towards the top edge of the sides 1816, 1818. The alignment notch 1868 generally extends from a top edge of the sides 1816, 1818 downwards towards the bottom edge of the sides 1816, 1818. The length of the alignment notches 1866, 1868 are configured such that the top and bottom edges of each beam 1802, 1812, 1822 are aligned.

The beam 1822 may be made from a generally flat, elongated sheet 1874 with a top side 1876, a bottom side 1878, a first end 1880, and a second end 1881. The sheet 1874 (similar to the sheets 1834, 1854) has a thickness and a longitudinal axis running along a center of the sheet 1874 between the first end 1880 and the second end 1881. A pair of fold lines 1842 extend between the first end 1880 and the second end 1881. The fold lines 1842 are disposed on the top side 1876 of the sheet 1874, on opposite sides of, and parallel with, the longitudinal axis. Each fold line 1842 includes a generally V-shaped cut 1844 on the top side 1876 of the sheet 1874 so that the sheet 1874 may cleanly fold without substantially compressing or deforming the material of the sheet 1874 that is otherwise present along the fold lines 1842. The fold lines 1842 define the bottom portion or side 1824, first side 1826, and second side 1828 of the third beam 1822. The folded first and second sides 1826, 1828 define the top side 1825 of the third beam 1822. The generally V-shaped cuts 1844 may be configured to permit the exposed edges to abut in a flush manner when the first and second sides 1826, 1828 are folded at a desired angle. The general rectangular shape of the beam 1822 is formed by the first side 1826 being folded upwards until the sides of the generally V-shaped cut 1844 engage, and the second side

1828 being folded upwards until the sides of the generally V-shaped cut 1844 engage, and the interior surfaces of the first and second sides 1826, 1828 contact each other when the first and second sides 1826, 1828 are folded together. The first end 1830 of the third beam 1822 and the first end 1880 of the sheet 1874 are the same end. The sheet 1874 is folded from a flat configuration to the generally rectangular-shaped configuration of the beam 1822.

The portions of the sheet 1874 defining the first and second sides 1826, 1828 each include a generally rectangular alignment notch 1886. The alignment notches 1886 on the first and second side 1826, 1828 are flipped images or reversed images of each other. The walls of the alignment notches 1886 are angled such that the alignment notches 1886 will matingly engage the alignment notches 1868 of the second beam 1812 (the alignment notches 1868 of the second beam 1812 also having angled walls such that engagement of the alignment notches 1868, 1886 will result in the second and third beams 1812, 1822 being at a particular angle with respect to one another, as well as the first and third beams 1802, 1822 being at a particular angle with respect to one another). As illustrated, the notches 1886 are disposed about halfway along the length of the sheet 1874, but the notches 1886 can be positioned anywhere along the sheet 1874 as desired by the user. The alignment notches 1886 on the first side 1826 of the third beam 1822 are aligned with the alignment notches 1886 on the second side 1828 of the third beam 1822. The alignment notches 1886 generally extend from a bottom edge of the sides 1826, 1828 upwards towards the top edge of the sides 1826, 1828. The length of the alignment notches 1886 are configured such that the top and bottom edges of each beam 1802, 1812, 1822 are aligned.

The beams 1802, 1812, 1822/sheets 1834, 1854, 1874 may be made using a sheet of one or more sound-absorbing/barrier (acoustical) materials including, but not limited to, fabric-covered synthetic polymer foam, fabric-covered glass wool composite material, or the like. Alternatively, the beams 1802, 1812, 1822/sheets 1834, 1854, 1874 may be made from other sound-absorbing materials including, but not limited to, synthetic foam or nonwoven polymer (without fabric), or synthetic foam or nonwoven polymer covered by a perforated metallic sheet, wood, wool or the like. In the alternative, the beams 1802, 1812, 1822/sheets 1834, 1854, 1874 may also be formed from a metallic sheet, a polymeric sheet, or the like. Alternatively, the beams 1802, 1812, 1822 may be directly formed in a generally rectangular-shaped beam configuration by various methods, such as those described above, without first being formed in a sheet and then folded into the generally rectangular-shaped beam configuration.

In accordance with an additional embodiment of the invention, an architectural fixture assembly 1800 is illustrated in FIGS. 92-97. The assembly 1800 has many similar, if not identical, features as described above in reference to the assemblies 100, 200, 300, 400, 500, 600, 700, 800, 900, 1000, 2000, except that the assembly 1800 describes an embodiment where three (3) beams 1802, 1812, 1822 are connected, and each beam 1802, 1812, 1822 is connected at an angle to the other two (2) beams.

In accordance with still another embodiment of the invention, an architectural fixture assembly 5000 is illustrated in FIGS. 92-97. The assembly 5000 has many similar, if not identical, features as described above in reference to the assemblies 100, 200, 300, 400, 500, 600, 700, 800, 900, 1000, 1800, 2000, 2500, but with beams engaging fins to produce an inclined generally wave-shaped configuration.

The architectural fixture assembly 5000 includes first and second fins 5002, 5004. The first fin 5002, 5004 includes a top side, a bottom side, and a plurality of pairs of alignment notches 5008 along a length of the fin 5002. The second fin 5004 includes a top side, a bottom side, and a plurality of pairs of alignment notches 5010 along a length of the fin 5004. The assembly 5000 also includes a first plurality of generally U-shaped beams 5014, wherein each beam 5014 includes a bottom side, a first side, a second side, a first end, and a second end, and interior surfaces of the first, second, and bottom sides of the each beam 5014 define an interior portion of the beam 5014. The beams 5014 are similar to the various beams described above in connection with the assemblies 100, 200, 300, 400, 500, 600, 700, 800, 900, 1000, 1800, 2000, 2500 in that the beams 5014, 5016 are made from the same/similar materials and constructed in a similar manner.

The first and second sides of each beam 5014 each include an alignment notch 5018 disposed near the first end of the beam 5014, and an alignment notch 5020 disposed near the second end of the beam 5014, such that the first end of each beam 5014 has a pair of alignment notches 5018, and the second end of each beam 5014 has a pair of alignment notches 502. The beams 5014 are generally disposed between the first and second fins 5002, 5004. The alignment notches 5018 of the first end of each beam 5014 are aligned with and engage a particular pair of alignment notches 5008 of the first fin 5002. The alignment notches 5020 of the second end of each beam 5014 are aligned with and engage a particular pair of alignment notches 5010 of the second fin 5004.

Figure 92:
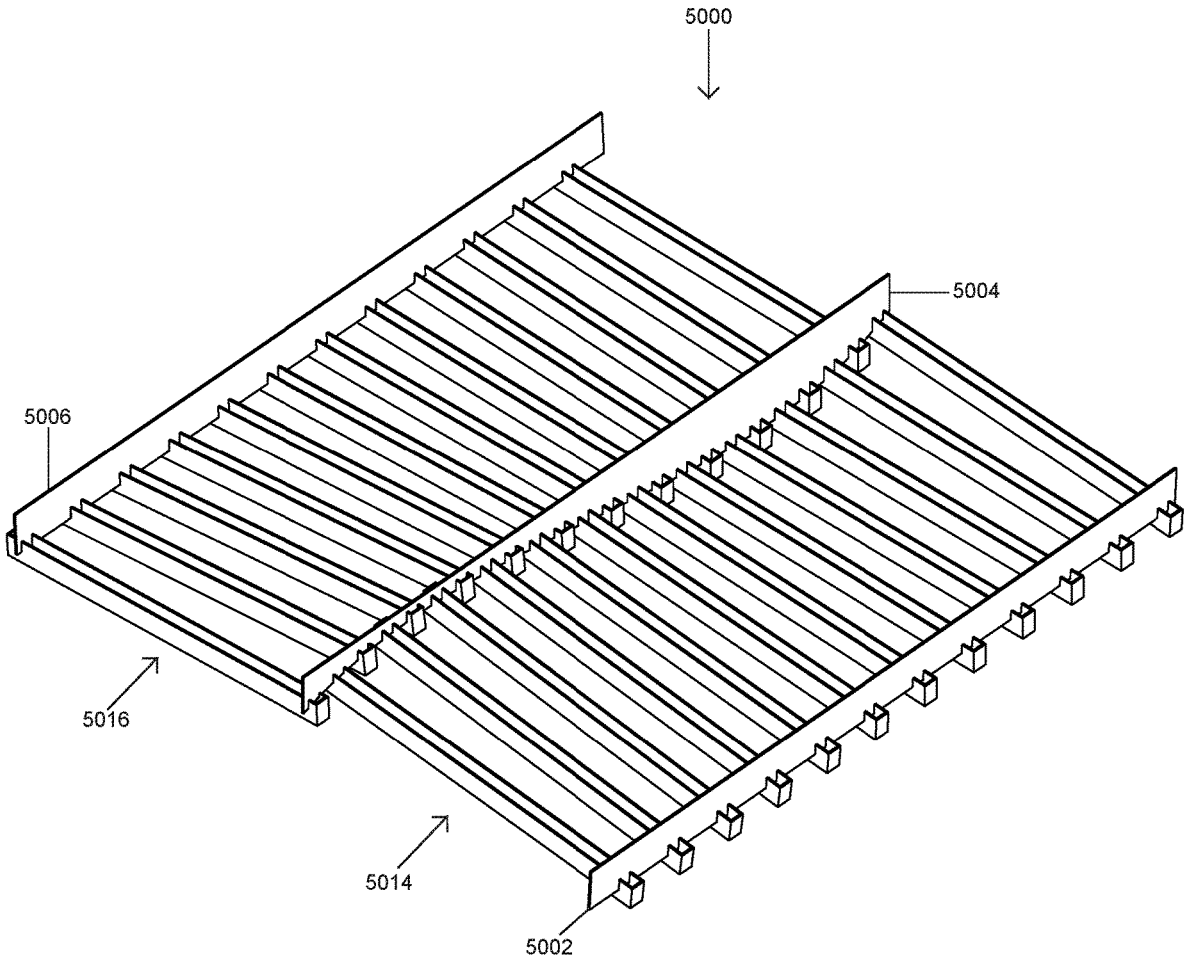
FIG. 92 illustrates a top, front, right perspective view of a further architectural fixture embodying the invention, with a plurality of beams engaging fins to produce an inclined generally wave-shaped configuration.
Figure 93:
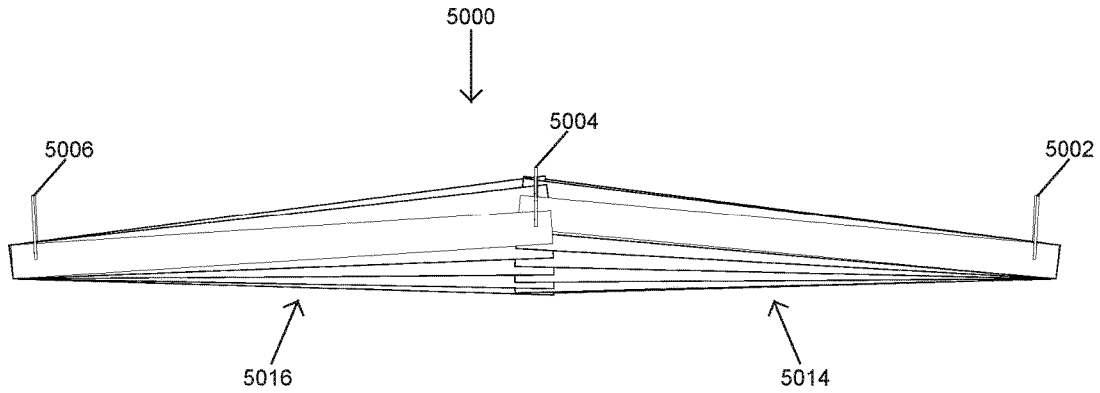
FIG. 93 illustrates a front side elevation view of the architectural fixture of FIG. 92.
Figure 94:
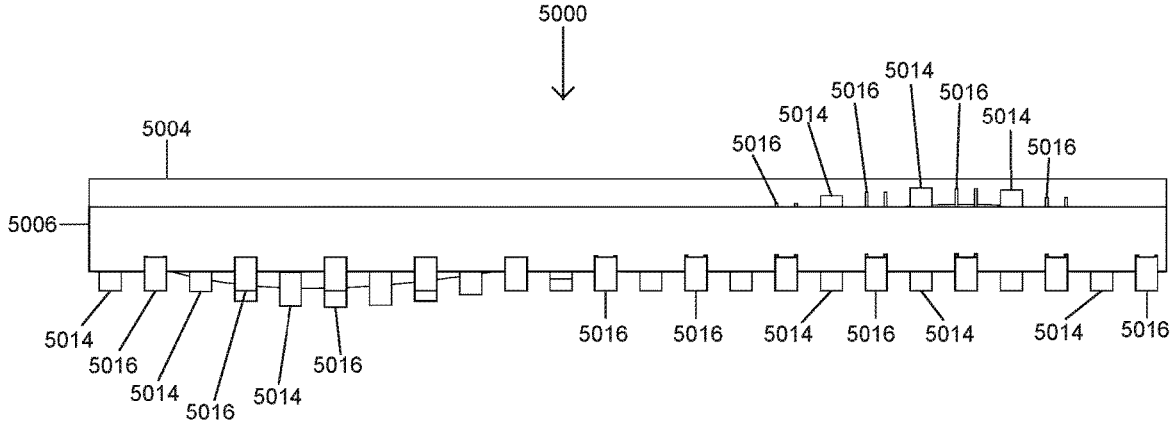
FIG. 94 illustrates a right side elevation view of the architectural fixture of FIG. 92.
Figure 95:
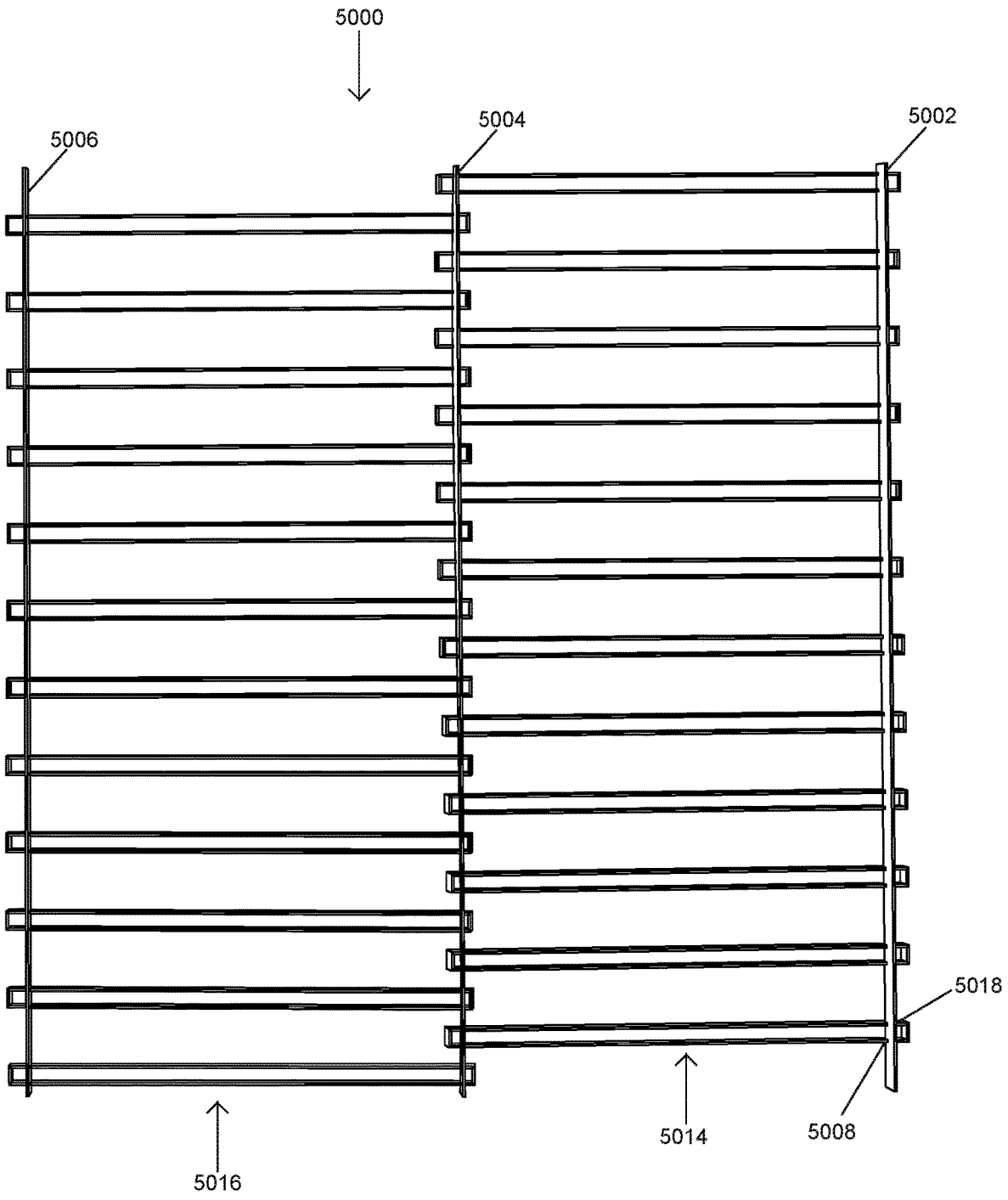
FIG. 95 illustrates a top plan view of the architectural fixture of FIG. 92.
Figure 96:
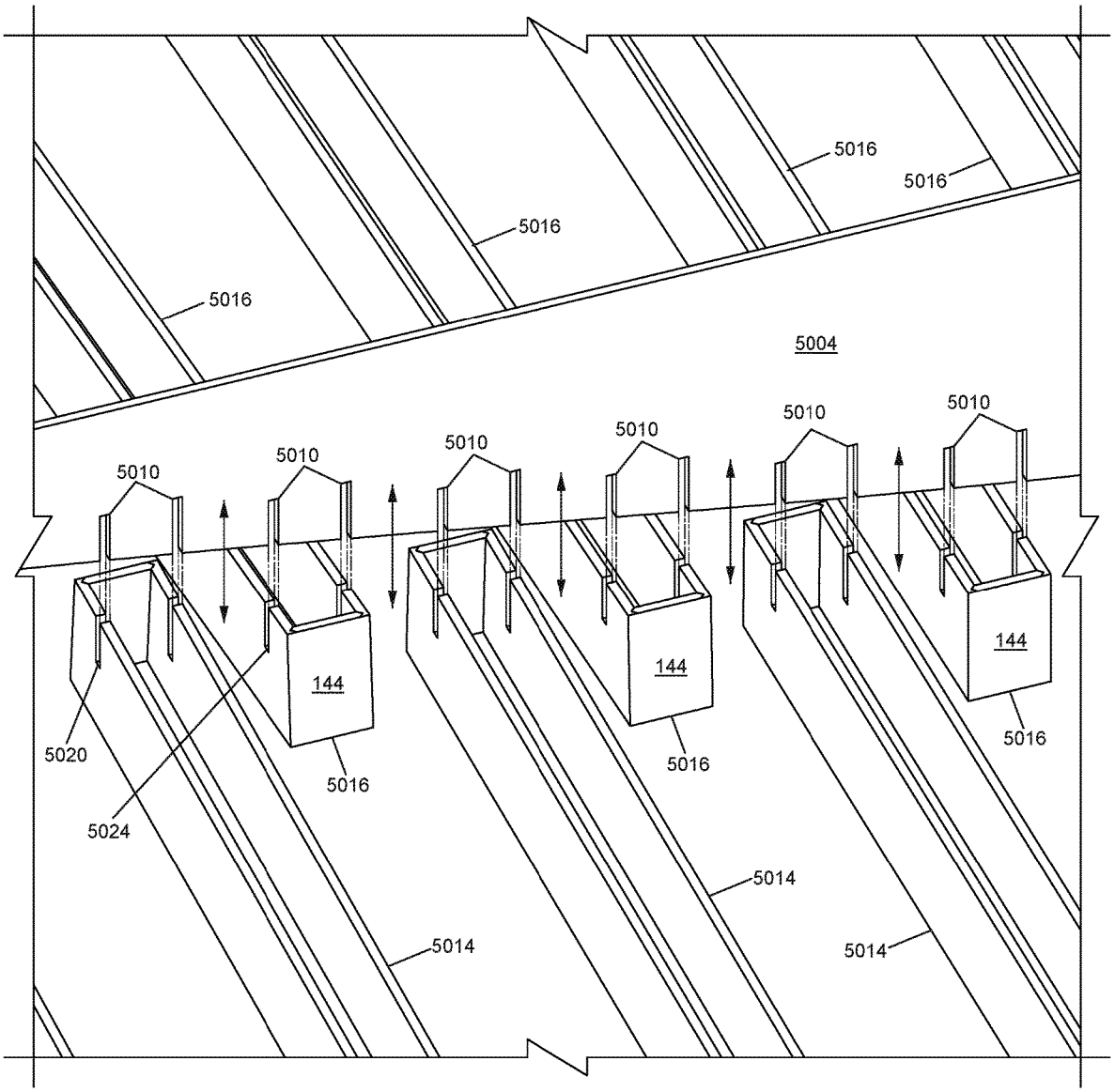
FIG. 96 illustrates an enlarged perspective view of the architectural fixture of FIG. 92, with double-ended arrows indicating directions of movement for the beams to engage with/disengage from the second fin.
Figure 97:
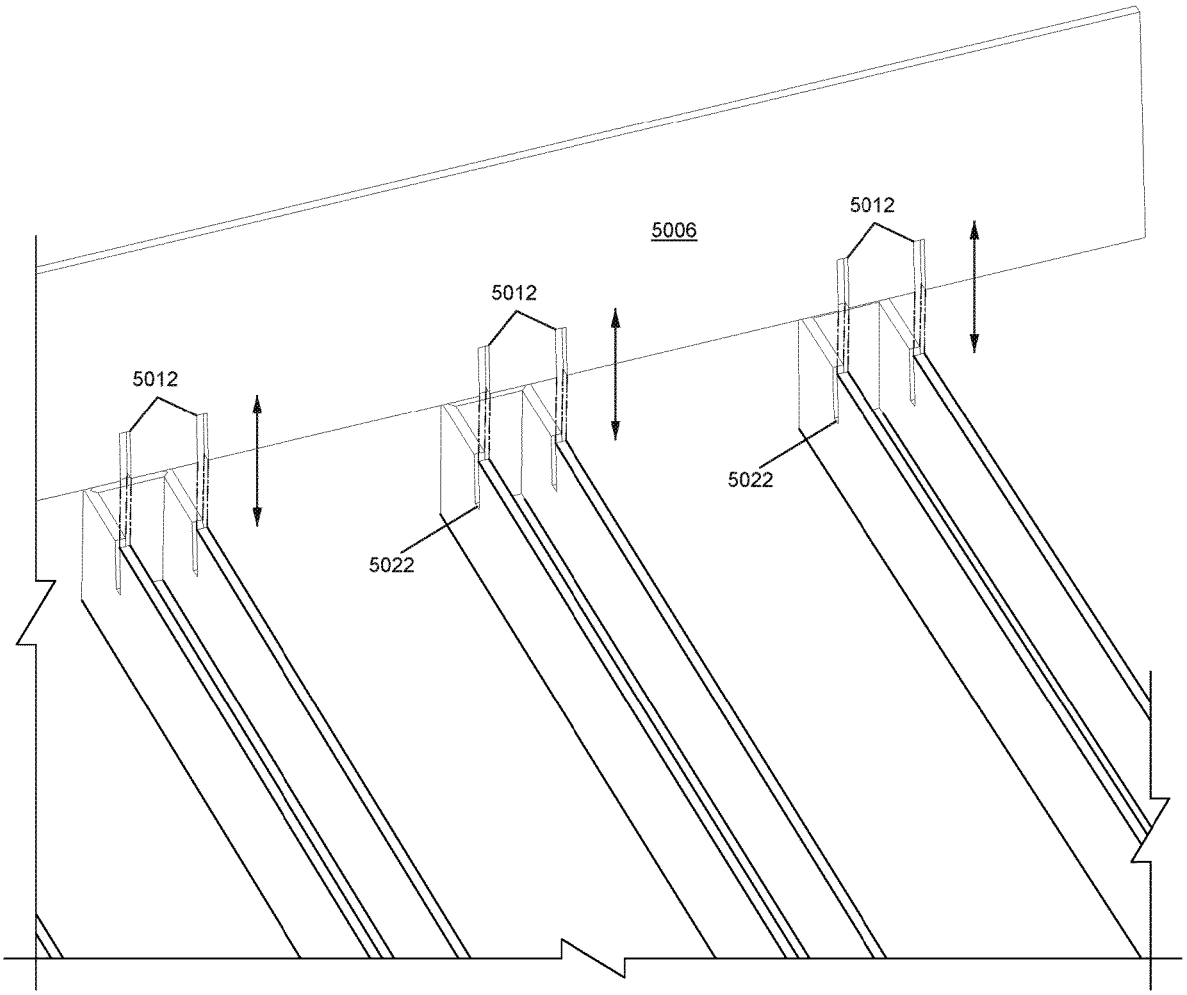
FIG. 97 illustrates an enlarged perspective view of the architectural fixture of FIG. 92, with double-ended arrows indicating directions of movement for the beams to engage with/disengage from the third fin.

The assembly 5000 further includes a third fin 5006. The third fin 5006 includes a top side, a bottom side, and a plurality of pairs of alignment notches 5012 along a length of the third fin 5006. The first and third fins 5002, 5006 are generally equal in size and shape. The second fin 5004 may have a regular or irregular shape. As partly seen in FIG. 94, the bottom side of the second fin 5004 may have a curving, wave-like shape along a length of the second fin 5004. The elevation of each fin 5002, 5004, 5006 may vary relative to the other fins (e.g., as seen in FIGS. 92-94, the first and third fins 5002, 5006 are generally level with each other such that the top sides of the fins 5002, 5006 are generally aligned, the bottom sides of the fins 5002, 5006 are generally aligned, and the top side of the second fin 5004 is higher than the top sides of the first and third fins 5002, 5006).

The assembly 5000 also includes a second plurality of generally U-shaped beams 5016, wherein each beam 5016 includes a bottom side, a first side, a second side, a first end, and a second end, and interior surfaces of the first, second, and bottom sides of the each beam 5016 define an interior portion of the beam 5016. The first and second sides of each beam 5016 of the second plurality of beams each include an alignment notch 5022 disposed near the first end of the beam 5016, and an alignment notch 5024 disposed near the second end of the beam 5014. The beams 5016 of the second plurality of beams are generally disposed between the third and second fins 5006, 5004, with the alignment notches 5022 of the first end of each beam 5016 of the second plurality of beams aligned with and engaging a particular pair of alignment notches 5012 of the third fin 5006; and the alignment notches 5024 of the second end of each beam 5016 of the second plurality of beams aligned with and engaging a particular pair of alignment notches 5010 of the second fin 5004.

The beams of the first and second plurality of beams 5014, 5016 alternatingly engage the second fin 5004 along a length of the second fin 5004. The pairs of alignment notches 5008, 5012 of the first and third fins 5002, 5006 are generally equal in depth whereby the first ends of the beams 5014 of the first plurality of beams are generally level with the first ends of the beams 5016 of the second plurality of beams. The depths of the pairs of alignment notches 5010 of the second fin 5004 may vary along the length of the second fin 5004 such that the second end of at least one beam 5014 of the first plurality of beams varies in elevation from the second end of at least one beam 5016 of the second plurality of beams. By varying the depths of the pairs of alignment notches 5010 of the second fin 5004, a user may create an assembly 5000 of inclined beams 5014, 5016 of any desired pattern. For example, the user may vary the depths of the pairs of alignment notches 5010 of the second fin 5004 such that the beams 5014, 5016 assembly 5000 give a wave-like appearance along the length of the assembly 5000 (e.g., the second ends of the beams 5014, 5016 rise in elevation and fall in elevation along the length of the assembly 5000). The angle of the alignment notches 5018, 5020, 5022, 5024 of any individual beams 5014, 5016 may be adjusted to compensate for that individual beam's angle of incline relative to the fins 5002, 5004, 5006 and their respective alignment notches 5008, 5010, 5012.

The architectural fixtures may include various patterns, features, designs, logos, cartoons or the like for ornamental purposes. The architectural fixtures may be monochromatic, or include various patterns (e.g., multi-color stripes, polka dots or the like) or the like for ornamental purposes.

Although the present invention has been discussed above in the context of attachment to a horizontal ceiling or vertical wall surface, the present invention may also be connected directly to or indirectly from various other surfaces.

In addition, the claimed invention is not limited in size and may be constructed in various sizes (e.g., miniature versions; large-scale versions) in which the same or similar principles of motion and friction control as described above would apply. Furthermore, the figures (and various components shown therein) of the specification are not to be construed as drawn to scale.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

More generally, the word "assembly" may reflect an actual physical grouping of distinct components in a single physical assemblage or a combination of physical and/or functional interaction of portions of one or more distinct components where one or more of the components can serve a particular function as a part of one assembly and other particular function(s) as part of one or more other assemblies. In other words, a single component can serve different functions as part of different assemblies.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "front," "rear," "left," "right," "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

What is claimed is:

1. An architectural fixture assembly configured for attachment to a wall or a ceiling, the assembly comprising:

a first beam being generally U-shaped and including a bottom side, a first side extending from the bottom side to a first distal end, a second side extending from the bottom side to a second distal end, and a first end, wherein interior surfaces of the first, second, and bottom sides of the first beam define an interior portion;

a connector including a plate comprising a front side, a back side, and a connection key attached to and extending from the back side of the plate;

wherein the interior surface of the first side comprises a first alignment notch that is generally V-shaped and disposed generally adjacent to the first end of the first beam, the first alignment notch extending from the first distal end of the first side downwardly towards the bottom side, and wherein the interior surface of the second side comprises a second alignment notch that is generally V-shaped and disposed generally adjacent to the first end of the first beam, the second alignment notch extending from the second distal end of the second side downwardly towards the bottom side;

wherein the connection key includes a pair of generally V-shaped sides disposed on opposite sides of the connection key; and wherein each generally V-shaped side is configured to slidably engage one of the first and second alignment notches.

2. The assembly of claim 1, wherein the connector further includes a flange configured to be secured to a generally flat surface.

3. The assembly of claim 1, further including a light fixture operationally engaging the plate.

4. The assembly of claim 1, further including an audio speaker operationally engaging the plate.

5. The assembly of claim 1, further including a sign operationally engaging the plate.

6. The assembly of claim 1, further including a planter operationally engaging the p late.

7. The assembly of claim 1, further including a sprinkler of a sprinkler system operationally engaging the plate.

8. The assembly of claim 1, further comprising a generally U-shaped second beam including a bottom side, a first side, a second side, and a first end, wherein interior surfaces of the first, second, and bottom sides of the second beam define an interior portion; wherein the interior surfaces of the first and second sides of the second beam each include a generally V-shaped alignment notch disposed generally adjacent to the first end of the second beam; wherein the connector further includes a second plate, and a second connection key extending away from the second plate; wherein the second connection key includes a pair of generally V-shaped sides disposed on opposite sides of the second connection key; and wherein each generally V-shaped side of the second connection key is configured to slidably engage one of the generally V-shaped alignment notches of the second beam.

9. The assembly of claim 1, further comprising a plurality of generally U-shaped beams, wherein each beam of the plurality of beams including a bottom side, a first side, a second side, and a first end, wherein interior surfaces of the first, second, and bottom sides of each beam of the plurality of the beams define an interior portion of that beam; wherein the interior surfaces of the first and second sides of each beam of the plurality of beams each include a generally V-shaped alignment notch disposed generally adjacent to the first end of the that beam; wherein the connector further includes a plurality of plates, and a plurality of connection keys, and wherein each connection key extends away from a particular one of the plurality of plates; wherein each connection key of the plurality of connection keys includes a pair of generally V-shaped sides disposed on opposite sides of that connection key; and wherein each generally V-shaped side of each connection key of the plurality of connection keys is configured to slidably engage a particular one of the generally V-shaped alignment notches of a particular beam of the plurality of beams.

10. The assembly of claim 9, wherein the plates of the connector are configured in a quadrangle.

11. The assembly of claim 9, wherein the connector is configured to engage the beams to form at least one of a generally L-shaped beam configuration, a generally Y-shaped beam configuration, a generally T-shaped beam configuration, and a generally X-shaped beam configuration.

12. The assembly of claim 9, wherein a shape of a beam configuration is configured from a number of plates of the plurality of plates of the connector, wherein each plate of the number of plates includes one of the plurality of connection keys extending away therefrom and engaging a particular one of the beams.

13. The assembly of claim 1, wherein the beam comprises a sound-absorbing material.

14. The assembly of claim 1, wherein the beam includes a light fixture at least partially disposed within the interior portion.

15. The assembly of claim 14, wherein the beam comprises a light- diffusive material configured to glow when the light fixture is illuminated.

16. The assembly of claim 1, wherein the beam includes a speaker at least partially disposed within the interior portion.

17. The assembly of claim 1, wherein the beam includes a planter at least partially disposed within the interior portion.

18. The assembly of claim 1, wherein the beam includes a portion of a sprinkler system at least partially disposed within the interior portion.

19. The assembly of claim 1, wherein the beam includes a portion of an HVAC system at least partially disposed within the interior portion.

20. The assembly of claim 1, wherein the beam includes additional sound-absorbing material at least partially disposed within the interior portion.

21. The assembly of claim 1, further including a spacer having a pair of generally V-shaped sides disposed on opposite sides of the spacer; wherein the interior surface of the first side of the first beam includes a third alignment notch disposed generally adjacent to the first alignment notch; and wherein the interior surface of the second side of the first beam includes a fourth alignment notch disposed generally adjacent to the second alignment notch, and wherein each generally V-shaped side of the spacer is configured to engage one of the third and fourth alignment notches.

22. The architectural fixture according to claim 1 wherein the interior surfaces of the first and second sides are oriented perpendicular relative to the interior surface of the bottom side.

23. The architectural fixture according to claim 1 wherein the first and second alignment notches are oriented perpendicular relative to the interior surface of the bottom side of the first beam.

24. The architectural fixture according to claim 1 wherein the first alignment notch extends from the first distal end of the first side to the interior surface of the bottom side, and wherein the second alignment notch extends from the second distal end of the second side to the interior surface of the bottom side.

25. The architectural fixture according to claim 1 wherein the first and second alignment notches are non-parallel relative to the bottom side of the first beam.

26. The architectural fixture according to claim 1 wherein the connection key overlies the back side of the plate so that a plane that is perpendicular to the front and back sides of the plate intersects the plate and the connection key.

27. The architectural fixture according to claim 1 wherein the connection key comprises a first surface that is in direct contact with the back side of the plate, a second surface opposite the first surface, and the pair of generally V-shaped sides which comprises a first V-shaped side which extends between the first and second surfaces and a second V-shaped side which extends between the first and second surfaces.

28. The architectural fixture according to claim 27 wherein each of the first and second V-shaped sides comprises a first linear portion that extends from the first surface of the connection key and a second linear portion that extends from the first linear portion to the second surface of the connection key, the first linear portions of the first and second V-shaped sides diverging with increasing distance from the back side of the plate and the second linear portions of the first and second V-shaped sides converging with increasing distance from the back side of the plate.

29. The architectural fixture according to claim 1 wherein when the connector is coupled to the first beam, each generally V-shaped side of the connection key nests within one of the first and second alignment notches, a first portion of the back side of the plate of the connector covers a first end surface of the first side of the first beam, and a second portion of the back side of the plate of the connector covers a second end surface of the second side of the first beam.

30. The architectural fixture according to claim 29 wherein the connection key is located on a third portion of the back side of the plate of the connector which extends between the first and second portions of the back side of the plate.

31. An architectural fixture assembly comprising:

a generally U-shaped beam including a bottom side, a first side, a second side, a first end, and a second end, wherein interior surfaces of the first, second, and bottom sides of the beam define an interior portion;

first and second connectors;

wherein, at each of the first and second ends of the beam, the interior surfaces of the first and second sides of the beam include a pair of generally V-shaped alignment notches generally adjacent to the first and second ends of the beam;

wherein the first and second connectors each include a pair of generally V-shaped sides disposed on opposite sides of the connector;

wherein each generally V-shaped side of the first and second connectors is configured to slidably engage one of the generally V-shaped alignment notches so that each generally V-shaped side of the first and second connectors nests within one of the generally V-shaped alignment notches formed in the interior surfaces of the first and second sides of the beam; and wherein an outwardly facing portion of each of the first and second connectors is flush with one of the first and second ends of the beam.

32. An architectural fixture assembly comprising:

a first beam extending from a first end to a second end along a first longitudinal axis, the first beam comprising a bottom side, a first side extending upwardly from the bottom side to a distal end, and a second side extending upwardly from the bottom side to a distal end, wherein interior surfaces of the first, second, and bottom sides of the first beam define an interior portion, wherein first end portions of each of the first, second, and bottom sides collectively form the first end of the first beam, and wherein second end portions of each of the first, second, and bottom sides collectively form the second end of the first beam;

a first alignment notch in the interior surface of the first side, the first alignment notch extending from the distal end of the first side downwardly towards the bottom side;

a second alignment notch in the interior surface of the second side, the second alignment notch extending from the distal end of the first side downwardly towards the bottom side;

a connector comprising a plate having a first surface and a first connection key attached to the first surface of the plate, the first connection key comprising a first lateral side and a second lateral side, the first lateral side comprising a first alignment feature and the second lateral side comprising a second alignment feature;

wherein the connector is slidably coupled to the first beam via engagement between the first and second alignment features of the connector and the first and second alignment notches of the first beam, respectively; and wherein when the connector is coupled to the first beam, a portion of the first surface of the plate covers one of the first and second ends of the first beam.

33. The architectural fixture assembly according to claim 32 wherein the first and second alignment notches are formed into the interior surfaces of the first and second sides at a position adjacent to the first end of the first beam, and wherein the connector closes an opening at the first end of the first beam.

34. The architectural fixture assembly according to claim 32 wherein the first alignment feature is dictated by a shape of the first lateral side of the first connection key and wherein the second alignment feature is dictated by a shape of the second lateral side of the first connection key, and wherein at least a portion of the first lateral side of the first connection key nests within the first alignment notch in the first side of the first beam and at least a portion of the second lateral side of the first connection key nests within the second alignment notch in the second side of the first beam when the connector is coupled to the first beam.

35. The architectural fixture assembly according to claim 32 wherein when the connector is coupled to the first beam, the first connection key is positioned within the interior portion of the first beam and the plate portion abuts one of the first and second ends of the first beam.

36. The architectural fixture assembly according to claim 35 wherein when the connector is coupled to the first beam, the plate portion abuts against the first end of the first beam.

37. The architectural fixture assembly according to claim 32 wherein each of the first and second alignment notches have a generally V-shape, and wherein the first and second lateral sides of the first connection key have a generally V-shape that mates with the V-shape of the first and second alignment notches to slidably couple the connector to the first beam.

38. The architectural fixture assembly according to claim 32 wherein the first and second alignment notches are located immediately adjacent to the first end of the first beam.

39. The architectural fixture assembly according to claim 32 wherein the first alignment notch extends from the distal end of the first side to the bottom side, and wherein the second alignment notch extends from the distal end of the second side to the bottom side.

40. The architectural fixture according to claim 32 wherein the first beam is configured to be hung from a ceiling.

41. The architectural fixture according to claim 32 wherein the first beam is elongated in a direction between the first and second ends of the first beam.

42. The architectural fixture according to claim 41 wherein the first beam has a length measured between the first and second ends and a height measured from a bottom end of the first side to the distal end of the first side, the length being greater than the height.

43. The architectural fixture according to claim 32 wherein when the connector is coupled to the first beam, the first alignment feature of the connection key nests within the first alignment notch in the interior surface of the first side of the first beam and the second alignment feature of the connection key nests within the second alignment notch in the interior surface of the second side of the first beam.

44. The architectural fixture according to claim 32 wherein the first surface of the plate comprises a first portion, a second portion, and a third portion located between the first and second portions, the first connection key overlying the third portion of the first surface of the plate, wherein the first end of the first beam comprises a first portion formed by the first side and a second portion formed by the second side, wherein the first portion of the first surface of the plate covers the first portion of the first end of the first beam that is formed by the first side of the first beam, and wherein the second portion of the first surface of the plate covers the second portion of the first end of the first beam that is formed by the second side of the first beam.

45. The architectural fixture according to claim 32 wherein the first connection key comprises a top end and a bottom end and wherein the plate comprises a top edge and a bottom edge, wherein the top end of the first connection key is flush with the top end of the plate and the bottom end of the first connection key is spaced apart from the bottom edge of the plate by a distance which is equal to a thickness of the bottom side of the first beam so that when the connector is coupled to the first beam a bottom portion of the plate covers a portion of the first end of the first beam that is formed by the bottom side of the first beam.

* * * * *